US007909533B2

(12) United States Patent
Quenzi et al.

(10) Patent No.: US 7,909,533 B2
(45) Date of Patent: Mar. 22, 2011

(54) APPARATUS FOR SCREEDING UNCURED CONCRETE SURFACES

(75) Inventors: Philip J. Quenzi, Atlantic Mine, MI (US); Russ E. Stein, Houghton, MI (US); Mark A. Pietila, Atlantic Mine, MI (US); Carl B. Kieranen, Chassel, MI (US); Philip D. Halonen, Calumet, MI (US); Howard E. Hohmann, Jr., Evans City, PA (US)

(73) Assignee: Somero Enterprises, Inc., Fort Myers, FL (US)

( * ) Notice: Subject to any disclaimer, the term of this patent is extended or adjusted under 35 U.S.C. 154(b) by 111 days.

(21) Appl. No.: 12/356,635

(22) Filed: Jan. 21, 2009

(65) Prior Publication Data

US 2009/0123229 A1 May 14, 2009

Related U.S. Application Data

(60) Division of application No. 11/965,066, filed on Dec. 27, 2007, now Pat. No. 7,491,011, which is a continuation of application No. 11/580,722, filed on Oct. 13, 2006, now Pat. No. 7,320,558, which is a continuation of application No. 10/902,528, filed on Jul. 29, 2004, now Pat. No. 7,121,762, which is a continuation-in-part of application No. 10/728,620, filed on Dec. 5, 2003, now Pat. No. 6,953,304, which is a division of application No. 10/266,305, filed on Oct. 8, 2002, now Pat. No. 6,976,805.

(60) Provisional application No. 60/327,964, filed on Oct. 9, 2001, provisional application No. 60/341,721, filed on Dec. 18, 2001, provisional application No. 60/354,866, filed on Feb. 5, 2002.

(51) Int. Cl.
*E01C 19/22* (2006.01)

(52) U.S. Cl. ..... 404/114; 404/118

(58) Field of Classification Search ..... 404/114, 404/118

See application file for complete search history.

(56) References Cited

U.S. PATENT DOCUMENTS 791,726 A 6/1905 Schutte (Continued)

FOREIGN PATENT DOCUMENTS

CA 2051776 12/1995

(Continued)

OTHER PUBLICATIONS

Engineering News-Record, Plymouth Locomotive Works, p. 78, May 26, 1949.

(Continued)

*Primary Examiner* — Gary S Hartmann

(74) *Attorney, Agent, or Firm* — Van Dyke, Gardner, Linn & Burkhart, LLP

(57) ABSTRACT

A wheeled screeding device includes a wheeled support having a frame portion supported by at least one wheel, with the at least one wheel defining an axis of rotation. A screed head is mounted to the frame portion and is balanced such that the screed head is at least partially supportable on an uncured concrete surface. The screed head is adapted to impart a force onto the uncured concrete surface. An adjustment device may be operable to adjust a balance of the wheeled support about the axis of rotation to adjust the force imparted by the screed head. The screed head may be pivotable about an axis generally normal to the axis of rotation of the wheel and relative to the at least one wheel to adjust an angle of the screed head relative to the axis of rotation of the wheel.

13 Claims, 33 Drawing Sheets

U.S. PATENT DOCUMENTS

| | | | | | |
|---|---|---|---|---|---|
| 842,770 | A | | 1/1907 | Connelly | |
| 1,695,202 | A | | 12/1928 | Newell | |
| 1,955,101 | A | | 4/1934 | Sloan | 94/48 |
| 2,009,542 | A | | 7/1935 | Day | 94/45 |
| 2,032,205 | A | | 2/1936 | Gage | 94/33 |
| 2,180,198 | A | | 11/1939 | Day | 94/46 |
| 2,219,246 | A | | 10/1940 | Jackson | 94/45 |
| 2,248,247 | A | | 7/1941 | Nichols | 94/45 |
| 2,255,343 | A | | 9/1941 | Baily | 94/45 |
| 2,296,453 | A | | 9/1942 | Saffert | 25/155 |
| 2,303,335 | A | | 12/1942 | Day | 94/24 |
| 2,314,985 | A | | 3/1943 | Jackson | 94/45 |
| 2,373,828 | A | | 4/1945 | Harrington | 94/45 |
| 2,378,065 | A | | 6/1945 | Crock | 94/45 |
| 2,386,662 | A | | 10/1945 | Crock | 94/45 |
| 2,400,321 | A | | 5/1946 | Troxell | 94/45 |
| 2,449,851 | A | | 9/1948 | Jackson | 94/45 |
| 2,453,510 | A | | 11/1948 | Jackson | 94/48 |
| 2,492,431 | A | | 12/1949 | Kroeckel | 259/1 |
| 2,584,459 | A | | 2/1952 | Jackson | 94/48 |
| 2,599,330 | A | | 6/1952 | Jackson | 94/48 |
| 2,635,888 | A | * | 4/1953 | Bailiff | 172/246 |
| 2,651,980 | A | | 9/1953 | Wells et al. | 94/48 |
| 2,746,367 | A | | 5/1956 | Ferguson | 94/49 |
| 2,916,836 | A | | 12/1959 | Stewart et al. | 37/143 |
| 3,067,656 | A | | 12/1962 | Gustafsson | 94/45 |
| 3,088,384 | A | | 5/1963 | Heer et al. | 94/46 |
| 3,095,789 | A | | 7/1963 | Melvin et al. | 94/45 |
| 3,147,678 | A | | 9/1964 | Lewis | 94/45 |
| 3,262,378 | A | | 7/1966 | Schrimper et al. | 94/46 |
| 3,396,642 | A | | 8/1968 | Martinson | 94/39 |
| 3,403,609 | A | | 10/1968 | Bradshaw et al. | 94/46 |
| 3,406,761 | A | | 10/1968 | Ryan | 172/42 |
| 3,412,658 | A | | 11/1968 | Griffin | 94/45 |
| 3,427,939 | A | | 2/1969 | Braff et al. | 94/48 |
| 3,540,360 | A | | 11/1970 | Snow et al. | 94/46 |
| 3,681,484 | A | | 8/1972 | McKie et al. | 264/34 |
| 3,838,933 | A | | 10/1974 | Lehman et al. | 404/114 |
| 3,850,541 | A | | 11/1974 | Baillet et al. | 404/114 |
| 3,871,788 | A | | 3/1975 | Barsby | 404/117 |
| 3,883,259 | A | | 5/1975 | Berg et al. | 404/120 |
| 3,918,214 | A | | 11/1975 | Buschman | 51/170 |
| 4,043,694 | A | | 8/1977 | Mullen | 404/133 |
| 4,224,003 | A | | 9/1980 | St. Louis | 404/133 |
| 4,249,327 | A | | 2/1981 | Allen | 404/114 |
| 4,256,416 | A | | 3/1981 | Bishop | 404/119 |
| 4,314,773 | A | | 2/1982 | Allen | 404/116 |
| 4,318,631 | A | | 3/1982 | Vickers | 404/93 |
| 4,343,568 | A | | 8/1982 | Kaltenegger | 404/133 |
| 4,349,295 | A | | 9/1982 | Morrison | 404/114 |
| 4,359,296 | A | | 11/1982 | Cronkhite | 404/114 |
| 4,375,351 | A | | 3/1983 | Allen | 425/456 |
| 4,379,653 | A | | 4/1983 | Brown | 404/118 |
| 4,386,901 | A | | 6/1983 | Morrison | 425/456 |
| 4,388,018 | A | | 6/1983 | Boschung | 404/113 |
| 4,408,978 | A | | 10/1983 | Owens | 425/456 |
| 4,427,358 | A | | 1/1984 | Stilwell | 425/432 |
| 4,431,336 | A | | 2/1984 | Nightengale et al. | 404/97 |
| 4,449,845 | A | | 5/1984 | Carrillo | 404/118 |
| 4,470,783 | A | | 9/1984 | Friebel et al. | 425/62 |
| 4,499,779 | A | | 2/1985 | Maass | 74/61 |
| 4,591,291 | A | | 5/1986 | Owens | 404/118 |
| 4,614,486 | A | | 9/1986 | Bragagnini | 425/62 |
| 4,641,995 | A | | 2/1987 | Owens | 404/118 |
| 4,650,366 | A | | 3/1987 | Morrison | 404/114 |
| 4,701,071 | A | | 10/1987 | Morrison | 404/114 |
| 4,702,641 | A | | 10/1987 | Naser et al. | 404/97 |
| 4,729,194 | A | | 3/1988 | Maier et al. | 51/170 |
| 4,734,022 | A | | 3/1988 | Shimabukuro | 425/62 |
| 4,752,156 | A | | 6/1988 | Owens | 404/118 |
| 4,798,494 | A | | 1/1989 | Allen | 404/114 |
| 4,838,730 | A | | 6/1989 | Owens | 404/114 |
| 4,848,961 | A | | 7/1989 | Rouillard | 404/114 |
| 4,856,932 | A | | 8/1989 | Kraft | 404/118 |
| 4,861,188 | A | | 8/1989 | Rouillard | 404/75 |
| 4,892,437 | A | | 1/1990 | Kraft | 404/97 |
| 4,911,575 | A | | 3/1990 | Tidwell | 404/97 |
| 5,016,319 | A | | 5/1991 | Stigen | 16/114 |
| 5,039,249 | A | | 8/1991 | Hansen et al. | 404/84 |
| 5,062,738 | A | | 11/1991 | Owens | 404/114 |
| 5,080,525 | A | | 1/1992 | Bricher et al. | 404/96 |
| 5,096,330 | A | | 3/1992 | Artzberger | 404/97 |
| 5,129,803 | A | | 7/1992 | Nomura et al. | 425/62 |
| 5,156,487 | A | | 10/1992 | Haid | 404/72 |
| 5,190,401 | A | | 3/1993 | Wilson | 404/118 |
| 5,234,283 | A | | 8/1993 | Adkins | 404/97 |
| 5,244,305 | A | | 9/1993 | Lindley | 404/97 |
| 5,279,501 | A | | 1/1994 | Shelly | 404/118 |
| 5,288,166 | A | | 2/1994 | Allen et al. | 404/84.1 |
| 5,289,880 | A | * | 3/1994 | Barto | 172/799.5 |
| 5,328,295 | A | | 7/1994 | Allen | 404/84.1 |
| 5,352,063 | A | | 10/1994 | Allen et al. | 404/84.1 |
| 5,375,942 | A | | 12/1994 | Lindley et al. | 404/97 |
| 5,540,519 | A | | 7/1996 | Weber | 404/102 |
| 5,556,226 | A | | 9/1996 | Hohmann, Jr. | 404/84.1 |
| 5,567,075 | A | | 10/1996 | Allen | 404/84.5 |
| 5,676,489 | A | | 10/1997 | Willhoite | 404/93 |
| 5,778,482 | A | | 7/1998 | Sbrigato | 15/245.1 |
| 5,779,390 | A | | 7/1998 | Tuusinen | 404/101 |
| 5,803,656 | A | | 9/1998 | Turck | 404/103 |
| 5,807,022 | A | | 9/1998 | McCleary | 404/97 |
| 5,857,803 | A | | 1/1999 | Davis et al. | 404/102 |
| 5,924,819 | A | | 7/1999 | Breidenbach | 404/96 |
| 5,984,571 | A | | 11/1999 | Owens | 404/97 |
| 6,022,171 | A | | 2/2000 | Munoz | 404/124 |
| 6,029,752 | A | | 2/2000 | Young | 172/4.5 |
| 6,056,474 | A | | 5/2000 | Nolan | 404/118 |
| 6,089,787 | A | | 7/2000 | Allen et al. | 404/118 |
| 6,139,217 | A | | 10/2000 | Reuter | 404/97 |
| 6,155,708 | A | | 12/2000 | Lindley | 366/123 |
| 6,174,105 | B1 | | 1/2001 | Holmes et al. | 404/104 |
| 6,200,065 | B1 | | 3/2001 | Eitzen | 404/114 |
| 6,223,495 | B1 | | 5/2001 | Shaw et al. | 52/749.1 |
| 6,231,331 | B1 | | 5/2001 | Lievers | 425/183 |
| 6,238,135 | B1 | | 5/2001 | Rower | 404/84.5 |
| 447,152 | A1 | | 8/2001 | Cunningham et al. | D15/10 |
| 6,293,780 | B1 | | 9/2001 | Rijkers | 425/456 |
| 6,296,467 | B1 | | 10/2001 | Rouillard | 425/182 |
| 6,302,619 | B2 | | 10/2001 | Fix | 404/84.1 |
| 6,322,286 | B1 | | 11/2001 | Rijkers | 404/114 |
| 6,325,531 | B1 | | 12/2001 | Lindley | 366/121 |
| 6,336,769 | B1 | | 1/2002 | Cincis et al. | 404/118 |
| 6,623,208 | B2 | | 9/2003 | Quenzi et al. | 404/84.8 |
| 6,685,390 | B1 | | 2/2004 | Eitzen | 404/119 |
| 6,953,304 | B2 | | 10/2005 | Quenzi et al. | 404/114 |
| 6,976,805 | B2 | * | 12/2005 | Quenzi et al. | 404/114 |
| 7,044,681 | B2 | | 5/2006 | Quenzi et al. | 404/84.1 |
| 7,121,762 | B2 | | 10/2006 | Quenzi et al. | |
| 7,175,363 | B2 | | 2/2007 | Quenzi et al. | 404/84.1 |
| 7,195,423 | B2 | | 3/2007 | Halonen et al. | |
| 7,320,558 | B2 | | 1/2008 | Quenzi et al. | |
| 7,396,186 | B2 | | 7/2008 | Quenzi et al. | |
| 7,407,339 | B2 | | 8/2008 | Halonen et al. | |
| 7,491,011 | B2 | * | 2/2009 | Quenzi et al. | 404/84.1 |
| 7,559,719 | B2 | * | 7/2009 | Nasby | 404/96 |
| 2001/0046179 | A1 | | 11/2001 | Lindley | 366/121 |

FOREIGN PATENT DOCUMENTS

| | | |
|---|---|---|
| CH | 352485 | 4/1961 |
| DE | 42402 | 11/1965 |
| DE | 2019631 | 11/1971 |
| DE | 3046433 | 7/1982 |
| DE | 4138011 | 5/1993 |
| EP | 1312717 | 5/2003 |
| FR | 636563 | 4/1928 |
| FR | 1227346 | 3/1960 |
| FR | 1417130 | 10/1965 |
| FR | 1479494 | 3/1967 |
| FR | 2644806 | 3/1989 |
| GB | 308423 | 3/1929 |
| GB | 819621 | 9/1959 |
| IT | 358073 | 4/1938 |
| JP | 6306813 | 1/1994 |
| NO | 78783 | 7/1951 |
| RU | 436125 | 11/1974 |
| SE | 173454 | 11/1960 |
| SE | 176924 | 10/1961 |

OTHER PUBLICATIONS

Construction Methods, p. 21, Oct. 1964.

Whiteman Manufacturing Co., Portable Screeding Machines Brochure, Jun. 18, 1958.

* cited by examiner

APPARATUS FOR SCREEDING UNCURED CONCRETE SURFACES

CROSS-REFERENCE TO RELATED APPLICATIONS

The present application is a division of U.S. patent application Ser. No. 11/965,066, filed Dec. 27, 2007, now U.S. Pat. No. 7,491,011, which is a continuation of U.S. patent application Ser. No. 11/580,722, filed Oct. 13, 2006, now U.S. Pat. No. 7,320,558, which is a continuation of U.S. patent application Ser. No. 10/902,528, filed Jul. 29, 2004, now U.S. Pat. No. 7,121,762, which is a continuation-in-part of U.S. patent application Ser. No. 10/728,620, filed Dec. 5, 2003, now U.S. Pat. No. 6,953,304, which is a divisional application of U.S. patent application Ser. No. 10/266,305, filed Oct. 8, 2002, now U.S. Pat. No. 6,976,805, which claims priority on U.S. provisional application Ser. No. 60/327,964, filed Oct. 9, 2001; Ser. No. 60/341,721, filed Dec. 18, 2001; and Ser. No. 60/354,866, filed Feb. 5, 2002, which are all hereby incorporated herein by reference in their entireties.

FIELD OF THE INVENTION

The present invention relates generally to screeding devices for uncured concrete floors and surfaces and, more particularly, to a lightweight screeding device which may be moved and guided as a walk behind apparatus over an uncured concrete surface by hand. The lightweight screeding device of the present invention is particularly suited for use at both over ground sites as well as on elevated deck surfaces, and may be implemented at other uncured concrete surfaces, such as interior floors, exterior slabs, roadways, ramps, parking areas or the like.

BACKGROUND OF THE INVENTION

When forming a concrete slab or floor, the uncured concrete is placed and screeded, leveled and/or smoothed to obtain a generally flat slab of generally uniform thickness. One known method to obtain a uniform thickness of concrete of a floor or deck surface is to use small pre-fabricated metal structures or stands that have support legs, which may rest directly on the corrugated sheet metal decking or plywood form-work. A small plate may be held in position at the height equal to the desired concrete thickness above the metal deck or form work. The manual screeding process then relies on these stands as a height gauge. Some devices may even ride along the top surface of elongated stands or rails supported by the stands similar to known methods used for slabs-on-grade and elevated deck work prior to implementation of mechanized laser screeding. The stands or rails may be removed just after the screeding process completed and before the concrete begins to cure. Any remaining holes and imperfections are then filled and refinished before the concrete begins to fully harden.

Another known method for obtaining a uniform thickness of concrete on a floor or deck is to provide an ongoing series of small pre-screeded areas ahead of the actual screeding process. These small pre-screeded areas may be generally referred to or known as "wet pads". A hand trowel may be used to strike off a roughly twelve inch (30 cm) diameter area of the pre-placed concrete at a desired height or elevation. The height or elevation of each "wet pad" may be determined by using a pre-established laser reference plane provided by a laser transmitter set-up at the site, and a hand-held laser receiver mounted to a pre-set position on a grade-stick. A series of small "wet pads" or "surface pads" are thus created at the desired thickness or elevation of concrete which serve as temporary height gages. A manual hand-screeding method will use a series of these pads as a reference.

As a typical example of the procedure, first, two wet pads are made about ten feet apart. Then, a wooden 2×4 or similar straight edge is used to strike off approximately a 12 inch (30 cm) wide by 10 foot (3 m) long surface between the two twelve inch (30 cm) diameter pads. Two of these 12 inch (30 cm) wide by 10 foot (3 m) elongated "surface-pads" are then struck off parallel to each other at a distance roughly equal to the width of the screed being used. The concrete is then struck off between these two parallel surfaces using the elongated "surface-pads" as a height reference or guides for the screed. Any excess concrete material may then be manually raked and shoveled aside by workers. Alternately, additional concrete material may be brought in and added as needed to fill any low areas. This is accomplished by at least one and often two or more workers. Any obvious low or high areas are thus detected through ongoing visual inspection by the workers and corrections to the concrete elevation or thickness are made in anticipation of the action of the screeding device. This process is subject to a number of variables which affect the quality of the surface of the concrete, including human effort and error.

Hand screeding devices are known where a vibratory device is moved over a concrete surface by hand. Examples of such devices are disclosed in U.S. Pat. Nos. 3,067,656 issued to Gustafsson; 5,244,305 issued to Lindley; and 5,857,803 issued to Davis et al. However, such known screeding devices typically require any grade elevation or thickness adjustments of the concrete surface to be performed by manually raking or pre-grading the uncured concrete surface to a desired grade prior to screeding the surface with the vibratory screeding device. The manual human effort and visual inspection process typically results in a concrete surface that is subject to undesired height or elevation variation. This directly affects the quality of the finished concrete surface and is measurable in terms of scientifically accepted standards known in the industry as "Floor Levelness" (F-l) and "Floor Flatness" (F-f).

Therefore, there is a need in the art for an improved screeding method and apparatus or device, which is relatively small and maneuverable, for providing a concrete slab or deck of generally uniform thickness or elevation without requiring the additional manual labor processes associated with metal stands, wet pads, pre-grading, or the like.

SUMMARY OF THE INVENTION

The present invention provides an apparatus for screeding and vibrating uncured concrete, sand, dirt, gravel and/or other materials in areas which may be inaccessible to larger machines and equipment, such as due to the space limitations of small buildings, or the weight restrictions maintained during the construction of elevated decks and surfaces. The present invention provides a concrete strike-off and screeding device or screed head which is moved around through human effort and/or through the force of a driven wheel or wheels. The screed head includes a concrete surface working member or device, such as a vibrating member or beam, and a grade setting device or member. The vibrating member is a generally elongated horizontal member having a surface area in contact with the surface of the uncured concrete. The grade setting device or member is a generally elongated horizontal member located in close proximity, just ahead of, and in parallel with the vibrating member. The grade setting device may be constitute a variety of forms, such as a strike-off plow, an auger, a flexible belt or chain with attached paddles, a spinning tube, or other such devices or forms for the purpose of engaging and imparting the movement of uncured concrete. The grade height or elevation of the grade setting device is adjustable via mechanical adjusting devices or electromechanical actuators which are preferably operable to automatically adjust an elevation of the grade setting device to a pre-determined desired elevation according to an electronically-sensed laser plane reference. A pair of laser receivers are mounted to the grade setting device and are operable to sense or detect the elevation position of the grade setting device relative to the laser plane.

The vibrating member generally floats upon or is supported directly on the uncured concrete surface created by the grade setting device ahead of it. With the grade setting device and laser receivers fixed together and adjustably attached to the vibrating member, the laser receivers and automatic control system automatically react to adjust the elevation of the grade setting device with respect to the newly and continuously created surface and with respect to the laser plane reference. This ongoing reference is used to correct the elevation of the grade setting device as the machine advances over and through the uncured concrete.

For example, when the screeding apparatus is operating and producing a concrete surface to a desired "on grade" result, the relative height of the grade setting device as compared to the vibrating member remains effectively unchanged by the control system. Alternately, if the concrete surface produced by the machine, and upon which the screed head and laser receivers is riding, is too high, the laser receivers will indicate a "high" signal to the control system. This "high" signal is then used by the control system to send a signal to the respective elevation actuator and accordingly lower the grade setting device, quickly working to produce a concrete surface at the correct elevation. Conversely, if the concrete surface produced by the machine, and upon which the screed head and laser receivers is riding, is too low, the laser receivers will indicate a "low" signal to the control system. This low signal is then used by the control system to send a signal to the respective elevation actuator and accordingly raise the grade setting device, quickly producing a concrete surface at the correct elevation. In either corrective operating mode, and within the operating range of the laser receivers, the corrective action will be a continuous process until the correct elevation is reached by the laser receivers and screed head.

The present invention thus provides a self-correcting process along with the ability of the apparatus to be at least partially supported upon the desired correct elevation surface it creates, as the device itself advances.

According to an aspect of the present invention, a screeding device which is movable over a surface of uncured concrete and is operable to level and smooth the uncured concrete surface includes a concrete surface working member and a grade setting device. The grade setting device is adjustably mounted to the concrete surface working member and is generally vertically adjustable with respect thereto. The concrete surface working member is at least partially supported on the uncured concrete surface, while the grade setting device is adjustable relative to the concrete surface working member to at least one of establish and indicate a desired grade for the uncured concrete surface. The grade setting device thus causes the concrete surface working member to flatten, smooth, and/or consolidate the uncured concrete surface at the desired grade. The height or grade of the grade setting device is preferably adjustable in response to a laser leveling or laser reference system.

Preferably, the concrete surface working member comprises a vibrating member or beam which is vibratable to flatten, smooth and consolidate the uncured concrete while being partially supported thereon. However, the concrete surface working member may comprise a roller, a flat or contoured plate or pan, a roller track or the like which is operable to engage and work the uncured concrete surface as the screeding device is moved over, along and/or through the uncured concrete.

In one form, the grade setting device of the screeding device includes a strike-off member or plow which functions to strike off the uncured concrete to establish the desired elevation or grade as the screeding device is moved over the uncured concrete surface. In another form, the grade setting device includes an elongated member or tube, which further includes a plurality of fingers or extensions extending downwardly therefrom for indicating the desired grade height above the sub-grade, thereby allowing for a reduced need for creating "wet pads". Either the lack of contact or marks left in the concrete by the fingers or extensions would show where additional manual filling, or pre-leveling of the concrete surface by workers using concrete rakes or shovels may be desired or necessary.

Optionally, the screeding device may include a means for moving excess concrete from in front of the grade setting device to either or both sides, or just ahead of the screeding device as the screeding device is moved through the uncured concrete. The means for moving excess concrete is preferably positioned along the forward face of the grade setting device to engage any excess concrete in front of the plow and to help fill in any low areas as well. The means for moving excess concrete may comprise an auger, a flexible belt or chain with paddles or the like, a rotating or spinning tube, a secondary plow or strike-off member, or any other means for moving excess concrete to one, both sides, or just ahead of the screeding device, while the device is moved along and through the uncured concrete. Optionally, the grade setting device may comprise a means for moving excess concrete and may function to cut and establish the grade height of the concrete surface in front of the vibrating member.

The screeding device is powered via a power source, which may include an internal combustion engine or an electric motor or any other powered means. The power source is operable to provide power to the vibrating member and the adjusting devices or actuators.

Optionally, the screeding device may include a vibrating member and a float member mounted to the rear portion of the frame portion. The vibrating member and the float member may at least partially support the rear portion of the frame portion. The grade setting device may be adjustably mounted to the vibrating member or said float member. In one form, the float member may be positioned in front of the vibrating member as the screeding device moves in a screeding direction (so that the float member is positioned between the vibrating member and the operator controls or handlebars and/or the wheeled support), and the grade setting device may be mounted along a forward portion of the float member. Alternately, the vibrating member may be positioned in front of the float member as the screeding device moves in the screeding direction, and the grade setting device may be mounted along a forward portion of the vibrating member.

Optionally, the screeding device includes a wheeled support frame for partially supporting at least some of the components of the screeding device. The wheels of the support frame may be powered or rotatably driven to assist an operator in moving the screeding device over the uncured concrete surface.

The vibrating member and grade setting device together generally comprise a screeding head. The screed head may be adjustably mounted to the wheeled support frame and may be adjustable to change and adjust an operating range height or grade of the screed head relative to the wheeled support frame. The screed head may also be adjustably mounted to the wheeled support frame to change or adjust a pitch or "angle of attack" of the screed head relative to the wheeled support frame and the uncured concrete surface. In addition to operating range height and pitch adjustments, a means to temporarily raise and then lower the screed head relative to the support frame in order to clear any low obstacles while moving the apparatus to and from or around the work site may also be provided. Any temporary raising and lowering of the screed head is not intended to affect any established operating range height and pitch adjustments.

Optionally, the screeding device may include a level control operable to automatically adjust the vibrating member relative to the frame portion in response to an output signal of a level sensor. The level control may automatically adjust the vibrating member relative to the frame portion to substantially maintain the frame portion at a desired orientation relative to horizontal as the screeding device is moved over and through the uncured concrete in a screeding direction.

Optionally, the screeding device may include a balancing control that automatically adjusts a weight along the wheeled support to adjust the balance of the screeding device. The balancing control may be operable to move the weight along a longitudinal axis of the wheeled support in response to at least one pressure sensor. In one form, the pressure sensor may comprise a fluid pressure sensor, which senses fluid pressure in a hydraulic propulsion system. In another form, the pressure sensor may comprise a down pressure sensor, which senses the down pressure of the vibrating member against the uncured concrete surface.

According to another aspect of the present invention, a method of flattening or leveling, smoothing and/or screeding, and/or consolidating and/or compacting an uncured concrete surface includes providing a screeding device which includes a concrete surface working member and a grade setting device, which is adjustable relative to the concrete surface working member. The screeding device is moved over the uncured concrete surface while the concrete surface working member is at least partially supported on the uncured concrete surface. The grade setting device is adjusted relative to the concrete surface working member to at least one of establish and indicate a desired height or grade for the uncured concrete surface.

Preferably, the concrete surface working member comprises a vibrating member or beam which is vibratable to flatten, smooth and consolidate the uncured concrete while being partially supported thereon. The method then includes vibrating the vibrating device while the vibrating device is at least partially supported on the concrete surface.

The grade setting device may include a visual indication of the desired grade height or may include a strike-off plow, auger or the like for plowing or cutting the uncured concrete to establish the desired grade height as the screeding device is moved over or through the uncured concrete surface.

In one form, the screeding device is moved over the uncured concrete surface by manually pulling the screeding device while the screed head, including the vibrating member, and grade setting device, and a portion of the screeding apparatus itself, is supported by the uncured concrete surface.

In another form, the screeding device includes a wheeled support frame for partially supporting at least some of the weight of the components of the screeding apparatus. Optionally, the wheels of the support frame may be powered or driven to assist an operator in moving the screeding device over or through the uncured concrete surface.

Optionally, the method may include actuating a lift mechanism or system to raise the vibrating member and grade setting device generally vertically upward relative to the wheeled support, so that the screeding device tilts downward to rest or support the vibrating member on the uncured concrete surface. When so positioned, the laser receiver is tilted and thus is at a lower level than when the screeding device is level, such that the controls of the screeding device will raise the grade setting device relative to the vibrating member. When the grade setting device is raised upward, the screeding device may be moved over and through the uncured concrete in a "quick-pass" mode to strike off excess concrete. After the "quick-pass" is completed, the lift mechanism may lower the vibrating member and grade setting device to their normal operating positions and may screed the struck-off, uncured concrete in the normal manner.

The grade setting device may also include a concrete moving device for engaging and moving any excess concrete and to help fill in any low areas as well. The means for moving excess concrete may comprise an auger, a flexible belt or chain with paddles or the like, a rotating or spinning tube, a secondary plow or strike-off member, or any other means for moving excess concrete to one, both sides, or just ahead of the screeding device, while the device is moved along and through the uncured concrete.

According to another aspect of the present invention, a wheeled screeding device which is movable over or through a surface of uncured concrete and is operable to level, smooth, and consolidate the uncured concrete surface includes a wheeled support, a screed head and an adjustment device. The wheeled support includes a frame portion supported by at least one wheel. The at least one wheel defines an axis of rotation of the wheel and a general axis of rotation for the apparatus itself. The screed head is mounted to the frame portion and is at least partially supportable on an uncured concrete surface. The screed head is adapted to impart a force onto the uncured concrete surface. The adjustment device is operable to adjust a desired degree of weight distribution and balance of the apparatus. Therefore, the balance of the apparatus about the axis of rotation at the wheeled support is used to adjust the force imparted by the screed head onto the uncured concrete surface.

In one form, the adjustment device includes the addition or removal of at least one weight at one or both ends of the wheeled support or anywhere along the longitudinal axis of the apparatus for adjustment purposes. In another form, the adjustment device is operable to mechanically adjust a position of the axis of rotation relative to the frame portion and the center of gravity of the apparatus.

The screed head may include a vibratable beam or member, a grade indicating device, a grade setting device, such as a strike-off plow or the like, and a means for moving excess concrete which is operable to move excess concrete to one side, both sides or just ahead of the vibratable member and to help fill in any low areas as well. The means for moving excess concrete may comprise an auger, a flexible belt or chain with paddles or the like, a rotating or spinning tube, a secondary plow or strike-off member, or any other means for moving excess concrete to one, both sides, or just ahead of the screeding device, while the device is moved along and through the uncured concrete.

According to yet another aspect of the present invention, a wheeled screeding device which is movable over a surface of uncured concrete and which is operable to level, smooth, and consolidate the uncured concrete surface includes a wheeled support and a screed head. The wheeled support includes a frame portion movably supported on at least one wheel. The at least one wheel defines an axis of rotation of the wheel and an axis of rotation for the apparatus itself. The screed head is mounted to the frame portion and is at least partially supportable on an uncured concrete surface. The screed head is also pivotable about a second axis generally horizontal and normal to the first axis of rotation and relative to the at least one wheel to adjust an angle of the screed head relative to the axis of rotation. The second axis of rotation provides the screed head with the capability of a clockwise and/or counterclockwise or roll freedom of movement relative to the surface of the uncured concrete and is generally parallel to the direction of travel of the apparatus.

In one form, the screed head is pivotable relative to the frame portion. In another form, the screed head is pivotable with the frame portion, which is pivotable relative to the axis of wheel rotation.

According to another aspect of the present invention, a method of smoothing, screeding, and consolidating an uncured concrete surface includes providing a wheeled screeding apparatus which includes at least one wheel and a screeding device mounted at the at least one wheel. The at least one wheel is movable through an uncured concrete surface. The screeding apparatus is adjustably and proportionately balanced about the at least one wheel such that the screeding device is at least partially supported on the uncured concrete surface and at least one wheel. The method includes moving the wheeled screeding apparatus over and/or through the uncured concrete, and screeding the uncured concrete surface with the screeding device while the screeding device is at least partially supported on the uncured surface.

Optionally, the method may include adjusting the wheeled screeding apparatus to adjust a degree or proportion in which the screeding device is supported on the uncured concrete surface.

Therefore, the present invention provides a lightweight, easily maneuverable screeding device which is at least partially supported on the uncured concrete as it is moved over or through the uncured concrete surface by an operator. The relative small size and portability of this device makes it uniquely useful for many concrete construction site applications. The screeding device includes a plow or other grade setting element or device which is vertically adjustable relative to a concrete surface working member or vibrating member of the screeding device to adjust the grade setting device to the desired grade height as the screeding device is moved over and supported on the uncured concrete surface. The screeding device includes an automatic control system which is responsive to a laser plane or laser-guided reference for vertically adjusting the grade setting device to the desired grade height. The screeding device may include a wheeled support which may be powered to drive one or more wheels to move the screeding device over and through the uncured concrete. In addition to reducing labor and effort, the present invention also provides for improved accuracy of the screeded concrete surface through the use of an automated control system and on-site laser reference for controlling the elevation adjustment of a grade-setting device. This occurs in conjunction with and just prior to the action of the vibratory screeding element supported by the uncured concrete.

These and other objects, advantages, purposes and features of the present invention will become apparent upon review of the following specification in conjunction with the drawings.

DESCRIPTION OF THE PREFERRED EMBODIMENTS

Figure 1:
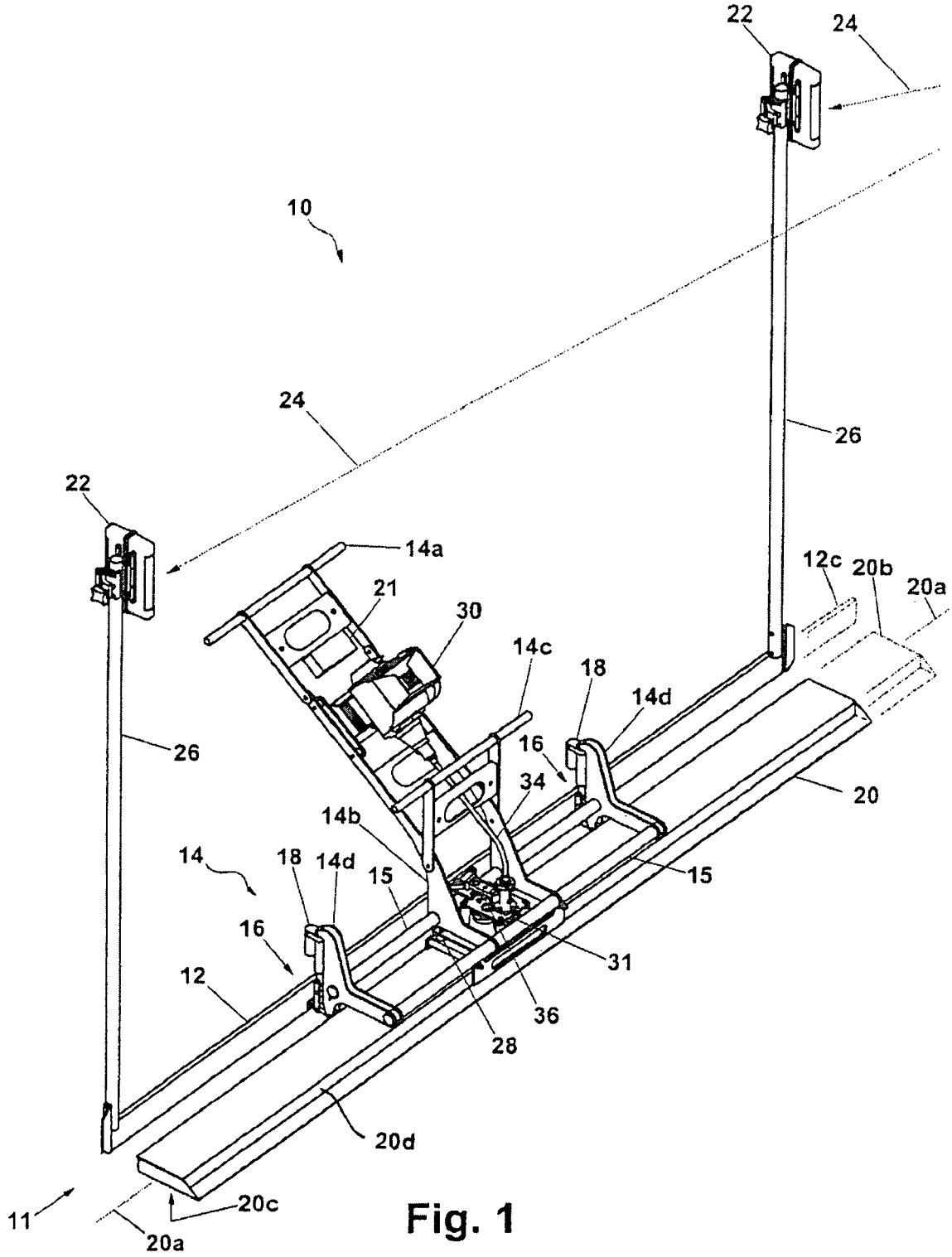
FIG. 1 is an upper perspective view of a screeding device in accordance with the present invention.

Referring now specifically to the drawings and the illustrative embodiments depicted therein, a screeding device 10 includes a screeding head 11, which includes a grade setting or indicating device, such as a strike-off plow 12, and a vibratory beam or member 20 (FIGS. 1-8). Plow 12 is attached to a framework 14 by two small sets of linkages 16 and is vertically adjustable relative to the framework 14 by a pair of elevation actuators 18 (FIGS. 1-8). Vibratory beam or member 20 is mounted to the framework 14. Screeding device 10 is at least partially supported on an uncured concrete surface and moved along and over the concrete surface to screed and smooth the surface via vibration of the vibrator beam 20 as the vibrator beam 20 floats on or is at least partially supported on the uncured surface. The plow 12 is adjustable with respect to the vibrator beam 20 to adjust a level or grade of the uncured concrete to a desired grade as screeding device 10 is moved along and over the uncured concrete.

Figure 7:
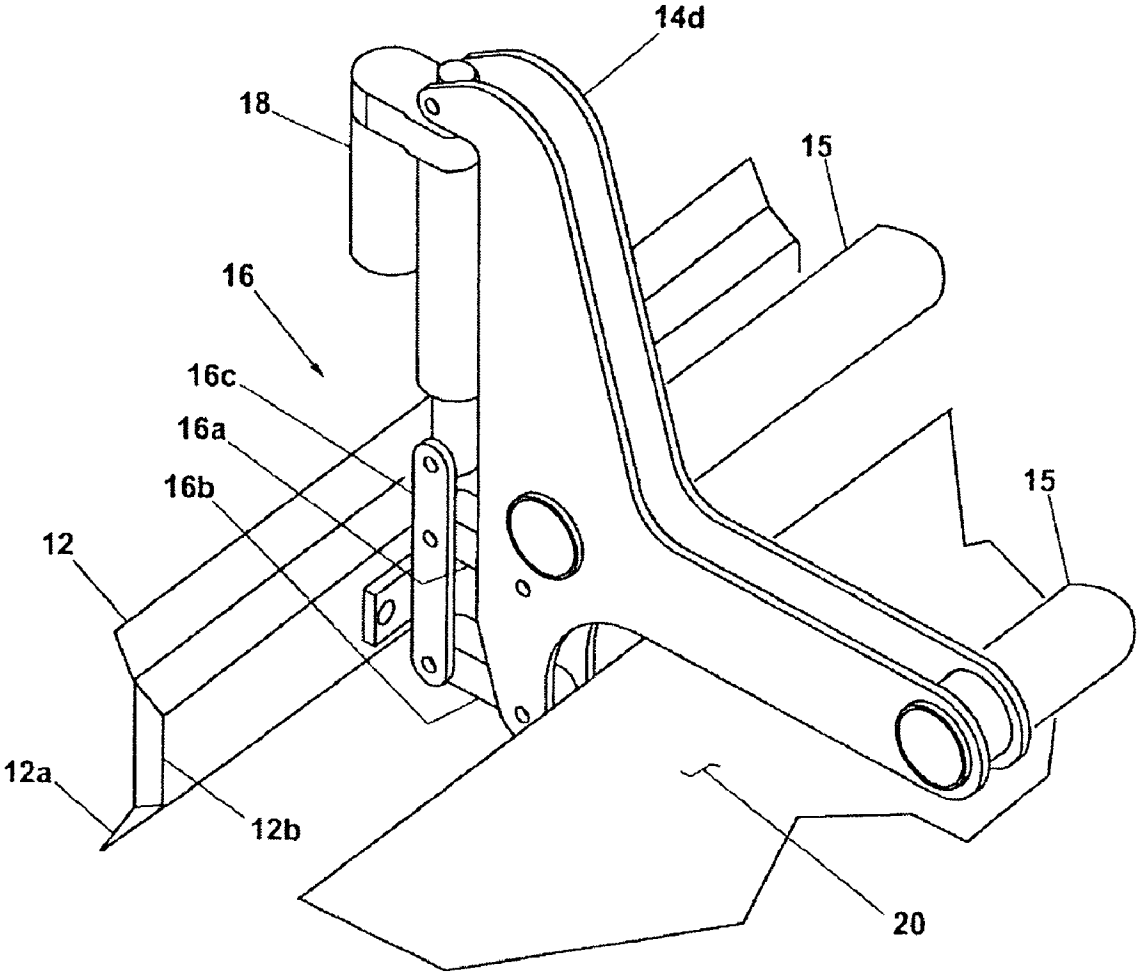
FIG. 7 is an enlarged perspective view of the area VII in FIG. 5.
Figure 8:
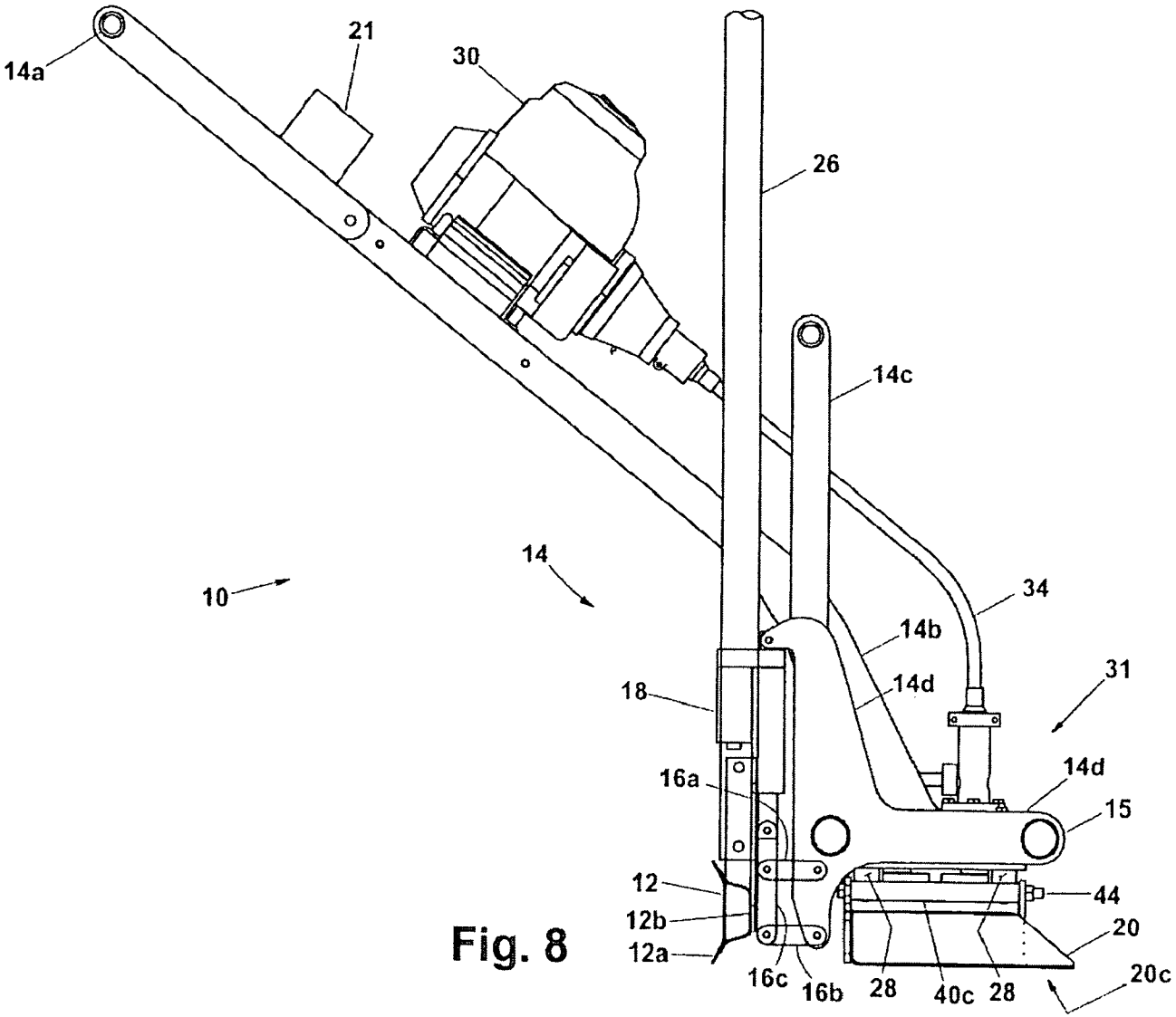
FIG. 8 is an enlarged side elevation similar to FIG. 4.

Plow 12 includes a plow blade or edge 12*a* and a generally rigid structural member or metal extrusion 12*b* extending laterally along the blade 12*a* (FIGS. 7 and 8). The structural member 12*b* provides a mounting surface for mounting plow 12 to the linkages or actuators, as discussed below, and provides structural rigidity to plow 12 to limit or substantially preclude deflection of plow 12 as plow 12 engages the uncured concrete. The blade 12*a* and casing 12*b* of plow 12 and/or other components or elements of the plow may be welded or riveted together or may be otherwise secured together via any other means, such as a double sided adhesive tape, such as VHB adhesive tape available from 3M Scotch Brand of the 3M Company of St. Paul, Minn., USA, or the like, without affecting the scope of the present invention.

Vibrator beam or member 20 is a generally flat member extending laterally outwardly in opposite directions from a pair of frame members 14*d* of framework 14. Vibrator beam 20 may be any vibratable member and preferably has a generally planar, flat and smooth lower surface for engaging and working the uncured concrete surface. In the illustrated embodiment, vibrating beam 20 extends along a longitudinal axis 20*a* and includes a lower, generally flat planar portion 20*c* and a pair of generally vertical walls 20*d* extending therealong to strengthen the planar portion and limit or substantially preclude deflection of the beam (FIG. 1). Similar to plow 12, discussed above, the components of vibrator beam 20 may be welded or riveted together or may be otherwise secured together via any other means, such as a double sided adhesive tape, such as "Scotch VHB" (Very High Bond) adhesive tape available from the 3M Company of St. Paul, Minn., USA or the like, without affecting the scope of the present invention. The length and width of vibrator beam 20 may be selected to provide a large enough footprint of the lower surface of the beam such that vibrator beam 20, along with the screeding device 10, floats on or is at least partially supported on the uncured concrete surface. Although shown and described as having a vibrating beam, the screeding device and/or screed head may alternately include any other type of concrete surface working device or member, such as a roller, a flat or contoured plate or the like, which engages and works the uncured concrete surface to flatten and/or smooth the concrete surface as the screeding device is moved over and along the uncured concrete.

The levelness or curvature of the plow and/or the vibrator beam may be adjustable to maintain or adjust the contacting or engaging surface at a generally straight or level orientation, in order to further limit or substantially preclude deflection of the beam. This may be accomplished by adjustable tensioning cables and/or rods extending along the plow and/or beam, such as by using the principles disclosed in U.S. Pat. No. 5,234,281 for DEFLECTION INDICATING ADJUSTABLE HIGHWAY STRAIGHT-EDGE, which is hereby incorporated herein by reference.

Plow 12 is adjustable relative to vibrator beam 20 via pivotal movement of linkages 16 and in response to actuators 18. Linkages 16 and actuators 18 are mounted to a pair of side frame members 14*d*, as best seen in FIGS. 5, 7 and 8. The actuators 18 control the vertical elevation of the plow 12 in relationship to the framework 14 and vibrator beam 20 via pivoting of the linkages 16 relative to plow 12 and framework 14. Because the actuators are generally fixedly mounted to the frame members 14*d* and, thus, to the vibrator beam 20, actuation of the actuators functions to lower or raise the plow relative to the vibrator beam. The actuators 18 are powered by a power supply, such as a 12-volt DC electrical power source, such as an alternator 36 including an AC to DC power converter and a voltage regulator (not shown). Optionally, the actuators may be any other means for raising or lowering the plow relative to the vibrator beam, such as hydraulic cylinders or the like, without affecting the scope of the present invention. The position or amount of extension of each actuator 18 may be independently adjusted, such as through a range of approximately 4 inches (100 mm), and may be controlled by output signals from an onboard electronic control box 21 (FIGS. 1, 3, 4 and 8).

The parallel linkages 16 function to maintain horizontal attachment of the plow 12 to the framework 14 as the plow is raised or lowered by the actuators 18. As best seen in FIGS. 7 and 8, each set of linkages 16 includes a pair of generally parallel links 16*a*, 16*b*, which are pivotally mounted to side frame member 14*d* at one end and to a generally vertical link 16*c* at the other end. Vertical link 16*c* is secured to a rear portion of the plow 12. Actuators 18 are connected to generally vertical link 16*c* and function to raise and lower vertical link 16*c* and plow 12 in a generally vertical, linear, reciprocal direction by pulling or pushing link 16*c* toward or away from the actuator, while links 16*a*, 16*b* function to maintain the plow in its generally vertical orientation during such reciprocal movement via pivotal movement of links 16*a*, 16*b* relative to frame member 14*d* and center link 16*c*. The linkages 16 thus limit or substantially preclude pivotal movement of the plow as it is vertically adjusted by actuators 18, such that plow 12 remains generally parallel to vibrator beam 20 regardless of the vertical position of plow 12 relative to vibrator beam 20.

The side frame members 14*d* of framework 14 are connected together by a pair of generally parallel rods or members 15 extending generally along the plow 12 and vibrator beam 20. The rods 15 are further secured to a central frame portion 14*b* of framework 14, which extends upwardly from the plow 12 and vibrator beam 20 for mounting a vibrator drive motor or power source 30 and for providing an operator control handle 14*a* and a lifting handle 14*c* for screeding device 10.

Figure 9:
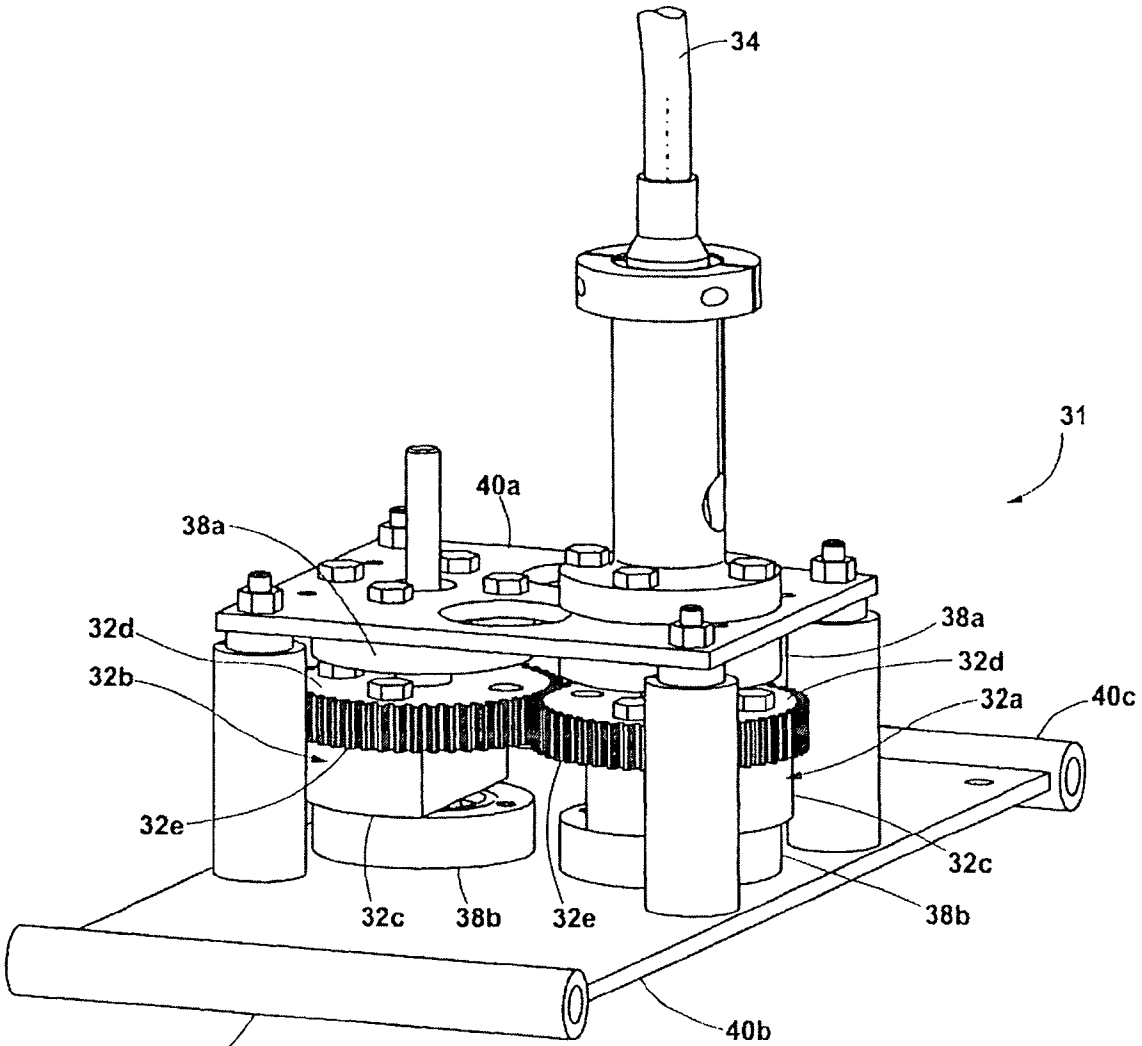
FIG. 9 is an enlarged perspective view of a vibrating device with eccentric weight members useful with the screeding device of FIGS. 1-8.

Vibration of vibrator beam 20 is accomplished by a powered vibrator device 31, which is powered by power source 30 (FIGS. 1, 6, 8 and 9), such as a gasoline powered drive motor or engine, or a battery powered drive motor, or the like. As shown in FIG. 9, vibrator device 31 includes a pair of eccentric weight shafts or members 32*a*, 32*b*, which are rotatably driven via a flexible drive shaft 34 from power source 30. Flexible drive shaft 34 is operatively connected to one of the eccentric weight members (such as member 32*a*) with spur gears or the like (not shown) to rotatably drive eccentric weight member 32*a*.

As shown in FIG. 9, eccentric weight members 32*a* and 32*b* include an eccentrically weighted portion 32*c*, which is offset from the central axis of rotation, and a circular portion 32*d* with gear teeth 32*e*, which is concentrically mounted on the central axis of rotation. Eccentric members 32*a*, 32*b* are engaged together via gear teeth 32*e*, such that rotation of one eccentric weight member 32*a* about its central axis of rotation rotatably drives the other eccentric weight member 32*b* in the opposite direction about its respective central axis of rotation. The rotation of the eccentric weight members 32*a*, 32*b* causes the vibration in the beam 20 to be directed to act in a primary axis matching the elongated axis 20*a* (FIG. 1) of the vibrator beam 20, while also serving to reduce or cancel vibration in the horizontal axis perpendicular to the vibrator beam 20. The eccentric weight members thus allow the vibration to be tailored in a desired plane, while substantially precluding vibration in an undesired plane.

Figure 5:
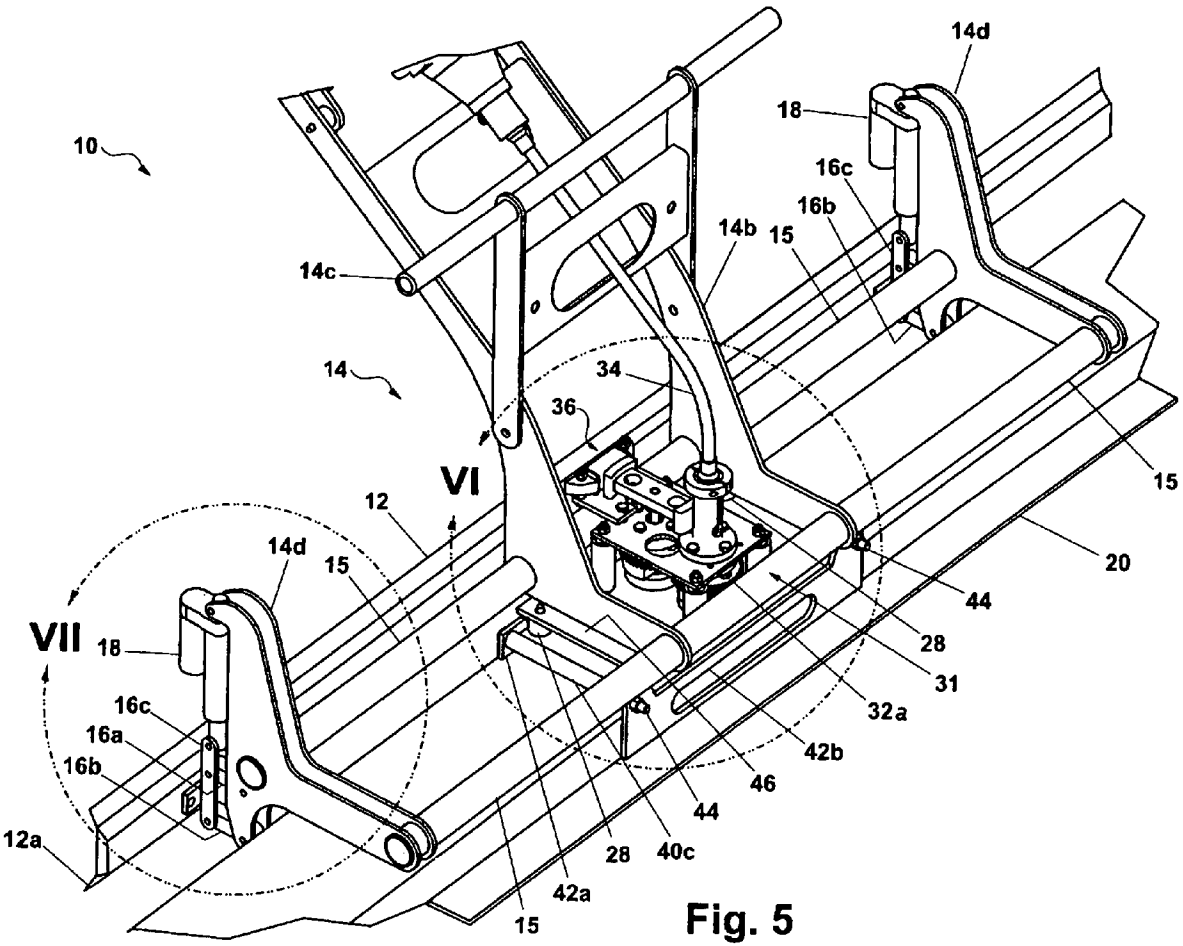
FIG. 5 is an enlarged perspective view similar to FIG. 1.
Figure 6:
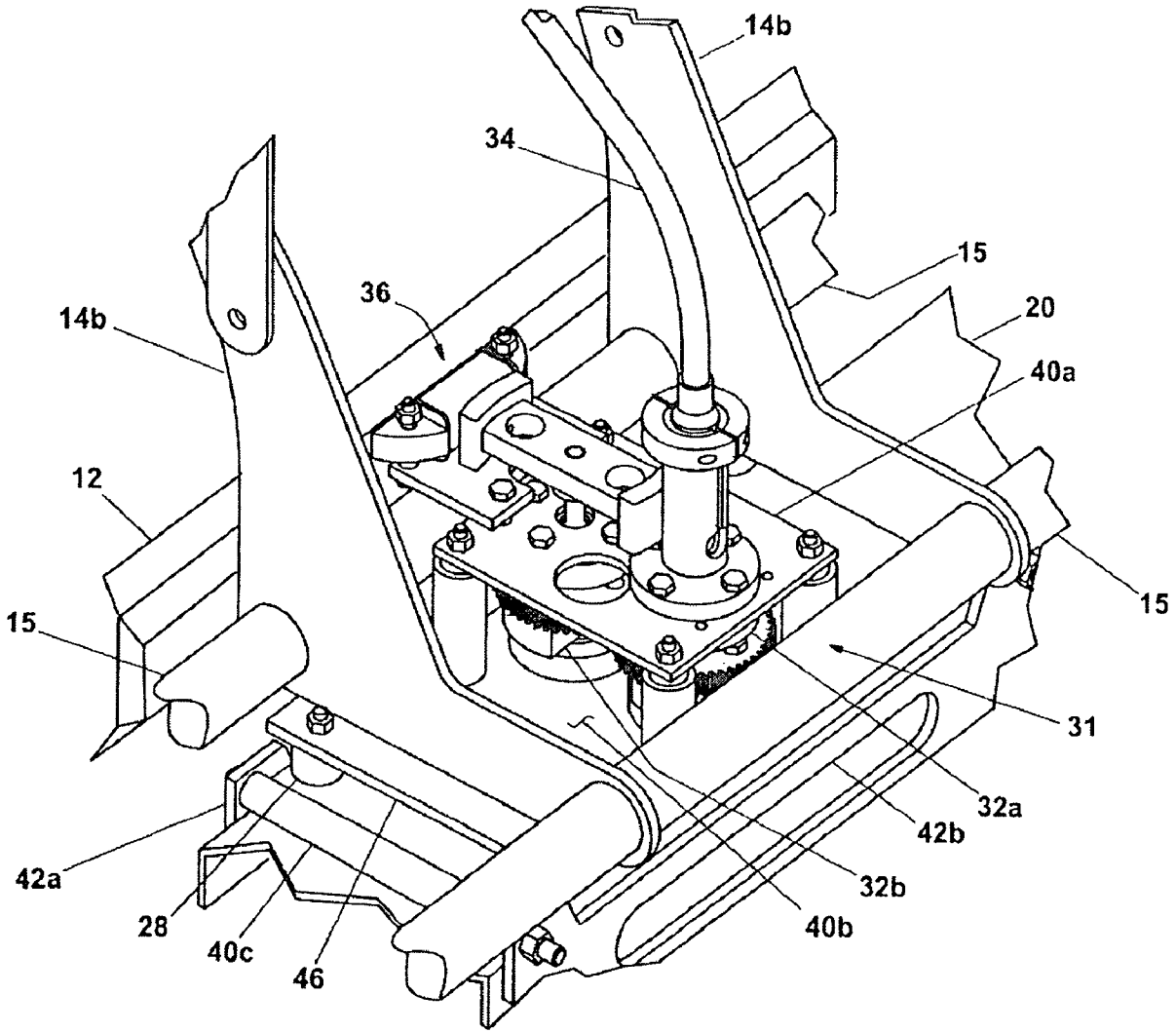
FIG. 6 is an enlarged perspective view of the area VI in FIG. 5.

Each of the eccentric weight members 32*a*, 32*b* is mounted between a pair of bearing members 38*a*, 38*b*, which are mounted (such as bolted or welded or the like) to a respective one of upper and lower mounting plates 40*a*, 40*b* (FIG. 9). As shown in FIGS. 5 and 6, the lower mounting plate 40*b* is then mounted between a forward plate 42*a* and a rearward plate 42*b* of the vibrator beam 20 via a pair of fasteners or bolts 44 extending through a pair of generally cylindrical mounting members 40*c* of lower mounting plate 40*b*. The lower mounting plate 40*b*, and thus the vibrator beam 20, is also mounted to lower brackets or plates 46, one on each of the central frame portions 14*b*, via one or more rubber sandwich mounts 28 (such as four in the illustrated embodiment), which also help serve to dampen the transmission of beam vibration to the support frame 14 and operator handle 14*a* of screeding device 10.

In the illustrated embodiment, vibrator power source 30 is an internal combustion engine. Optionally, however, the power source 30 may include an electric drive motor, such as a battery powered motor or the like. For example, the operator using the screeding device may carry a battery pack for powering the vibrator device. The battery pack may include a motorcycle battery or the like or a Nickel Metal Hydride pack or the like, or any other power source which provides sufficient power for driving the vibrator device 31. Such a battery pack may provide a sufficient power source for the vibrator device, while reducing the weight of the screeding device and also providing a quieter vibrator device. Alternately, the screeding device of the present invention may also be electrically powered through use of a power supply cable connected to a remote electric power supply. It is further envisioned that compressed air may be utilized to power the vibrating means of the vibrator device 31 and the elevation actuators through electrically controlled solenoid air valves. Therefore, the present invention may be operable via any power means, such as via an internal combustion engine, electrically via a power cord or battery, and/or pneumatically via a compressed air source and hose, or any other means for providing power to the components of the screeding device, without affecting the scope of the present invention.

Figure 3:
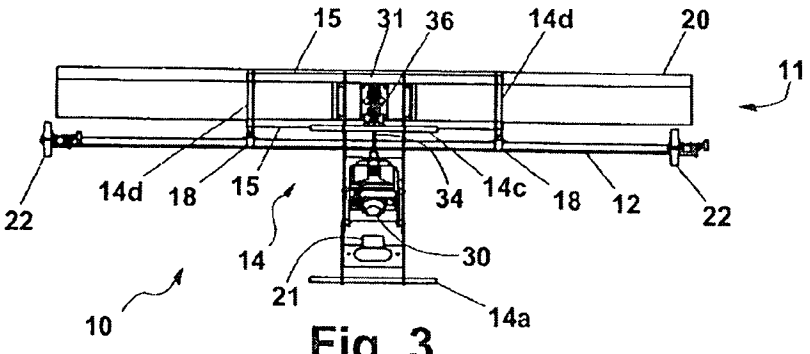
FIG. 3 is a top plan view of the screeding device of FIGS. 1 and 2.
Figure 2:
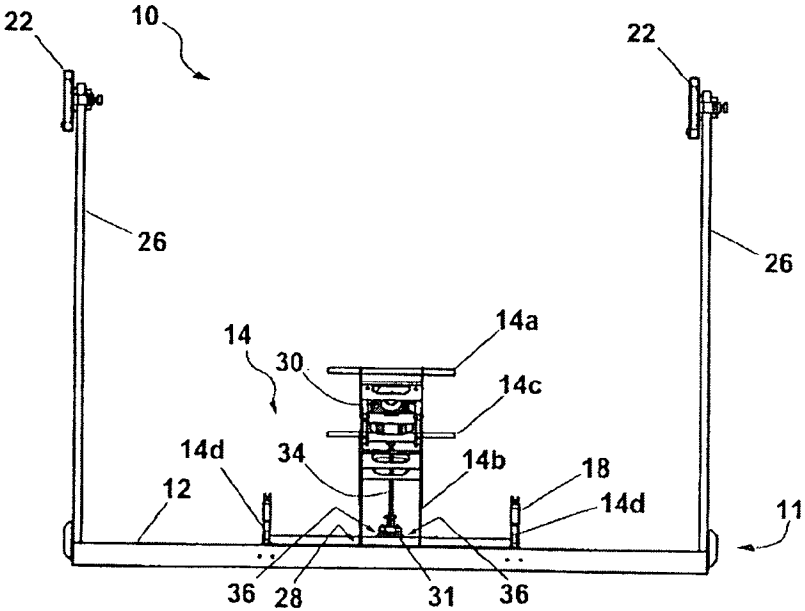
FIG. 2 is a rear end elevation of the screeding device of FIG. 1.
Figure 10:
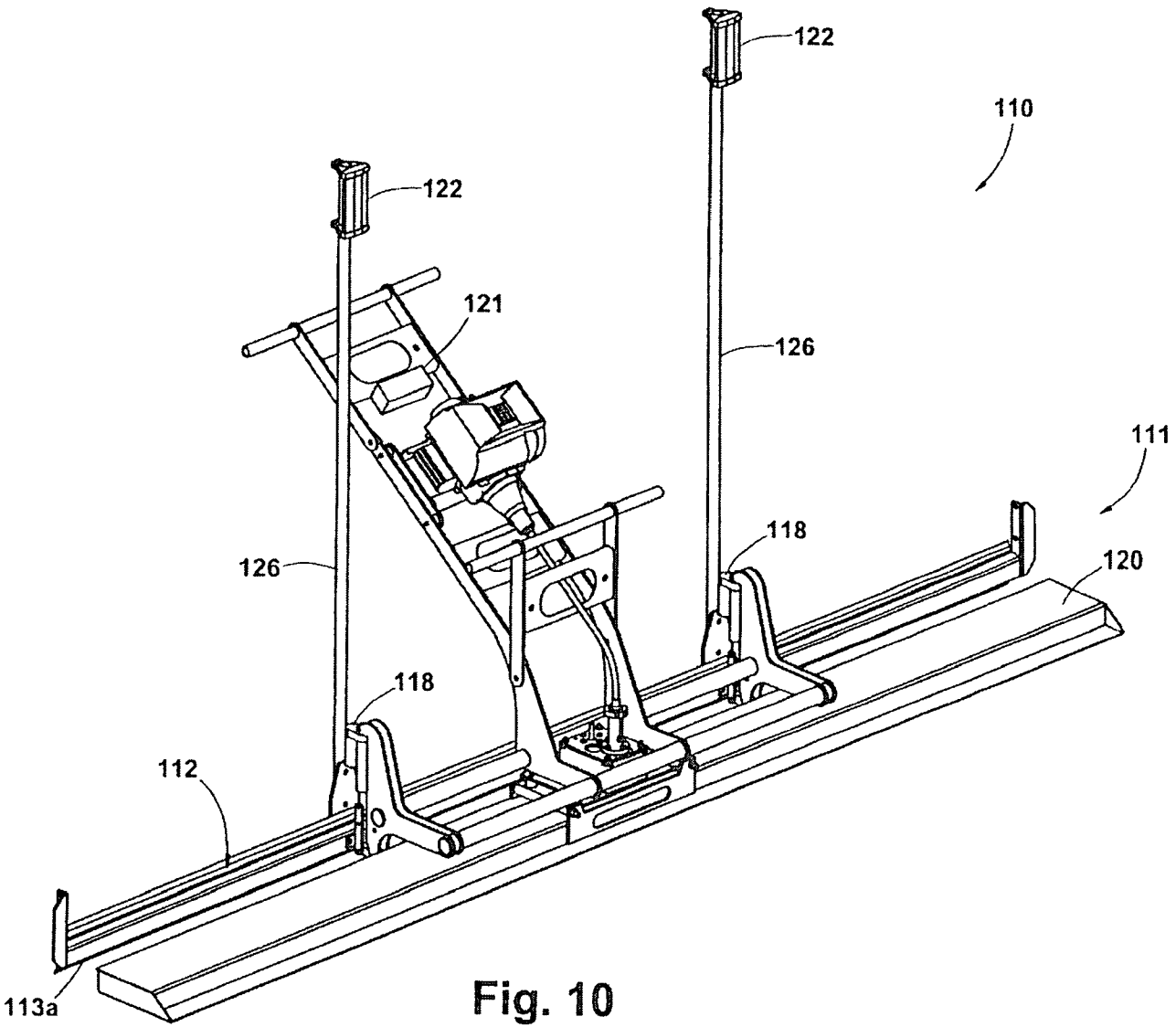
FIG. 10 is an upper perspective view of another screeding device in accordance with the present invention.
Figure 11:
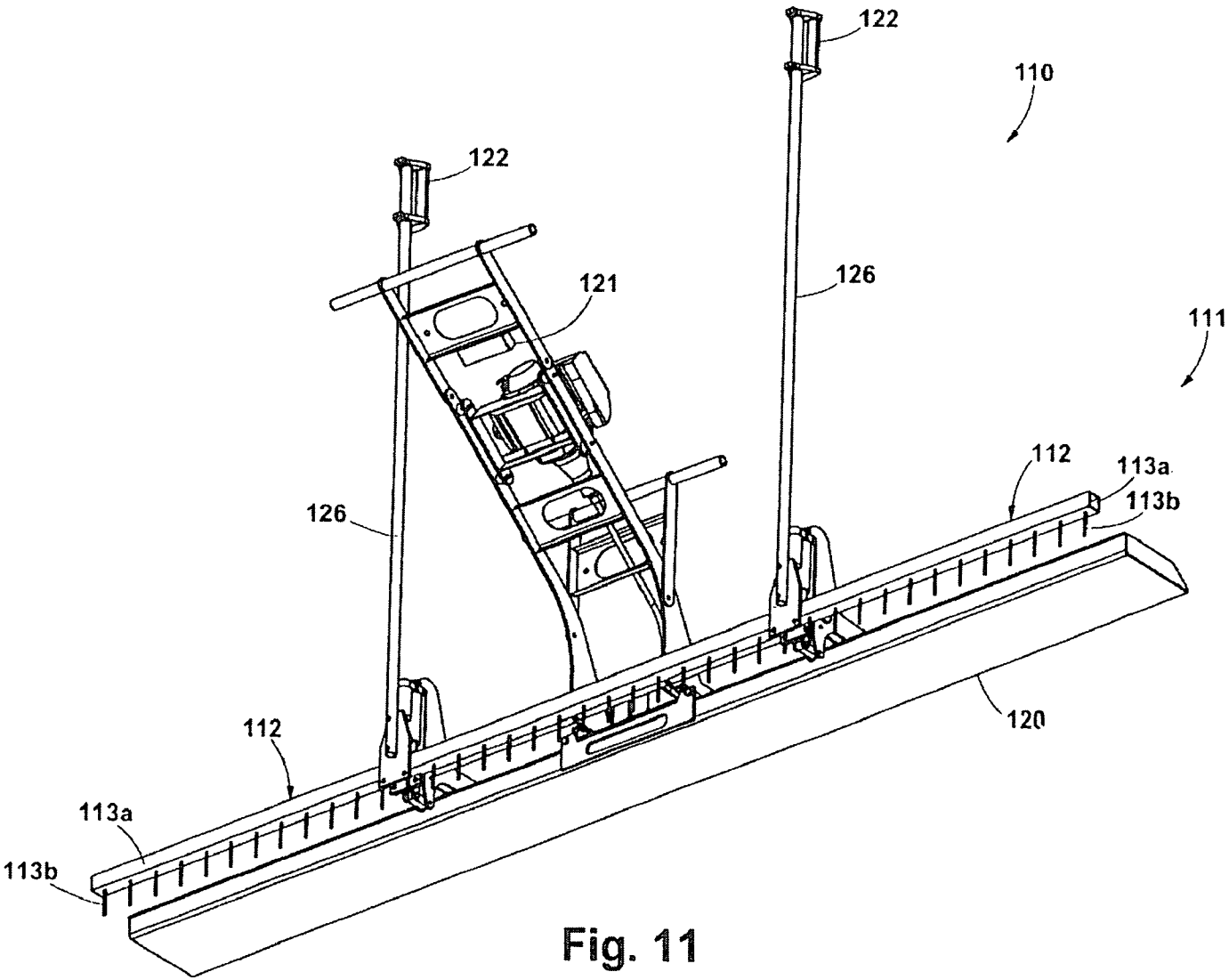
FIG. 11 is a lower perspective view of the screeding device of FIG. 10.

The elevation of the plow 12 is adjustable relative to the beam 20, preferably in response to a laser plane system. Optionally, and preferably, the control box 21 for controlling the actuators 18 receives input signals from each of a pair of laser receivers 22 (FIGS. 1-4), which each sense the elevation of a fixed laser plane reference 24 (FIG. 1) that has been established over the job site by a separate rotating, laser plane generator or projector (not shown), as is commonly known in the industry. Each laser receiver 22 is mounted to a support rod or mast 26 which is in turn mounted to the grade setting device or strike-off plow 12. Laser receivers 22 may be any suitable type of laser receiver, such as a Spectra Precision "R2N", "GCR", or Combi CR600 laser receiver available from Trimble Engineering and Construction Division of Dayton, Ohio, USA, or the like. The laser receivers may be adjustably mounted to masts 26 or the masts may be telescoping masts to facilitate vertical adjustment of the laser receivers relative to the grade setting device or plow. The masts 26 and laser receivers 22 of the laser plane system may be positioned toward laterally outward ends of the plow (as shown in FIGS. 1-3) or, alternately, toward a center region or centerline, where they are generally aligned and in-line with the actuators 18 (as shown in FIGS. 10 and 11 and as discussed below) in order to accommodate the relative response of the laser-controlled elevation actuators and control system. Optionally, the closed-loop system response may be changed electronically, such as by adding an adjustable potentiometer or variable capacitor to the control circuits, without affecting the scope of the present invention. Optionally, the elevation of plow 12 may be manually adjusted during operation by the operator, such as via mechanical adjustments or override electrical control actuation of actuators 18, without affecting the scope of the present invention.

An electric alternator 36 (FIGS. 1, 5 and 6), which is driven by the engine 30 and flexible shaft 34, provides electrical power to the laser receivers 22, an elevation control, control box 21, electrical circuit (not shown), and plow elevation actuators 18. As shown in FIGS. 1-3, 5 and 6, alternator 36 may be positioned at a lower portion of the framework 14 and at a central portion of the beam 12 and plow 20. Optionally, the alternator, dynamo, or generator 36 may be incorporated into the design of the internal combustion engine, without affecting the scope of the present invention.

Figure 4:
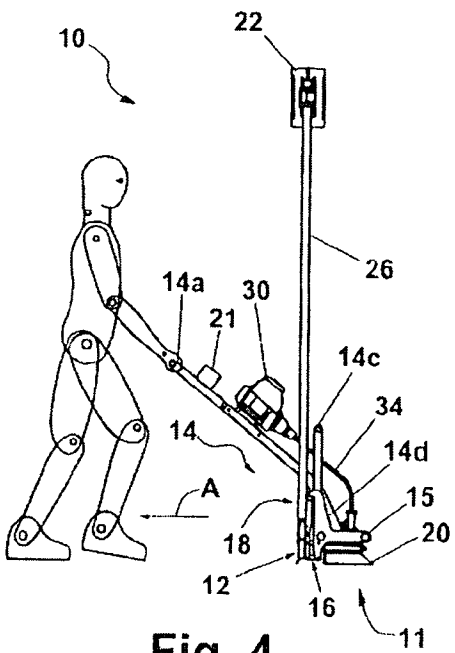
FIG. 4 is a side elevation of the screeding device of FIGS. 1-3, as it is moved by an operator.

Screeding device 10 is movable and operable by being pulled by human effort (in the direction of arrow A as shown in FIG. 4) over and/or through freshly poured and uncured concrete. Laser receivers 22 are set to sense or detect the established laser plane reference 24, such that the height of the desired concrete grade is established by the strike-off plow 12, which is vertically adjusted relative to vibrator beam 20 in response to the laser receivers 22 and actuators 18. The floating action of the vibrator beam 20 over the uncured concrete then continues to consolidate, smooth, level and finish the uncured concrete surface. Should laser receivers 22 sense a laser plane signal 24 that is either high or low, an output signal from the control box 21 automatically adjusts the appropriate elevation actuator or actuators 18 to correct the elevation of the plow 12, returning the plow to the desired grade.

Many components of screeding device 10 are preferably made from aluminum using known methods of fabrication and materials including commercially available dimensional metal stock, extrusions, castings, or machined components and other lightweight materials. The illustrated embodiment of FIGS. 1-9 of the present invention preferably weighs approximately 60 lbs. (approximately 27.2 kg.), but may weigh more or less than this, without affecting the scope of the present invention. This makes the device portable and manageable by one operator or worker. Further weight reduction or even an increase in size and capacity of the device without adding additional weight or without adding a significant amount of weight is possible through the use of even lighter materials such as magnesium, plastic, or carbon fiber composites.

Plow 12 and vibrator beam 20 are preferably of such length to allow and enable the screeding device 10 to be easily maneuvered by a single operator. Various lengths and/or sizes of the screed head are available for the device and easily interchanged as needed. For example, the plow and beam may be approximately six feet (approximately 183 cm) or less, which is a manageable length, yet the surface area of the vibrator is of such design and dimension that there remains a sufficiently low contact pressure on the concrete surface. However, other lengths may be implemented as desired for specific working applications without affecting the scope of the present invention. Preferably, the length of the screed head is selected to be short enough to allow for easy maneuverability and handling and not so long as to avoid excessive labor during use through raking large amounts of material in advance of the plow or grade setting device.

Optionally, the plow and vibrating beam may have adjustable lengths so as to be adaptable for different applications. For example, the plow 12 and vibrating beam 20 may include bolt-on sections 12*c*, 20*b* (FIG. 1), respectively, of different sizes, or may include other extensions or wings, which may be bolted to either or both ends of a central, shorter plow and beam. This allows the operator to vary the length of the plow and beam (and thus the width of the screeding device) depending on the particular application. For example, the lengths of the vibrating beam and plow may be adjusted between approximately three feet and approximately twelve feet via attachment or detachment of various sections. Optionally, the rotational speed of the vibrating members and the mass and sizes of the eccentric weights may be adjustable to accommodate different length beams and/or plows.

Referring now to FIGS. 10 and 11, a screeding device 110 is shown which is substantially similar to the screeding device 10, discussed above. Screeding device 110 includes a screeding head 111, which includes a vibrator beam 120 and a grade setting or grade indicating device 112. As best shown in FIG. 11, grade indicating device 112 includes an elongated member or tube 113*a* which further includes a plurality of indicators, such as fingers or extensions 113*b*, spaced along the lower surface of the tube 113*a* and extending downwardly therefrom. Grade indicating device 112 is adjustable relative to vibrator beam or member 120 in response to actuators 118 and a control 121 to indicate to an operator of screeding device 110 the desired grade of the uncured concrete surface. Either a lack of contact or marks left in the concrete by the fingers or extensions 113*b* may indicate an area or areas where additional manual filling, or pre-leveling of the concrete surface by workers using concrete rates or shovels may be necessary or desired.

Screeding device 110 also includes a pair of laser receivers 122 mounted to generally vertical rods 126, which are in turn mounted to elongated tube 113*a*, with the laser receivers 122 and rods 126 being mounted to tube 113*a* toward a central portion of screeding device 110, rather than at the outer ends of the grade setting device, as shown in FIGS. 1-3 with respect to screeding device 10. In the illustrated embodiment, the rods 126 are positioned and aligned to be generally in-line with the elevation actuators 118. As discussed above, positioning the rods and laser receivers in this manner effectively accommodates for the relatively quick system response of the laser-controlled elevation actuators 118, in order to enhance control of the height of tube 113*a* and fingers 113*b* relative to vibrator beam 120.

Preferably, the fingers 113*b* of tube 113*a* are generally straight wire fingers spaced approximately one to two inches apart along the tube and extending generally vertically downward therefrom, with the bottom of the fingers terminating at the desired grade when the elongated tube is set at the appropriate level. The fingers 113*b* may be substantially rigid or they may be flexible and may flex as they contact the uncured concrete surface. The fingers 113*b* thus provide a visual indication of the desired grade to the operator and workers, but do not necessarily function to plow or rake to move substantial amounts of material as screeding device 110 is pulled or moved over the concrete. Fingers 113*b* may be suitable for wider screeding devices where the additional weight of having a wider plow 12 (as shown in FIG. 1) may become a disadvantage in using the screeding device. Thus, workers or rakers may remove excess concrete or fill in concrete or "rake" the concrete (using suitable hand tools or the like) to the approximate elevation of the fingers. The fingers 113*b* provide a visible indicator which acts as a gauge for the workers to see how much concrete they need to remove or add to obtain the desired grade level in front of the screeding device 110.

Referring now to FIGS. 12-15, a wheeled screeding device 210 includes a screeding head 211, which includes a vibrator beam or member 220, attached to a framework 214. The framework 214 includes two pairs of spaced side frame members 214*d* which are connected together by a pair of generally parallel rods 215, similar to frame 14 discussed above. Rods 215 are also connected to a central frame portion 214*b* of framework 214, each side of which is further connected to a pair of generally parallel linkages 214*e*, 214*f* (in the illustrated embodiment, linkage 214*f* is generally parallel to and above linkage 214*e* at each side of the wheeled support 217). The spaced, parallel linkages 214*e*, 214*f* are connected to a rear end 217*a* of a wheeled support 217, and are pivotable to adjust the framework 214, and thus the vibrating beam 220, relative to wheeled support 217, as discussed below.

Wheeled support 217 includes a pair of wheels 217*b* rotatably mounted at opposite ends of a laterally extending frame portion 217*c*. A handle 217*d* extends upward and forward from a forward end 217*e* of wheeled support 217 and may be grasped and pulled or pushed by an operator (shown moving the device in the direction of arrow A in FIG. 13) over and through the uncured concrete surface. The wheels 217*b* may be freely rotatable at each side of the wheeled support 217 or may each be powered or driven via a drive motor 217*f* to further enhance maneuverability and mobility of the screeding device 210. The drive motor or motors for the wheels may be independently operable and may be electric, hydraulic or any other means for rotatably driving the wheels, without affecting the scope of the present invention.

Vibrator beam 220 is mounted to framework 214 in a similar manner as discussed above with respect to screeding device 10, such that a detailed discussion will not be repeated herein. Likewise, screeding device 210 includes a powered vibrator device 231, with a power source (not shown) preferably mounted at wheeled support 217, for causing vibration of the vibrating beam 220, such as by rotatably driving a pair of counter rotating eccentrically weighted shafts or members (also not shown) at vibrating beam 220, as discussed above with respect to screeding device 10.

Although not shown in FIGS. 12-15, screeding head 211 of screeding device 210 may also include a plow or other grade setting device or member, such as a visual indicator, such as fingers or extensions along a tube, such as discussed above with respect to screeding device 110, or the like. The grade setting device may be adjustably mounted to the side frame members 214*d* and vertically adjustable relative to the vibrating beam 220, such as via a pair of elevation actuators (not shown), such as in a similar manner as discussed above with respect to screeding devices 10 and 110. Also, the elevation actuators may be operable in response to a laser plane detection system via a pair of laser receivers (also not shown) mounted to the vibrating beam.

Figure 12:
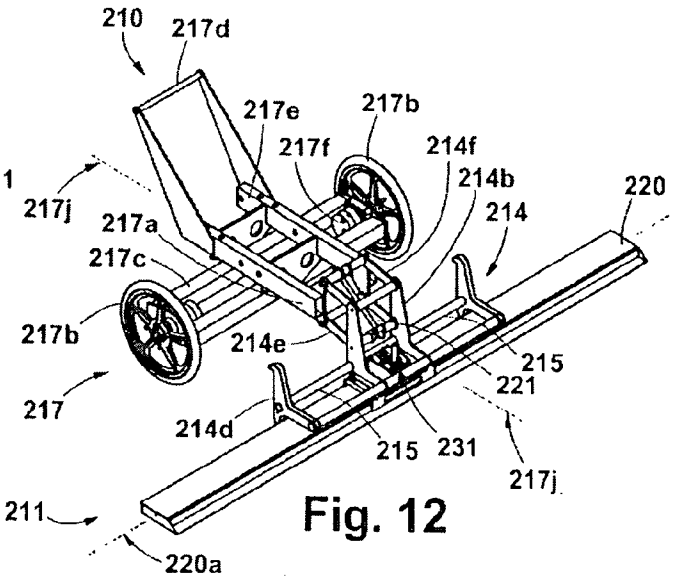
FIG. 12 is an upper perspective view of another screeding device in accordance with the present invention, with a wheeled frame structure.
Figure 13:
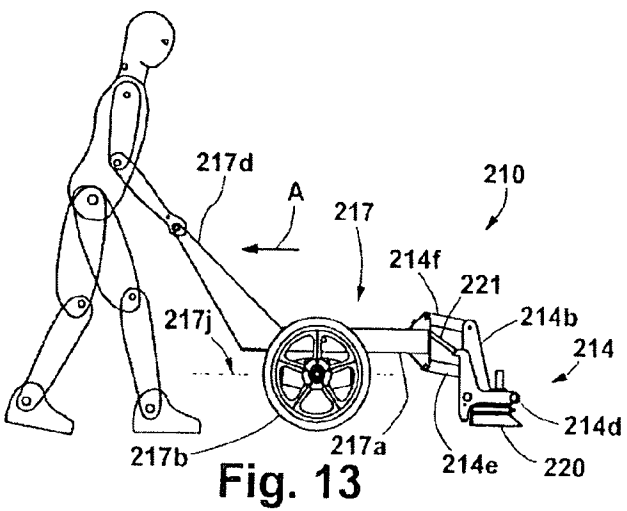
FIG. 13 is a side elevation of the screeding device of FIG. 12 in use by an operator.
Figure 14:
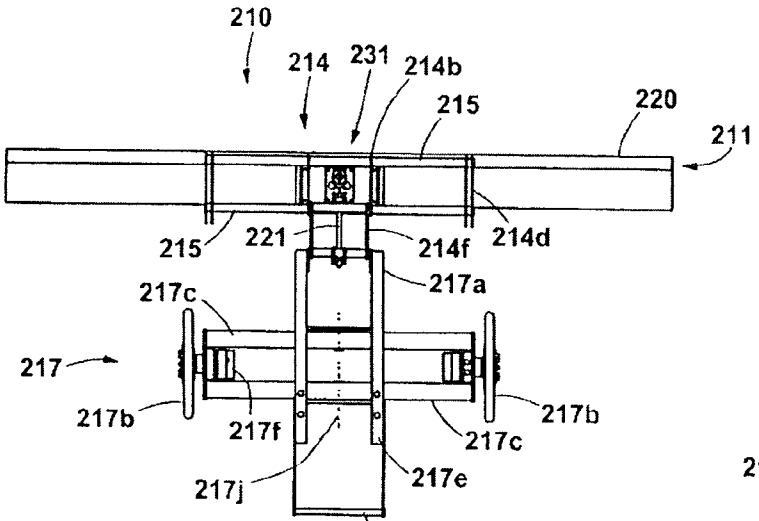
FIG. 14 is a top plan view of the screeding device of FIGS. 12 and 13.
Figure 15:
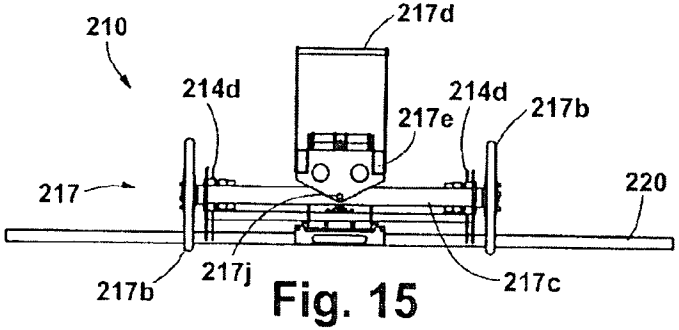
FIG. 15 is a front end elevation of the screeding device of FIGS. 12-14.

The operating range height of the vibrating beam 220 may be manually adjusted relative to the level of the wheels 217*b* via an adjustment device 221 (FIGS. 12-14). This adjustment is desirable to correspond to the thickness of the concrete slab where the vibrating beam 220 rests upon the uncured concrete and the wheels 217*b* may rest upon the sub-grade surface and drive through and/or over the uncured concrete. The adjustment device 221 may be an actuator, a threaded rod, turnbuckle, or any other extension and retraction device or the like, and is operable to adjust the height of the vibrating beam 220 relative to the wheeled support 217. As can be seen from FIGS. 12 and 13, extension and retraction of adjustment device 221 causes the frame 214 and vibrating beam 220 to lower and raise, respectively, relative to wheeled support 217 via pivotal movement of both sets of parallel linkages 214*e*, 214*f* simultaneously relative to rear end 217*a* of wheeled support and corresponding pivotal movement of central frame portion 214*b* relative to both sets of parallel linkages 214*e*, 214*f*. The movement of linkages 214*e*, 214*f* relative to wheeled support 217 and of frame portion 214*b* relative to linkages 214*e*, 214*f* provides generally vertical reciprocal movement of frame portion 214*b* relative to wheeled support 217, such that frame portion 214*b* remains in generally the same orientation as the frame portion 214*b* is raised or lowered relative to wheeled support 217.

Adjustment device 221 may be manually rotated or actuated to retract or extend and functions to raise and lower central frame portion 214*b* relative to wheeled support 217, while linkages 214*e*, 214*f* function to maintain the vibrating beam in its generally horizontal orientation or at its desired pitch during such vertical movement. The linkages 214*e*, 214*f* thus limit or substantially limit or preclude rotation of vibrating beam 220 about its longitudinal axis 220*a* (FIG. 12) as vibrating beam 220 is vertically adjusted to various operating range heights. Additionally, either or both of the linkages 214*e*, 214*f* may be replaced with adjustment devices that are operable to adjust the relative angle or pitch of the framework 214, central frame portion 214*b*, and vibrating beam 220 relative to both the wheeled support 217 and the generally horizontal work surface. The adjustment devices may be an actuator, a threaded rod, turnbuckle, or any other extension and retraction device or the like, without affecting the scope of the present invention, and are thus operable to adjust the "angle of attack" of the vibrating beam 220 relative to the wheeled support 217.

During use, an operator pulls, drives or otherwise moves wheeled screeding device 210 in the direction shown by directional arrow A in FIG. 13 to move wheels 217*b* along and through the uncured concrete surface and to move vibrating beam 220 and the plow over the uncured concrete surface to consolidate, smooth, level and/or flatten the surface at a desired grade. Vibrating beam 220 and any plow or other grade setting device as disclosed herein also move or cause sufficient concrete to fill in the tracks created by wheels 217*b* passing through the uncured concrete ahead of vibrating beam 220. The operating range height of the vibrating beam 220 may be set relative to wheels 217*b* via adjustment device 221 and maintained at that level relative to the wheeled support. The desired grade elevation may also be adjusted by adjusting a plow (such as a plow of the types discussed above and shown in FIG. 1 and FIG. 10), or other grade setting device or member (not shown in FIGS. 12-15) relative to the vibrating beam 220 via elevation actuators or the like, such as discussed above with respect to screeding devices 10, 110 and shown in FIGS. 1, 10, respectively, while the screeding device is moved over and through the concrete surface.

Vibrating beam 220, and/or any other grade setting device, may at least be partially supported by a wheeled support 217 of the screeding device 210, and may include a wider or longer vibrating beam and plow than the non-wheeled screeding devices 10 and 110, as discussed above. For example, screeding device 210 may optionally include a vibrating beam 220 of approximately 6 feet (1.83 m), 7 feet (2.13 m), 8 feet (2.44 m), 10 feet (3.05 m), 12 feet (3.65 m) or the like, in order to cover a desired amount of surface area with each working pass of the screeding device. The additional weight of larger members is thus at least partially supported by the wheels 217*b*. With the addition of a power source 30, electronic controls 21, and laser receivers 22 (as shown in FIG. 1 and FIG. 10), and wheel drive motors 217*f*, further advantages of screeding device 210 may be achieved, as will be described below.

Optionally, an upper portion of wheeled support 217 may be pivotally mounted to laterally extending frame portions 217*c* and wheels 217*b* such that the frame portion may be pivoted side to side, providing a roll action as needed through an axis 217*j* with respect to the direction of travel of screeding device 210. Such pivotal movement allows for adjustment of the plane of the vibrating beam 220 about longitudinal axis 217*j* of wheeled support 217.

Referring now to FIGS. 16-20, a powered wheeled screeding device 310 includes a screeding head 311, which includes a grade setting member or strike-off plow 312 and a vibrating beam 320, attached to a framework 314. Framework 314 is adjustably mounted to a wheeled support 317 and is adjustable to adjust a position or orientation of screeding head 311 relative to wheeled support 317. The wheeled support 317 includes a pair of powered drive wheels 317*b* and is movable or drivable over and/or through the uncured concrete.

Wheeled support 317 includes a pair of wheels 317*b* at opposite ends of a laterally extending frame portion 317*c*. A handle 317*d* extends upward and forward from a forward end 317*e* of wheeled support 317 and may be grasped and pulled or pushed by an operator to move and/or steer screeding device 310 over and through the uncured concrete surfaces or the like. Preferably, each wheel 317*b* is powered or driven by its own drive motor 317*f* positioned at each wheel to further enhance maneuverability and mobility of the screeding device 310. In the illustrated embodiment, drive motors 317*f* are hydraulic motors powered by the power source 330 (which may include an engine, an hydraulic pump and a reservoir for hydraulic fluid or oil), which is operable to provide pressurized hydraulic fluid to the motors 317*f* and other hydraulically controlled cylinders and motors, as discussed below. However, drive motors 317*f* may be any other means for rotatably driving the wheels of the screeding device, such as electric, pneumatic, or the like, without affecting the scope of the present invention. Optionally, the drive means for the wheels may include a motor positioned above the central portion or axle 317*w* of the wheels 317*b* which is operable to drive the wheels via a chain drive mechanism and/or drive shafts (not shown), such that the drive means is positioned substantially above the axles of the wheels, thereby providing increased ground clearance for the wheeled support.

Figure 16:
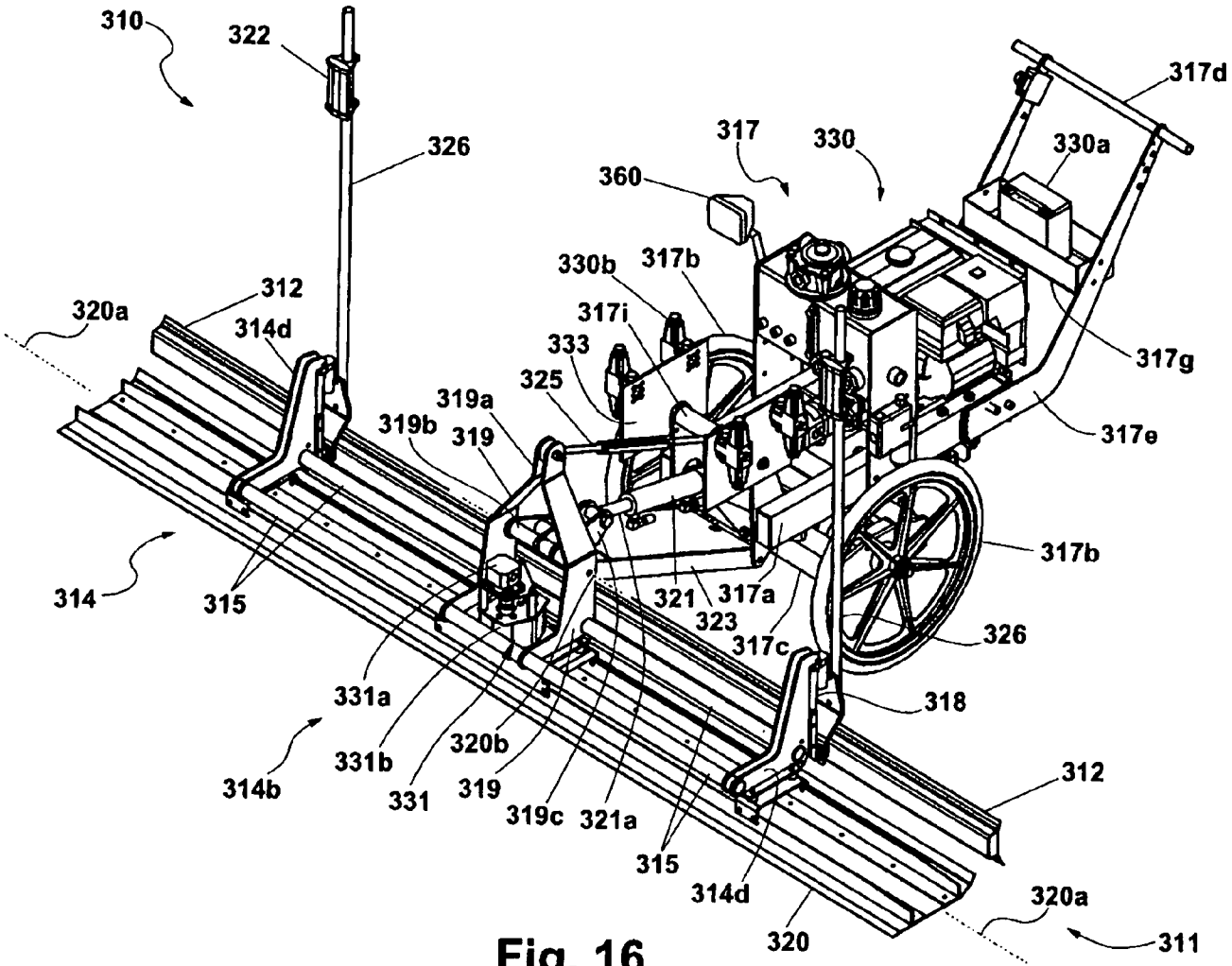
FIG. 16 is an upper, rear perspective view of another screeding device in accordance with the present invention, with a wheeled frame structure.
Figure 17:
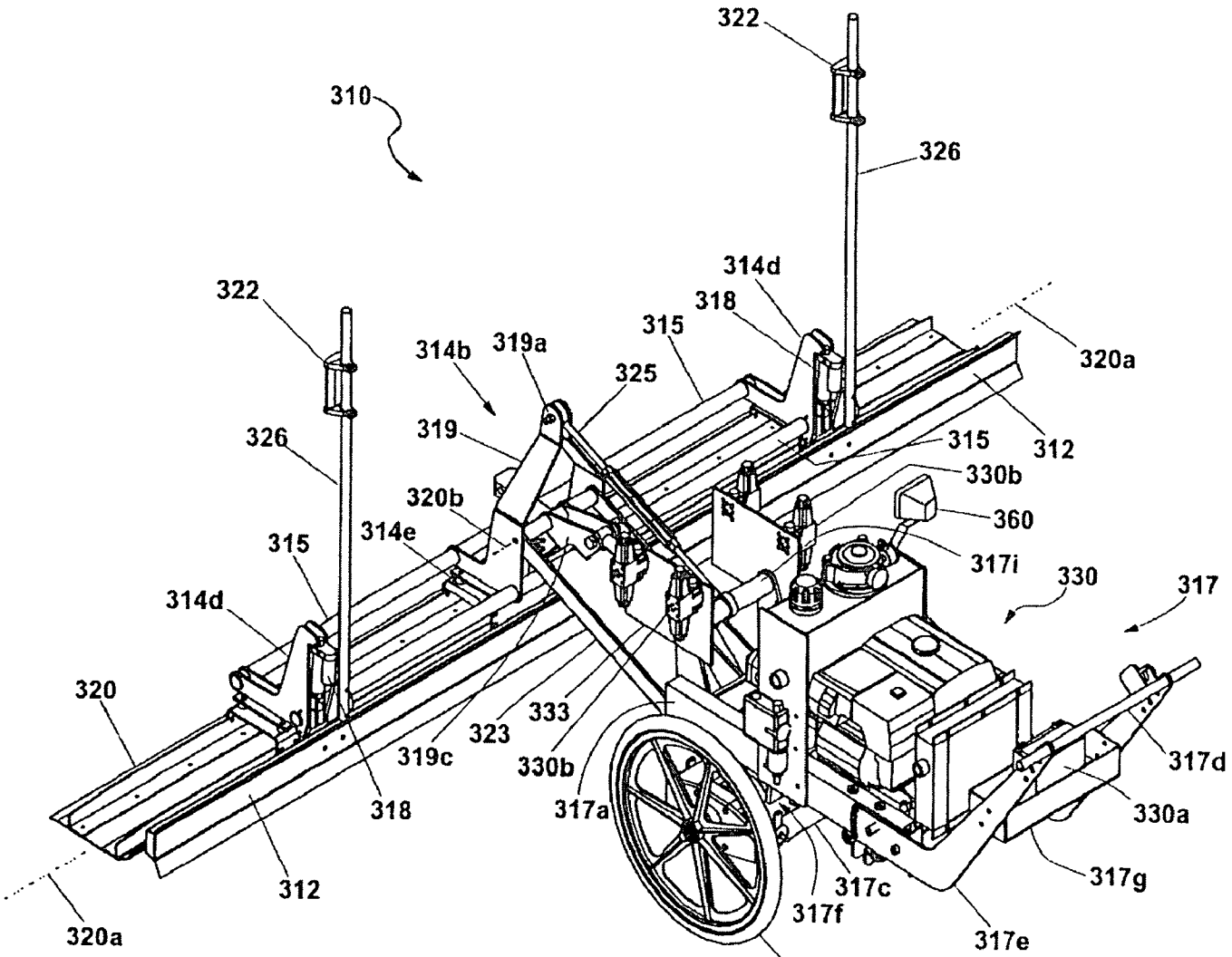
FIG. 17 is an upper, front perspective view of the screeding device of FIG. 16.
Figure 21:
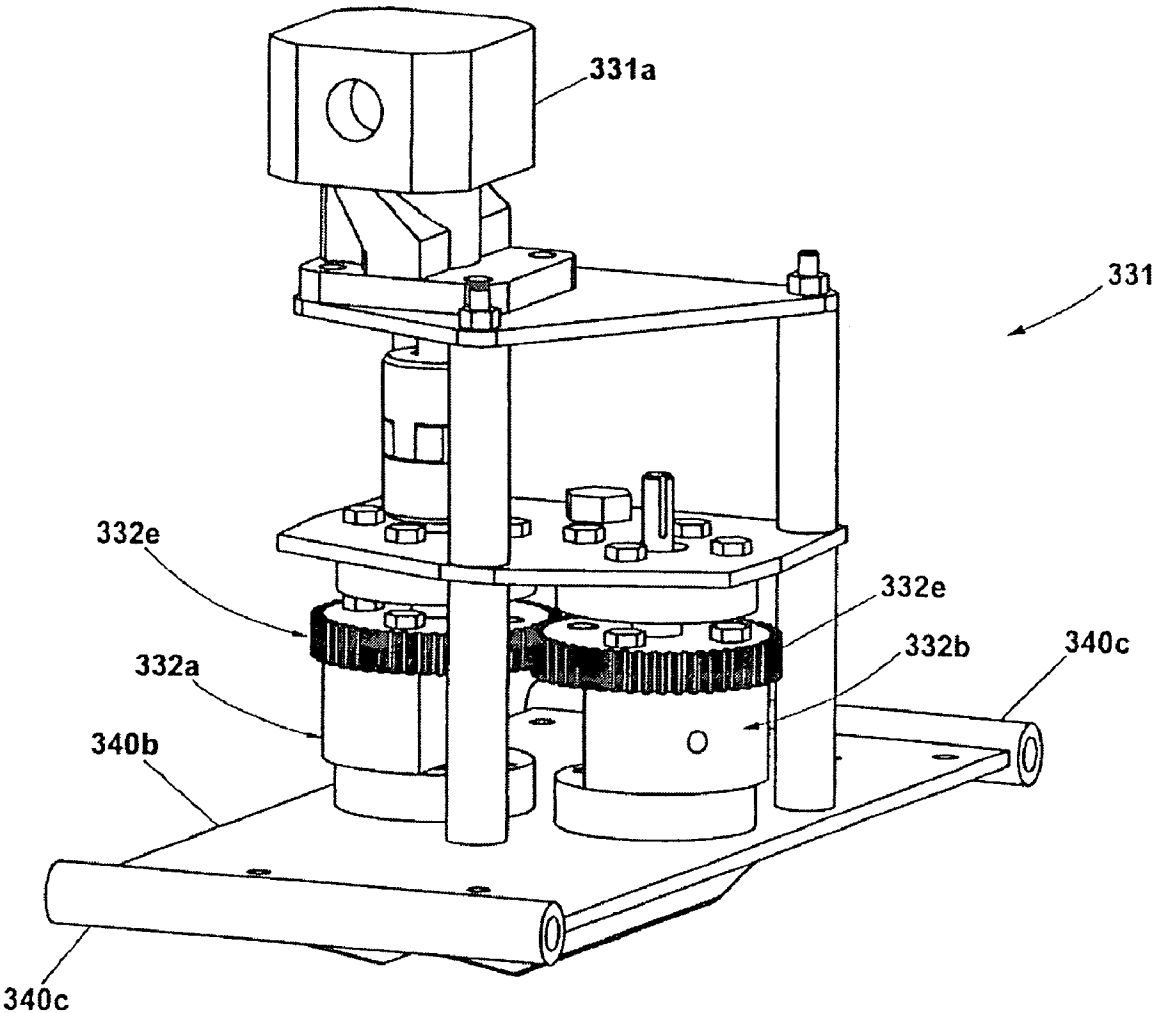
FIG. 21 is an enlarged perspective view of a vibrating device with eccentric weight members useful with the screeding device of FIGS. 16-20.
Figure 28:
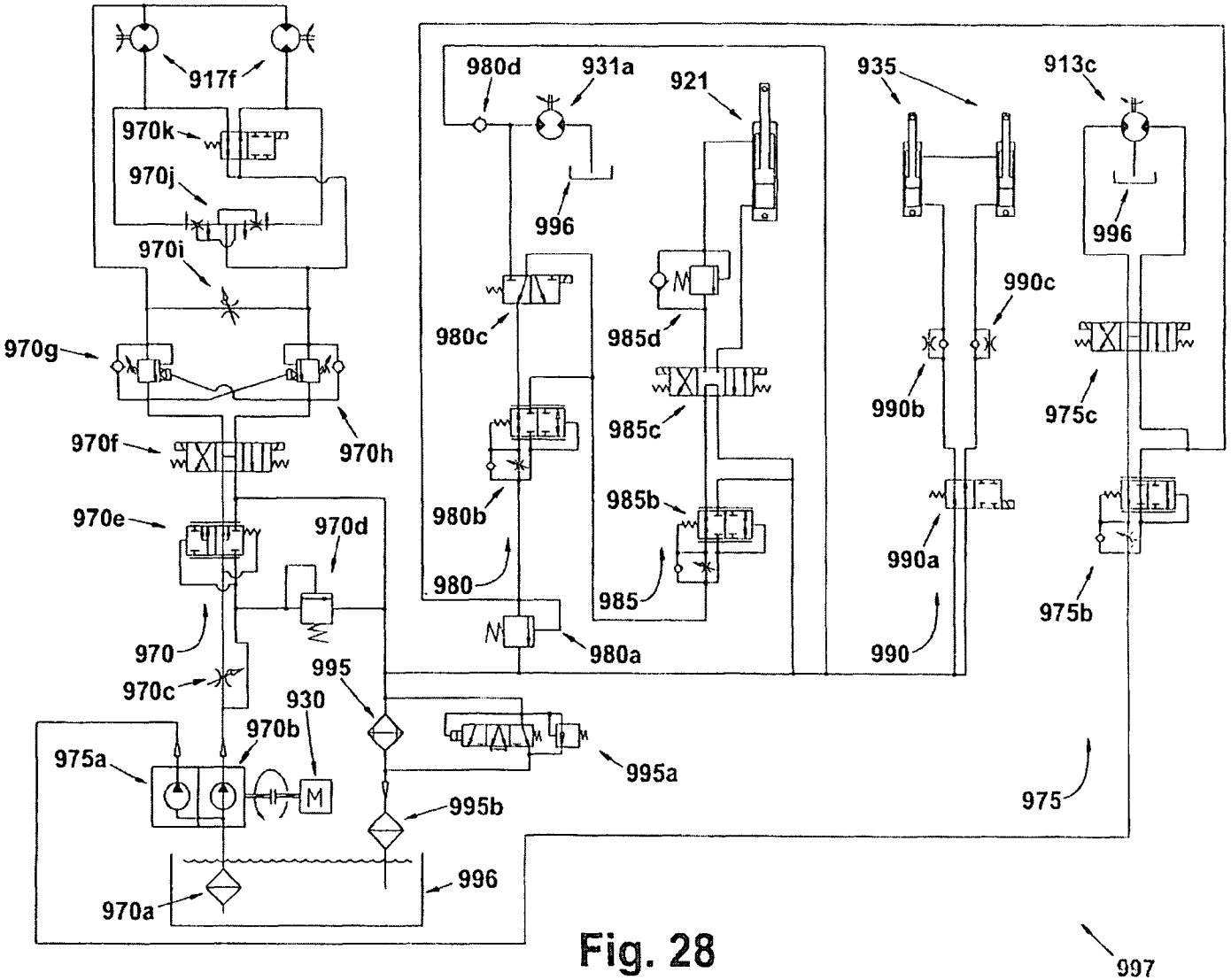
FIG. 28 is an hydraulic schematic diagram exemplary of an hydraulic control system useful with a screeding device of the present invention.

Additionally, power source or motor or engine 330 may be operable to actuate or energize an hydraulic motor 331*a* (FIGS. 16 and 21) of a vibration device 331, which is operable to cause vibration of the vibrating beam 320, in a similar manner as described above with respect to vibration device 31. In the illustrated embodiment, power source 330 is an internal combustion engine driving at least one hydraulic pump (for example, the power source may drive two hydraulic pumps 975*a*, 975*b* (as in a preferred embodiment, of which an hydraulic diagram 997 is shown in FIG. 28) or more hydraulic pumps, without affecting the scope of the present invention) and includes a fluid reservoir system 996 (FIG. 28) for providing pressurized fluid to actuators or hydraulic cylinders 318, 321 and hydraulic motors 331*a*, 317*f* of screeding device 310 via a plurality of solenoid valves and hydraulic controls 330*b* (FIGS. 16 and 17). Power source 330 is operable to drive or actuate the hydraulic motor 331*a* of vibration device 331 via hydraulic lines (not shown). In the illustrated embodiment, wheeled support 317 includes a pair of spaced plates 333 mounted at either end of cross member 317*i* for supporting the hydraulic valves and controls 330*b*. Optionally, the power source 330 may include an electric storage battery 330*a*, which may be positioned at the wheeled support 317, or within a battery mounting support 317*g* near handle 317*d*. Alternately, the power source 330 may include an electric drive motor, such as a battery-powered motor, a power-cord supplied motor, a compressed-air supplied pneumatic motor, or the like, without affecting the scope of the present invention.

In a preferred embodiment, screeding device 310 may also include controls for controlling the drive motors or drive means of the wheels through a range of selectable or infinitely variable speeds as desired by the operator. For example, the controls may be manually actuated to drive the wheels in a forward direction or a reverse direction and may be actuated to drive the wheels independent from one another to assist in steering or turning the screeding device. Optionally, the controls may include a cruise control type control system which is operable to maintain a generally constant drive speed of the device as the screeding device moves over and through the uncured concrete.

Figure 22:
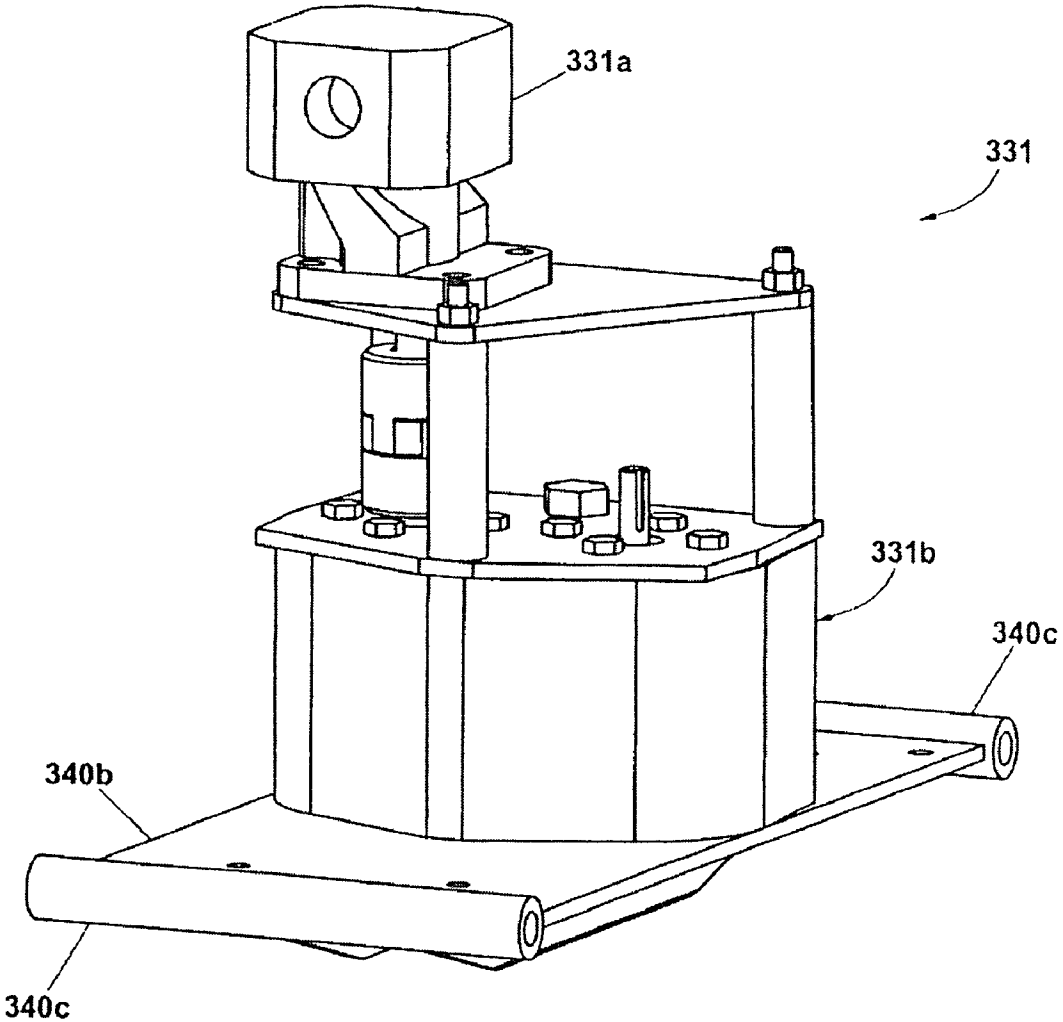
FIG. 22 is another enlarged perspective view of the vibrating device of FIG. 21, with a housing around the eccentric weight members.

Preferably, in a manner similar to vibration device 31 (FIG. 9) discussed above, vibration device 331 includes a pair of counter rotating eccentrically weighted shafts or members 332*a*, 332*b* (FIG. 21), which are rotatably driven by gears 332*e* at vibrating beam 320, as discussed above with respect to screeding device 10. Because vibration device 331 is substantially similar to vibration device 31 discussed above, a detailed discussion of vibration device 331 will not be repeated herein. Briefly, one of the eccentric weight members 332*a* may be rotatably driven by hydraulic motor 331*a*. The eccentric weight members 332*a* and 332*b* are engaged with one another via gear teeth 332*e*, such that rotation of member 332*a* causes a corresponding, opposite rotation of member 332*b*. As also discussed above, the vibrating beam 320 may be attached to the vibrating device 331 via cylindrical mounting members 340*c*, while the lower mounting plate 340*b* of vibrating device 331 is mounted to the framework 314 through one or more vibration isolator or elastic rubber sandwich mounts 314*e* (FIG. 17), which serves to help dampen the transmission of beam vibration to the support frame 314 and to the wheeled support 317 and operator handle 317*d*. The eccentric weight members 332*a* and 332*b* are preferably indexed relative to each other by means of the gear teeth 332*e* such that the vibration of the beam 320 is directed to act in a primary axis matching the elongated axis of the vibrator beam 320, while also serving to reduce, minimize, or cancel vibration in the horizontal axis perpendicular to the vibrator beam 320. The eccentric weight members thus allow the vibration displacement to be primarily directed in a desired plane, while substantially precluding vibration displacement in an undesired plane. Optionally, the speed of rotation of the eccentric weight members may be adjustable to a desired speed depending on the particular application of the screeding device and/or the length of the plow and/or beam mounted to the screeding device. Optionally, the mass of the eccentric weight members may be changed or adjusted through the addition or subtraction of weight from each eccentric weight member, or through replacement of the eccentric weights. As shown in FIGS. 16 and 22, vibrating device 331 is preferably substantially encased within a housing 331*b* to protect the eccentric weight members, gear teeth, and shaft bearings from the elements.

Similar to screeding head 11 of screeding device 10, discussed above, screeding head 311 of screeding device 310 includes grade setting member or strike-off plow 312, which is adjustably mounted to each of the side frame members 314*d* via a pair of parallel, plow adjusting linkages (not shown in FIGS. 16-20) and an elevation cylinder or actuator 318, in a manner similar to that discussed above in screeding device 10. The parallel linkages function to maintain horizontal attachment and generally parallel alignment of plow 312 relative to framework 314 as the plow is raised or lowered by actuators 318. The linkages thus limit or substantially preclude pivotal movement of the plow 312 as it is vertically adjusted by actuators 318. Preferably, elevation actuators 318 are operable to adjust the position of plow 312 relative to vibrating beam 320 in response to an on-site laser plane reference system and a laser receiver 322 positioned at a generally vertical rod or post 326 extending upwardly from plow 312 at or near each actuator 318, all as described above with respect to screeding devices 10 and/or 110.

Optionally, screeding head 311 may be detachably mounted to wheeled support 317, such that different length or different sized vibrating beams, plows, or strike-off devices, which may include various lengths of approximately 6 feet (1.83 m), 7 feet (2.13 m), 8 feet (2.44 m), 10 feet (3.05 m), 12 feet (3.65 m) or the like, may be mounted to the wheeled support in order to cover a desired amount of surface area with each pass of the screeding device, depending on the particular application. Preferably, the screeding head 311 is easily detachable and mountable to wheeled support 317, such that the screeding head may be easily removed for transportation of the screeding device from one work site to another. In the illustrated embodiment, the wheeled support and wheels are preferably of such dimensions that the device may be moved or driven through a standard sized door opening, such as a 36 inch (91 cm) wide service door opening of a building, when the screeding head is temporarily removed from the wheeled support and manually carried through such a door opening by work personnel.

Optionally, the screeding head 311 may be adjustably mounted to wheeled support 317, such that the screeding head may be pivoted about a longitudinal axis 317*j* (FIGS. 17A, 17B and 19), which is generally parallel to the direction of travel of the screeding device, and/or about an axis 320*b* generally parallel to the longitudinal axis 320*a* of the vibrating beam (FIGS. 16 and 17). The screeding head 311 may thus be adjustable about one or more axes to a desired orientation with respect to the wheeled support. The screeding head may include a leveling system which functions to level the screeding head relative to the wheeled support or relative to a generally horizontal plane in response to an angle or level sensor. It is further envisioned that the screeding head may be substantially fixed or locked in a desired orientation relative to the wheeled support to limit pivotal movement of the screeding head about one or both axes during operation of the screeding device, without affecting the scope of the present invention.

Figure 18:
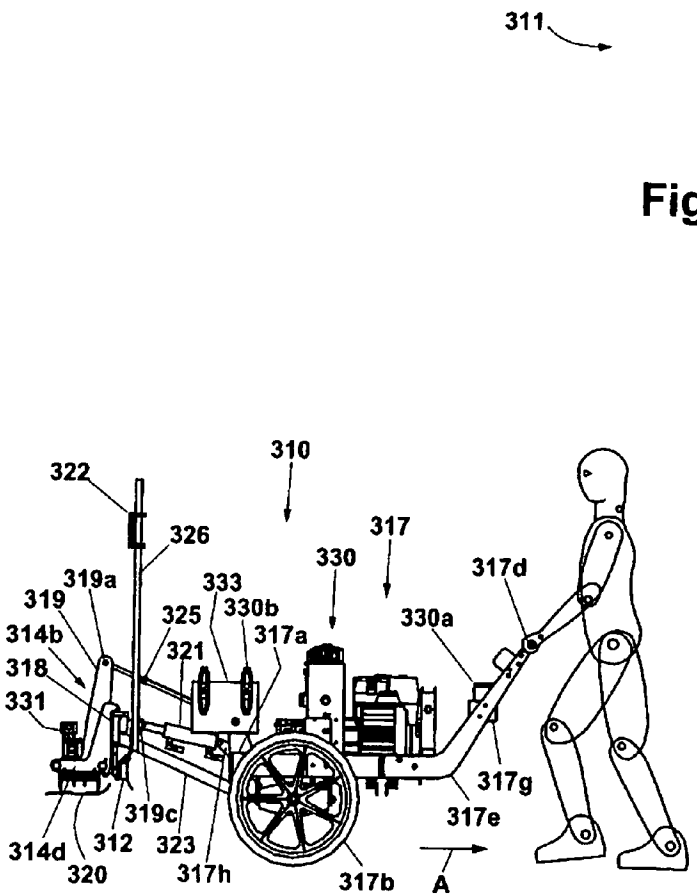
FIG. 18 is a side elevation of the screeding device of FIGS. 16 and 17 in use by an operator.

Framework 314 includes two pairs of spaced side frame members 314*d* which are connected together by a pair of generally parallel rods 315, similar to frames 14 and 214 discussed above. The rods 315 are also connected to a central frame portion 314*b* of framework 314, which is adjustably mounted to a rear end 317*a* of wheeled support 317 via a pair of linkages 323 and an adjustable member 325, such as a turnbuckle or the like. Adjustable member 325 is mounted between a cross member 317*i* of wheeled support 317 and the central frame portion 314*b* of framework 314, and is adjustable to adjust a pitch or "angle of attack" of framework 314 and vibrating beam 320 relative to wheeled support 317. Similarly, adjustable member 325 and linkages 323 are pivotable relative to wheeled support 317 via hydraulic actuator 321, as best shown in FIG. 18, to adjust an operating range height of framework 314 and screeding head 311 relative to wheeled support 317. As described above with respect to adjustment device 221, adjustable member 325 functions to maintain vibrating beam 320 at the desired orientation or "angle of attack" relative to wheeled support 317 through the operating range of travel.

In the illustrated embodiment, central frame portion 314*b* is pivotally and adjustably mounted to rear end 317*a* of wheeled support 317 via the pair of parallel linkages 323, the adjustable member 325 and actuator 321. As best shown in FIGS. 16-18, central frame portion 314*b* includes a pair of upwardly extending brackets or flanges 319, which are bent or curved inwardly toward one another at their upper ends 319*a* to join one another. A cross member 319*b* extends between the upwardly extending brackets 319 and is fixedly secured to the brackets 319, such that pivotal movement of cross member 319*b* causes pivotal movement or rotation of the brackets 319 and of vibrating beam 320 and plow 312 about axis 320*b* defined by cross member 319*b*.

In the illustrated embodiment, cross member 319*b* includes an actuator mount 319*c* extending forwardly and upwardly from cross member 319*b* for mounting an end 321*a* of actuator 321, such as a hydraulic cylinder or other means for providing extension and retraction. Actuator 321 is positioned between actuator mount 319*c* and a second actuator mount 317*h* (FIG. 18) at rear end 317*a* of wheeled support 317. Also, each of the linkages 323 is pivotally mounted at one end to or at a respective end of cross member 319*b* and at the other end to or at the rear end 317*a* of wheeled support 317. Likewise, the adjustable member 325 is mounted at one end to the upper end 319*a* of brackets 319 and at the other end to cross member 317*i* of wheeled support 317, and at a position generally above the mounting points for the linkages 323.

As can be seen in FIGS. 16-18, adjustment of the length of adjustable member 325 causes pivotal movement of brackets 319 and vibrating beam 320 and plow 312 about cross member 319*b* and pivot axis 320*b*. This adjusts the pitch or angle of the vibrating beam 320 relative to the uncured concrete surface. As can also be seen in FIGS. 16-18, extension and retraction of actuator 321 causes lowering and raising, respectively, of central frame portion 314*b*, along with vibrating beam 320 and plow 312, relative to the level of wheeled support 317. Accordingly, the pitch angle and general height of the vibrating beam 320 relative to the wheeled support 317 may be selected and adjusted via adjustment of the turnbuckle or adjustable member 325 and extension and/or retraction of the adjustable member 321. Once a desired pitch or angle is set via adjustment of adjustable member 325, the grade or elevation height of the vibrating beam may be adjusted via actuator 321, while the pitch angle or "angle of attack" of the vibrating beam remains at the desired setting. The vibrating beam 320 and plow 312 may be lifted or raised above the uncured concrete surface or any low obstacles to ease movement of the screeding apparatus 310 through a work site area to and/or from a desired location or area of the uncured concrete.

The pitch angle and operating range of the elevation height of the screeding head 311 are selected to provide optimal results based upon the site conditions, concrete slab thickness, and concrete mix design, to achieve the desired consolidation, leveling, and flattening and/or to affect the smoothing of the uncured concrete surface to fill in and smooth over the tracks left in the uncured and unscreeded concrete by the operator and the wheels 317*b* of the wheeled support 317 in front of the plow 312 and vibrating beam 320 as the screeding device 310 is pulled or driven in the direction of arrow A in FIG. 18 over and through the uncured concrete surface. Adjustment of the pitch of vibrating beam 320 may also adjust the axes of rotation of the eccentric members to adjust the vibration plane of the vibrating beam. Further adjustment within the operating range height of the plow 312 to adjust the amount of material being struck off in front of the vibrating beam 320 is provided by the elevation actuators 318 in response to the laser receivers 322 and the laser reference plane, as discussed above.

Optionally, screeding apparatus 310 may include a pair of wheel track fillers (not shown in FIGS. 16-20, but such as shown at 450 in FIG. 23), which are operable to deflect or direct concrete into the furrows or channels formed by the wheels as the screeding device is moved through the uncured concrete. The wheel track fillers may be angled plow type devices which are positioned in front of a forward side of the plow, and just rearward of the wheels, to push or deflect concrete toward or into the furrows to generally fill in the furrows before the plow engages the uncured concrete. Optionally, screeding apparatus 310 may include one or more work lights 360 (FIG. 16), which provide illumination of the work site during darkened conditions.

Figure 17A:
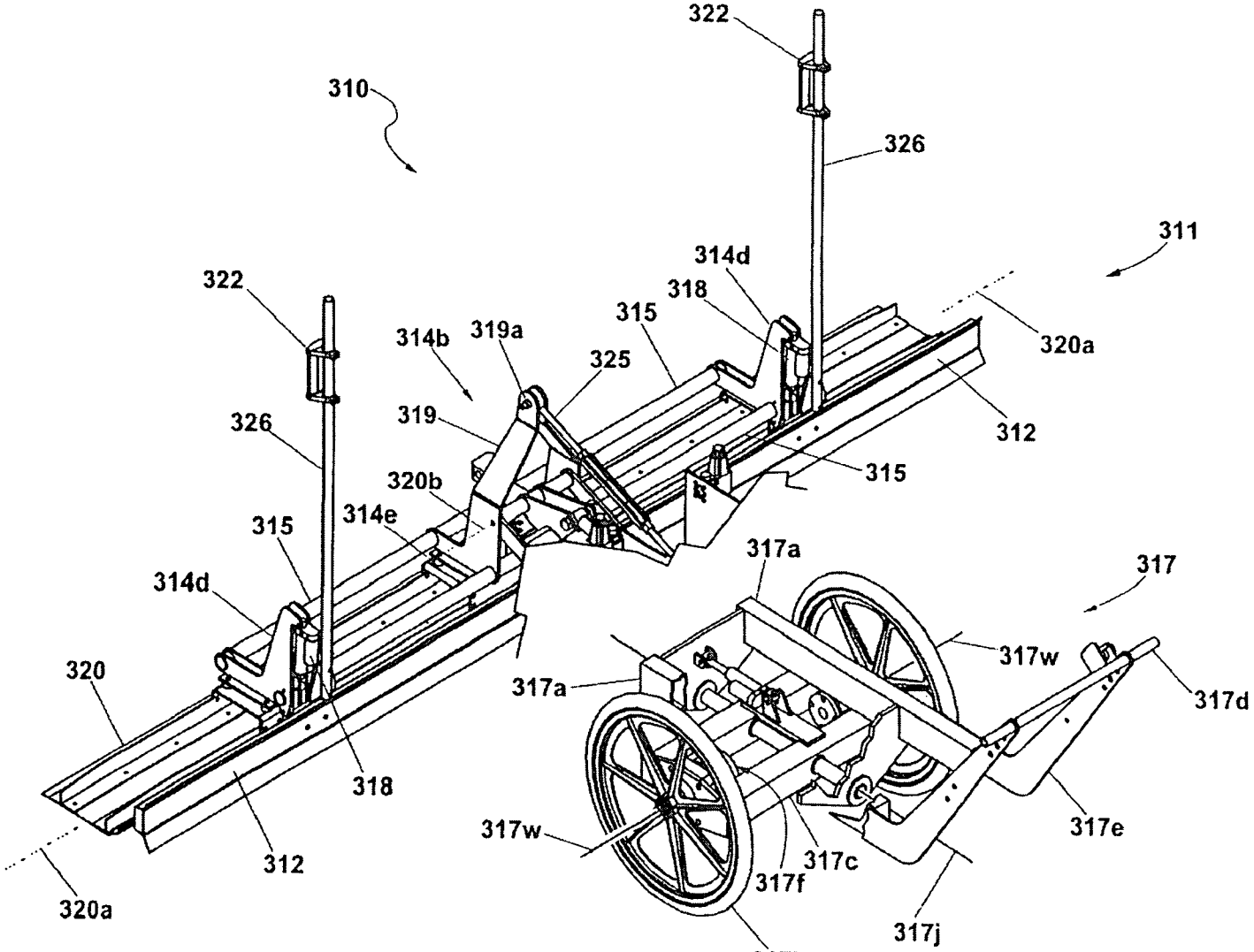
FIG. 17A is an upper, front perspective view similar to FIG. 17, with the power source omitted to reveal additional details of the wheeled support.
Figure 17B:
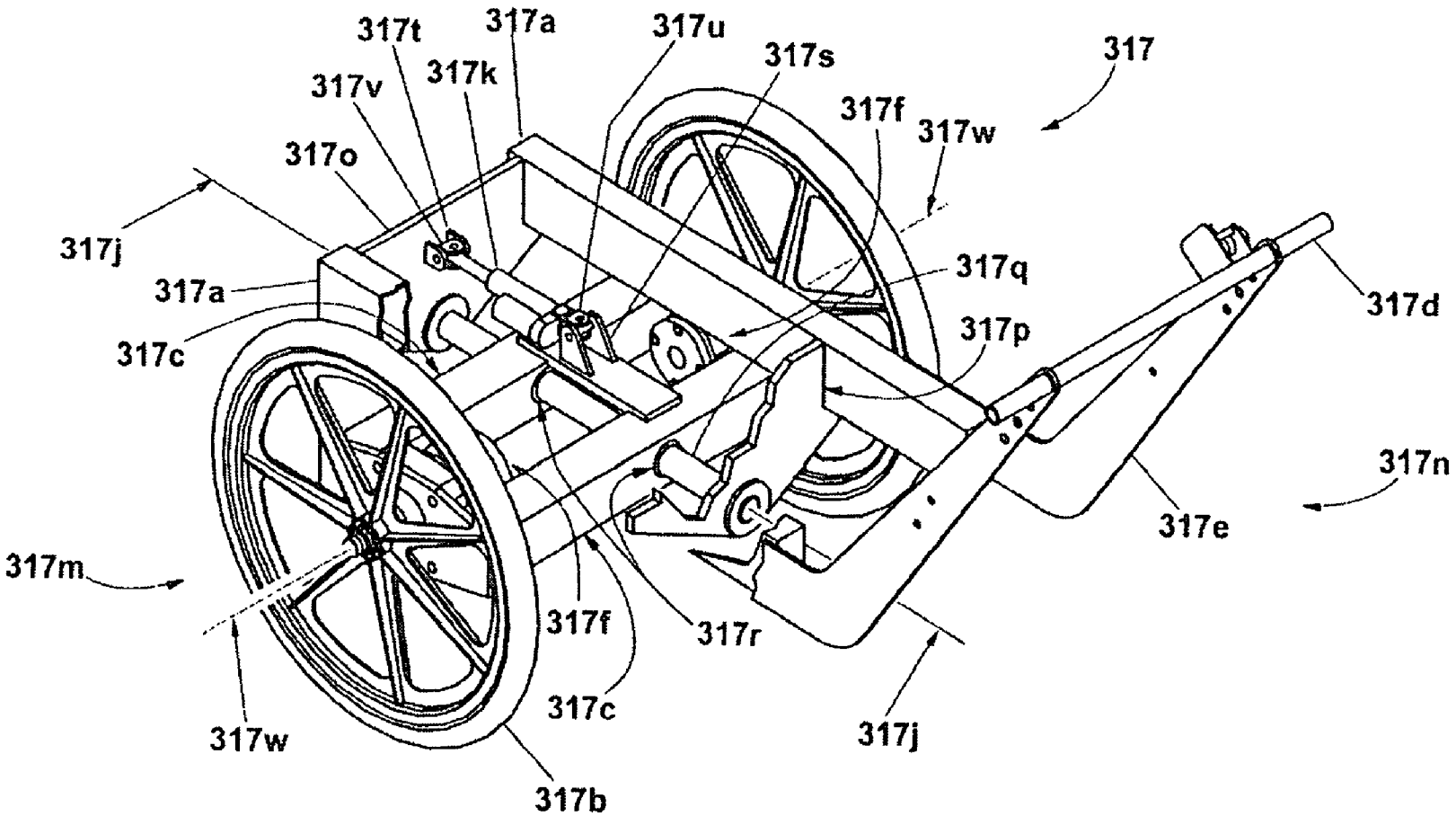
FIG. 17B is an enlarged perspective view similar to FIG. 17A, with the screeding head omitted for clarity.

Referring now in detail to FIGS. 17A and 17B, apparatus 310 maintains a center of gravity located in close proximity to and to the rearward side of the wheels 317*b* and axis 317*w* according to the direction of travel. The location of the center of gravity relative to the wheels 317*b* results in the screeding device 310 having the characteristic of being nearly balanced about an axis near and parallel to rotation axis 317*w* at the wheels 317*b*, with a greater portion of the apparatus' weight resting upon the wheels and a lesser portion of the apparatus' weight resting upon the vibrating beam 320, such that vibrating beam 320 is at least partially supported by, or essentially "floating" upon, the uncured concrete surface, and applies a sufficient and desired amount of down-pressure to work the surface. The amount of weight or downward force applied by vibrating beam 320 may be adjustable via the fore-aft adjustment of detachable counter weights (not shown) fastened to appropriate locations on the screeding device 310. Optionally, the amount of weight or downward force applied by vibrating beam 320 may be adjustable via an adjustable mounting location or mechanical adjustment slots or the like (not shown) between the laterally extending frame portion 317*c* and the wheeled support members 317*a*.

Optionally, and preferably, and as shown in FIGS. 17A and 17B, screeding device 310 may include an adjustment device 317*k*, which functions to adjust the fore-aft position of a lower wheeled support sub-frame assembly 317*m*, which is generally comprised of the laterally extending frame portions 317*c*, drive motors 317*f*, and wheels 317*b*, relative to an upper wheeled support sub-frame assembly 317*n*, which is generally comprised of handle 317*d*, forward end of wheeled support 317*e*, and rear end of wheeled support 317*a*. Lower wheeled support sub-frame assembly 317*m* is able to slide relative to upper sub-frame assembly 317*n* along longitudinal shaft 317*q* via bearings 317*r*. Longitudinal shaft 317*q* is mounted at its opposite ends between a front cross support 317*p* and a rear cross support 317*o* of upper sub-frame assembly 317*n*, thereby securing it to upper wheeled support frame 317*n*. The sliding axis of the lower wheeled support sub-frame assembly 317*m* relative to upper sub-frame assembly 317*n* is thus generally coaxial with the longitudinal axis of pivotal motion 317*j*, which is parallel to the direction of travel of the screeding device 310. A center actuator bracket 317*s* and a rear actuator bracket 317*t* contain a center u-joint 317*u* and a rear u-joint 317*v*, respectively, for pivotally mounting an actuator or adjustment device 317*k* therebetween. Therefore, center u-joint 317*u* and rear u-joint 317*v* are each able to maintain at least two axes or degrees of motion freedom to preclude binding of adjustment device 317*k* when lower wheeled support sub-frame assembly 317*m* is pivoted relative to upper wheeled support sub-frame assembly 317*n*. Relatively small degrees of twisting action along the axis of the actuator itself may be taken up by the actuator.

As shown in this example, the adjustment device 317*k* is a 12-volt DC linear electric actuator available commercially and manufactured by Warner Electric of South Beloit, Ill., USA. Other means of adjustment devices may also or otherwise be used, such as, but not limited to, a mechanical turnbuckle, a threaded shaft with a hand-wheel adjustment, a pressurized hydraulic cylinder, or a toothed rack and pinion gear, or any other actuators or the like that may be incorporated into the design to perform a similar adjustment function either manually, or as an option automatically, as may be desired, without affecting the scope of the present invention. In similar fashion, the center u-joint 317*u* and rear u-joint 317*v* of actuator 317*k* may also be replaced by spherical bearings, ball joints, elastic mountings, or the like, in order to accomplish equivalent degrees of mechanical freedom to limit or substantially preclude mechanical binding or limitation of adjustment device 317*k*, without affecting the scope of the present invention.

As can be seen in FIGS. 17A and 17B, shifting the lower wheeled support sub-frame portion 317*m* and wheels 317*b* to the front with respect to the upper wheeled support frame sub-frame 317*n* will increase the proportion of weight on the rearward side of the screeding apparatus 310 and the screeding head 311, which results in an increase in the force or down pressure exerted upon the uncured concrete by the vibrating beam 320, which is also supported by and works the uncured concrete surface. Conversely, shifting the lower wheeled support sub-frame portion 317*m* and wheels 317*b* to the rear with respect to the upper wheeled support frame sub-frame 317*n* will decrease the proportion of weight on the rearward side of the screeding apparatus 310 and the screeding head 311, which results in a decrease in force or down pressure exerted upon the uncured concrete by the vibrating beam 320, which is also supported by and works the uncured concrete surface. Thus, the means described above serves to adjust the force or "degree of float" of the vibrating beam 320 upon the uncured concrete surface as the uncured concrete surface is being worked and smoothed to the desired final elevation.

Additionally, the above described adjustment means may further include means to automatically control the position of the lower wheeled support sub-frame portion 317*m* and wheels 317*b* relative to the upper sub-frame 317*n* via an electric actuator 317*k* in response to measurements taken by a force sensor (not shown) mounted at the vibrating beam 320 of the screed head 311. The force sensor may measure the force exerted by the vibrating beam 320 against the concrete surface and accordingly output an electrical input signal to the onboard electronic control box (not shown), where an appropriate output signal is then generated by the control box to operate the electric actuator 317*k* and thus to shift the lower wheeled support sub-frame portion 317*m* relative to upper sub-frame assembly 317*n* accordingly and in the proper direction, in order to automatically maintain an approximate range of desired and preset "degree of float" of the vibrating beam 320 on the uncured concrete surface. The control system of screeding device 310 thus may provide an automatic closed-loop "degree of float" control system for the screeding device 310.

Alternately, it is further envisioned that the screeding head may be mounted at a rearward end of an extendable or adjustable boom (not shown) which extends rearward from the wheeled support. Extension of the boom then moves the screeding head 311 further rearward to increase the force of the screeding head 311 on the uncured concrete surface by increasing the amount of the unsupported weight of the screeding head 311 and the extendable boom. Conversely, retraction of the boom then moves the screeding head 311 further forward or closer to the wheels 317*b* to decrease the force of the screeding head 311 on the uncured concrete surface by decreasing the amount of the unsupported weight of the screeding head 311 and the extendable boom as they are increasingly supported by the wheels 317*b*. Alternately, the weight or down pressure exerted by the beam on the uncured concrete surface may be adjusted via weights (not shown) which may be added or removed from one of the ends of the screeding apparatus to affect the balance of the unit, without affecting the scope of the present invention.

Figure 23:
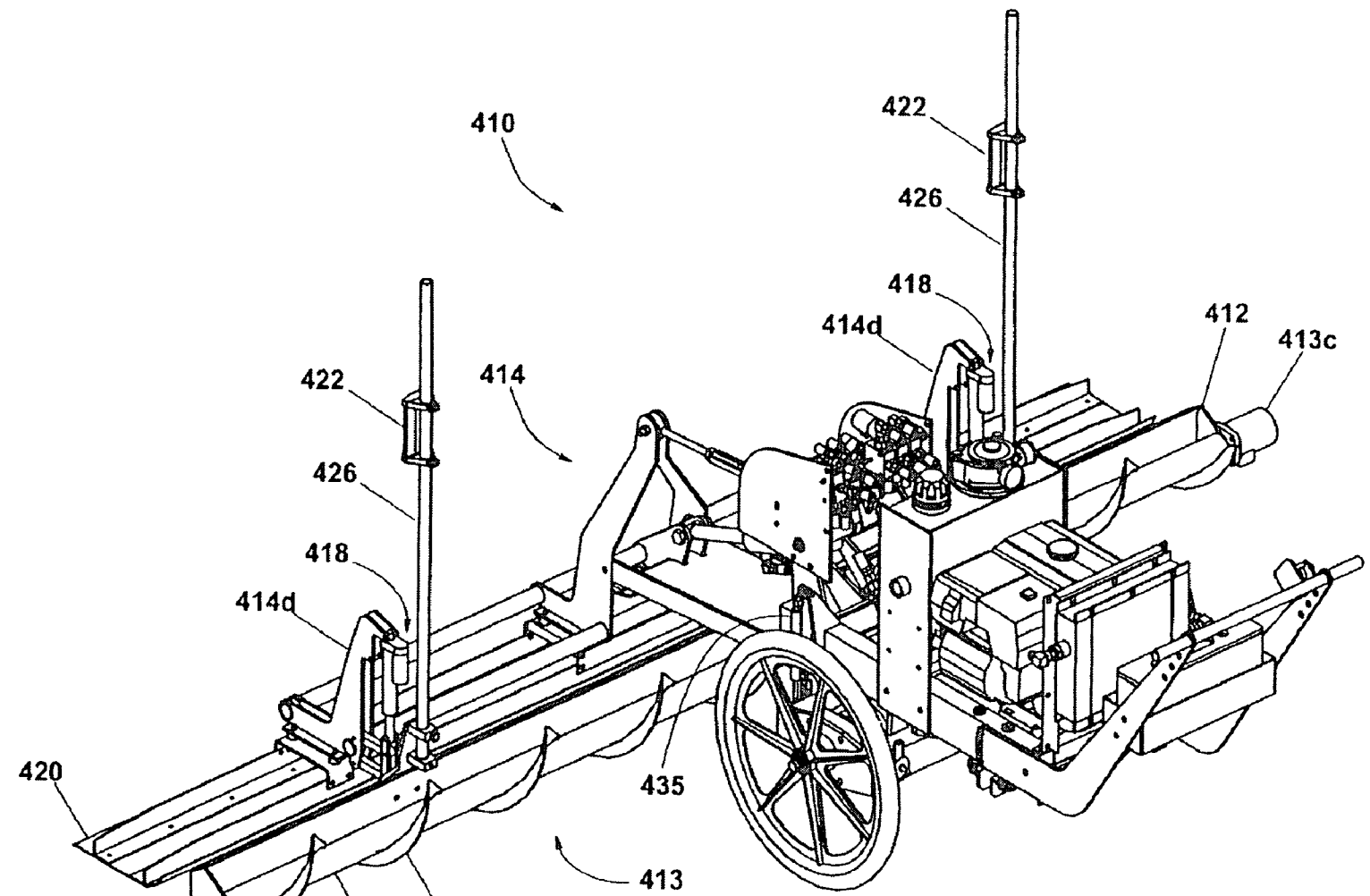
FIG. 23 is an upper, front perspective view of another screeding device in accordance with the present invention, with an auger mounted forward of the plow and vibrating member.
Figure 23A:
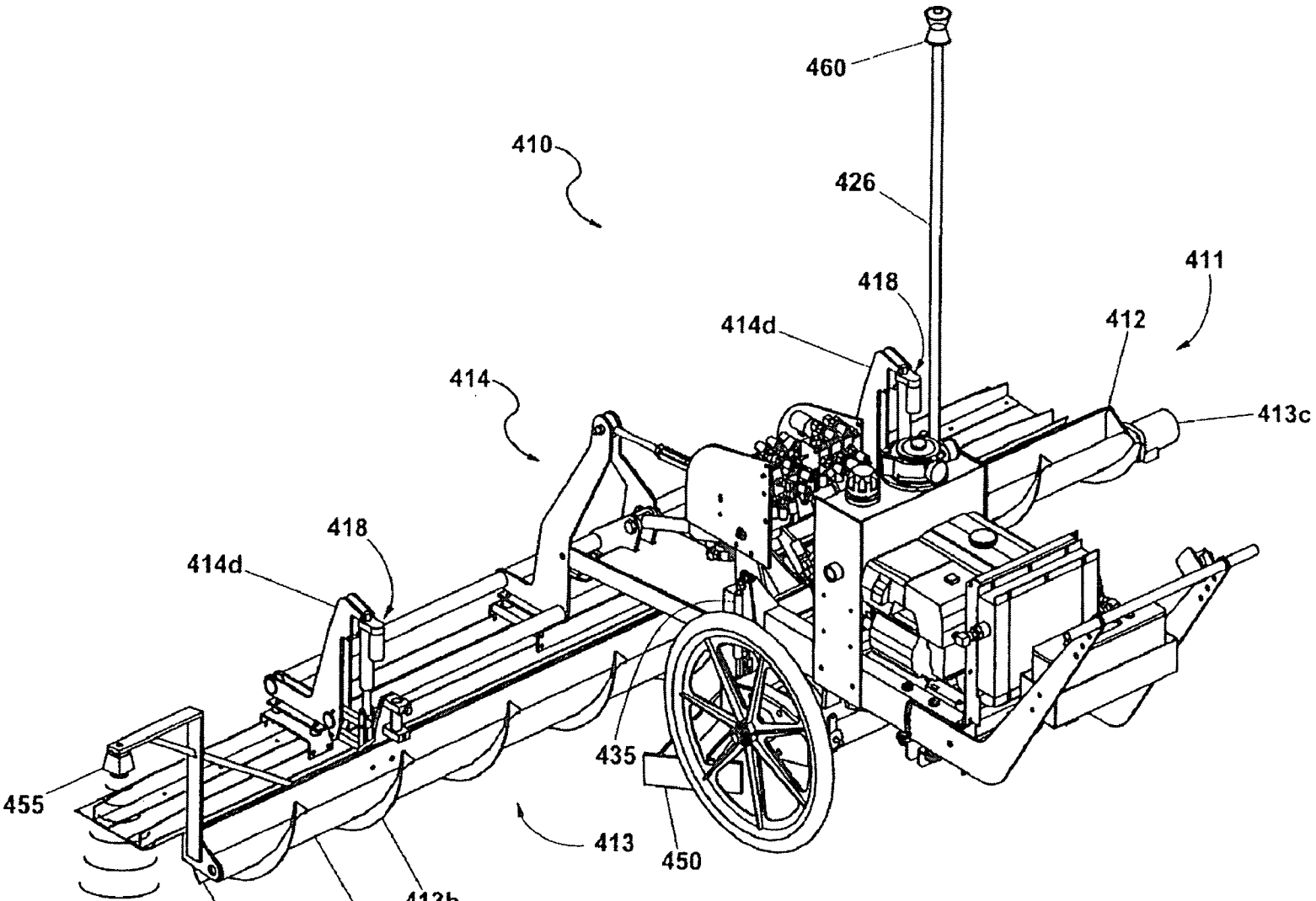
FIG. 23A is an upper, front perspective view of the screeding device of FIG. 23, shown with a 3-D profiler contouring system including a sonar height sensor and a laser reflective tracking target, and wheel track filler members just rearward of the wheels.

Lower wheeled support sub-frame portion 317*m*, including laterally extending frame portions 317*c*, may be pivotally mounted to upper wheeled support sub-frame 317*n*, such that the wheeled support 317 may be pivoted or tilted side to side. This provides a roll action through axis 317*j* with respect to the direction of travel of the wheeled support 317. Such free pivotal movement allows for adjustment of the plane of the vibrating beam 320 about a longitudinal axis 317*j* of wheeled support 317. In such applications, it is a further option that the screeding apparatus may include oil-filled oscillation cylinders or dampers (such as discussed below and as shown in FIGS. 23 and 23A) or the like to control and dampen such side to side pivotal movement of the screed head 311. This allows controlled axial movement of the screed head 311 along and/or about pivot axis 317*j* and also serves to enhance and maintain the stability of the apparatus while the screeding device 310 advances along a work path or is traveling along to and from a work site over rough terrain. The oscillation dampers may be oil-filled cylinders or gas-spring shock absorbers, but may alternately be any other form of dampening device, such as friction or other shock absorbing type devices or the like, without affecting the scope of the present invention.

Screeding apparatus 310 may also include a temporary mechanical link or hydraulic locking mechanism to temporarily fix or lock the lower wheeled support sub-frame portion 317*m*, including the laterally extending frame portion 317*c*, at a desired angle or orientation with respect to the wheels 317*b*. Alternately, the mechanical links may be replaced with oil-filled shock absorbers or hydraulic cylinders connected hydraulically to one another such that the free flow of fluid, and therefore pivotal motion at axis 317*j*, can be readily controlled through actuation of a fluid or selector valve 990*a* and/or the selected sizing of the orifices within check valves, such as orifices 990*b* and 990*c* as shown in FIG. 28 and as discussed below. Actuation of the selector valve may be either mechanical or through an electrical switch or electronic device (not shown) serving to control the electromechanical hydraulic solenoid valve or selector valve. The screeding device control system thus may provide an "oscillation lock" control system for the screeding apparatus or device 310.

It is further envisioned that such a screeding apparatus "oscillation lock" control system may include an angle or tilt sensor (not shown) to automatically detect the angle of tilt of the frame portion relative to the frame or the wheels or relative to a horizontal plane. In such an application, the screeding apparatus may be further operable to automatically sense the screed head position and to adjust the frame portion to a generally level or generally horizontal orientation (or to a desired angle) in response to the angle sensor, such as via a motor, hydraulic cylinder, or electric actuator (also not shown) operable to pivot frame portion 317*c* about axis 317*j* to a desired angle relative to wheels 317*b*.

Referring now to FIG. 23, a powered wheeled screeding device 410 includes a screeding head 411, which includes a grade setting device, such as a plow 412, and a vibrating beam 420 attached to a framework 414, similar to screeding device 310 discussed above. Screeding head 411 also includes a concrete moving device 413, which is operable to engage and move excess uncured concrete from in front of the vibrating beam 420 and/or plow 412, such as an auger mounted to the plow 412 at laterally opposite ends thereof. Screeding device 410, vibrating beam 420 and plow 412 are otherwise substantially similar to screeding device 310, vibrating beam 320 and plow 312, discussed above, such that a detailed discussion will not be repeated herein.

Concrete moving device or auger 413 is rotatably mounted between a pair of mounting brackets extending forwardly from each end of plow 412, such that auger 413 extends generally along and generally parallel to the entire length of plow 412. Auger 413 is mounted along the front portion or edge of the plow 412 and is rotatable to engage and remove excess concrete that may accumulate in front of screeding device 410 as the machine progresses through the uncured concrete. Auger 413 comprises a generally cylindrical tube portion 413*a* and a helical or spiraling, generally continuous, ridge, blade or flighting 413*b* extending radially outwardly from tube portion 413*a*, such that as auger 413 is rotated, blade or fighting 413*b* scrapes excess concrete from the uncured concrete surface and moves the excess concrete toward one side or the other, or just ahead of screeding head 411, depending on the direction of rotation of auger 413. Auger 413 is positioned relative to plow 412 such that a lower edge of fighting 413*a* is just above a lower edge of plow 412, such that auger 413 removes excess concrete, or respectively carries and adds concrete to fill any low spots while plow 412 sets the uncured concrete surface to the desired grade. Alternately, the auger 413 may be positioned relative to the plow 412 such that a lower edge of fighting 413*a* is equal in elevation to the lower edge of the plow 412, such that the auger 413 removes any excess concrete or respectively carries and adds concrete to fill any low spots and therefore sets the uncured concrete surface to the desired grade.

Auger 413 is driven by a driving mechanism or motor 413*c* which may turn or rotate the auger in either direction, such as in response to control by the operator. The driving mechanism may be a hydraulic motor positioned at one end of the auger and operable to rotate the auger via a keyed-shaft or the like. Alternately, other means to drive the auger may be used, including but not limited to, electric or air drive motors, roller chains and sprocket gears, right-angle gearboxes, and/or cogged belts and pulleys and/or the like, without affecting the scope of the present invention. Optionally, a "center drive position" may be implemented with a drive chain engaging a sprocket mounted near the mid-point of the auger, without affecting the scope of the present invention. If such a drive chain or belt were implemented, the chain or belt may preferably be substantially or completely enclosed to limit or preclude exposure to the concrete aggregate, in order to avoid potential jamming of the drive chain or belt.

Preferably, the auger 413 is constructed of lightweight plastic in order to minimize the weight of screeding device 410. Optionally, the auger 413 may comprise injection-molded modular plastic auger sections with an interlocking lap joint that allows the sections to align with respect to one another when they are joined together along a common center drive shaft. Such an auger assembly is commercially available from The Lundell Corporation, of Odebolt, Iowa, USA, and is used in a variety of applications including farming, foods, and material handling equipment. Since the auger on screeding device 410 is preferably a lightweight plastic member, the auger may not be required or suitable to cut or establish the final grade height of the concrete. Therefore, the dimensional accuracy of the auger flighting or any deflection in the auger main shaft at its center due to material loads may not be as critical as with other screeding machines. The auger 413 on screeding device 410 functions to remove excess material off to the side such that plow 412 will continue to cut the grade, in a similar manner as screeding device 310, as discussed above.

It is envisioned that the screeding device of the present invention may alternately include an auger or the like positioned along a forward edge of the vibrating beam, whereby the auger is operable to cut or establish the grade height of the concrete as the screeding device is moved along and through the uncured concrete. Such an embodiment may or may not include a strike-off plow or indicating member. The auger may replace the function of this component entirely or, optionally, the auger may supplement engagement and strike-off of the concrete. The auger or other such device may be vertically adjustable in response to the elevation actuators or cylinders to adjust the concrete surface to the desired grade, such as in a manner similar to the other grade setting devices 12, 112, 212, 312 and/or 412, discussed above. In such an embodiment, it is further envisioned that the auger may be constructed to close tolerance dimensions and constructed of materials of increased structural rigidity, such as alloy steel or carbon fiber or the like, such that the auger may be increasingly suited for cutting or establishing the grade height of the uncured concrete as the screeding device is moved along and through the uncured concrete.

Screeding device 410 preferably includes a pair of laser receivers 422 mounted to the ends of respective rods 426 extending upward from the plow 412, similar to laser receivers 22, discussed above. Preferably, the laser receivers 422 are positioned generally near to the elevation actuators 418 at the frame members 414*d*, such as discussed above with respect to screeding device 110. The grade of the uncured concrete surface may thus be set by grade setting device or plow 412 in response to a laser plane generating system and an established laser plane reference, as discussed above. It is further envisioned that the elevation actuators 418 may be at least occasionally correspondingly operable in response to a signal from only one of the laser receivers 422, such as in situations where the laser beam reference plane may be temporarily blocked from being received, such as disclosed in U.S. Pat. No. 5,556,226, issued Sep. 17, 1996 to Hohmann, Jr. and entitled AUTOMATED, LASER ALIGNED LEVELING APPARATUS, which is hereby incorporated herein by reference.

Optionally, the elevation actuators may be controlled by other means or control systems, such as shown in FIG. 23A, such as a three dimensional profiler system (such as a 3-D Profiler System commercially available from Somero Enterprises), such as disclosed in U.S. Pat. No. 6,227,761, issued May 8, 2001 to Kieranen et al. and entitled APPARATUS AND METHOD FOR THREE DIMENSIONAL CONTOURING, which is hereby incorporated herein by reference. Optionally, screeding apparatus 410 may also include at least one sonic tracer or sensor 455 and at least one three-dimensional laser tracking target 460 (as shown in FIG. 23A and as disclosed in U.S. Pat. No. 6,227,761). The sonic tracer or sensor 455 may be adjustably mounted or secured at the ends of the screeding head 411, whereby at one end of the screeding head the sonic sensor 455 is operable to detect the relative elevation or height of a previously screeded surface using the sonic sensor for measuring a surface screeded during an earlier pass of the screeding apparatus) to assist in blending adjacent portions of the uncured concrete surface, while at the opposite end of the screeding head the tracking target 460 is operable to measure the location of the screeding head 411 in three-dimensions including elevation of the screed head 411. The screeding apparatus 410 may then be operable to adjust the elevation actuator 418 at one end of the plow, auger 413, or grade setting device, and thus of the vibrating beam 420, in response to a signal from the sonic tracer or sensor 455, while at the opposite end of the screed head 411, screeding apparatus 410 may be operable to adjust the other elevation actuator 418 at the opposite end of the plow, auger 413, or grade setting device, and thus of the vibrating beam 420, in response to a signal from the three-dimensional tracking target 460 and computer controlled 3-D system.

Figure 24:
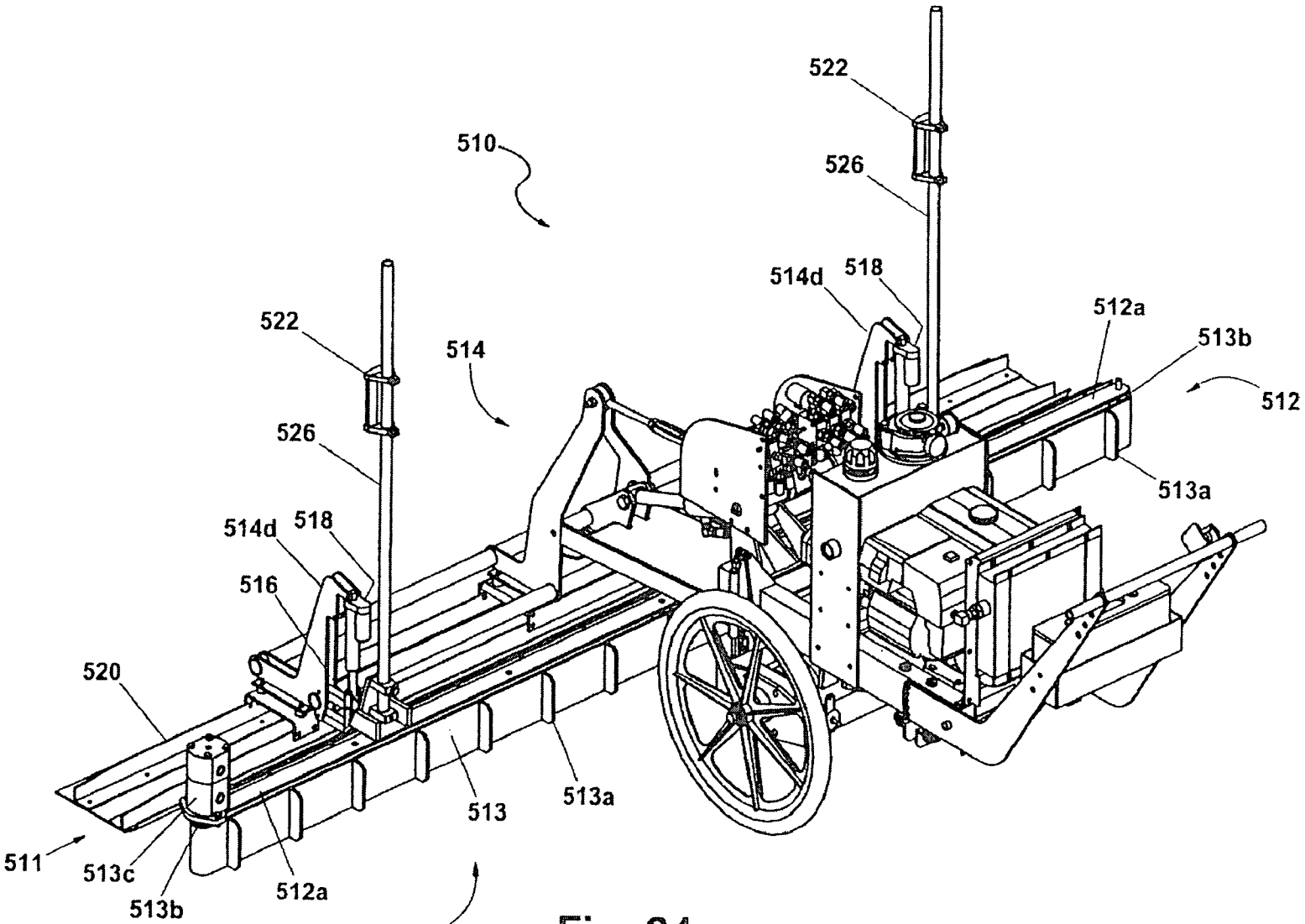
FIG. 24 is an upper, front perspective view of yet another screeding device in accordance with the present invention, with a belt and paddle device adjustably mounted along a forward edge of the vibrating member.

Alternately, and with reference to the screeding device shown in FIG. 24, a screeding device 510 of the present invention may include other grade setting or mechanical devices or which may be operable to accomplish the same or similar task as the auger 413, discussed above. Screeding device 510 may include a screeding head 511 having a vibrating beam or member 520 and a grade setting device 512 attached to a framework 514. Grade setting device 512 includes a continuous flexible belt 513 which is routed around a pair of guides or rollers 513*b* mounted at laterally opposite sides of the screeding device 510. The belt 513 preferably includes a plurality of paddles 513*a* extending outwardly from the belt 513 for engaging and moving the excess uncured concrete as the belt is moved about rollers 513*b*.

In the illustrated embodiment, belt 513 and paddles 513*a* function to cut and establish the grade of the uncured concrete surface as screeding device 510 is moved along and through the uncured concrete. Grade setting device 512 further includes a center support structure 512*a* extending along the grade setting device to support belt 513 and limit deflection of belt 513 as the belt engages the excess uncured concrete.

Belt 513 may be driven in either direction around rollers 513*b* via a rotatable drive or power source 513*c*, which is operable to rotatably drive one of the rollers 513*b* in either direction to move the belt and paddles around rollers 513*b* to move the excess uncured concrete to either side of the screeding device. The power source 511 may comprise a hydraulic motor or any other means for causing rotation of one of the rollers 513*b* to move the belt 513 around both rollers 513*b*.

Screeding device 510 is otherwise substantially similar to screeding devices 310 and 410, discussed above, such that a detailed discussion will not be repeated herein. Screeding device 510 preferably includes a pair of laser receivers 522 mounted to the upper ends of respective rods 526 extending upward from grade setting device 512, similar to laser receivers 22, discussed above. Therefore, the grade of the uncured concrete may be set by belt 513 of grade setting device 512 in response to a laser plane generating system and an established laser plane reference, as discussed above. A pair of actuators 518 and linkages 516 may function to generally vertically adjust the position of grade setting device 512 relative to frame members 514*d* of framework 514 and, thus, relative to vibrating beam 520, in response to the laser plane system, similar to the actuators 12 and linkages 16 of screeding device 10, discussed above.

Optionally, in place of the continuous, flexible belt as shown in FIG. 24, a roller chain riding on and between a pair of sprockets (not shown) may be implemented with the screeding device of the present invention. The chain may further include multiple paddles extending outward from the chain to engage and move the excess uncured concrete.

Figure 25:
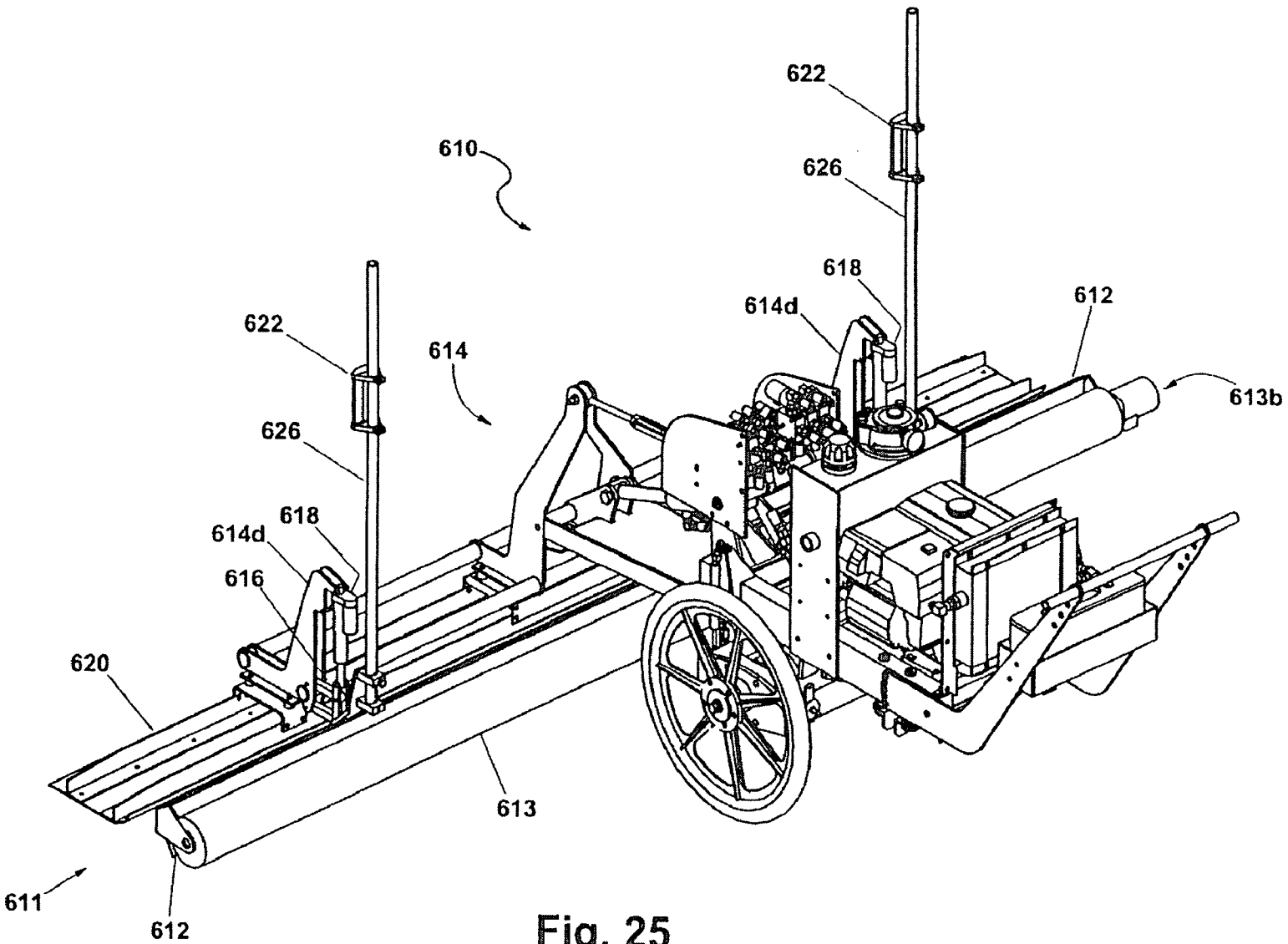
FIG. 25 is an upper, front perspective view of another screeding device in accordance with the present invention, with a spinning tube device adjustably mounted forward of the vibrating member.

Optionally, in place of the continuous, flexible belt as previously shown in FIG. 24 and described above, a wheeled screeding device 610 may include a screed head 611, which includes a vibratory beam or member 620 and a horizontal spinning tube 613 (FIG. 25). The spinning tube 613 has an axis of rotation parallel to the elongated vibrating member 620 and includes a bracket or frame member 612 for mounting the ends of the spinning tube to the frame members 614*d* of framework 614 via linkages 616. The working surface of the spinning tube 613 may be either smooth or contoured to include small working edges or paddles (not shown) to aid in striking-off and moving excess concrete in the direction of travel of the screeding device 610. The spinning tube 613 may be spun or rotated via an hydraulic motor 613*b* mounted at one end of spinning tube 613. The elevation of the spinning tube 613 may be adjusted relative to the framework 614 of screed head 611 via linkages 616 and actuators 618, in a similar manner as described above. Preferably, the actuators 618 are operable in response to laser receivers 622 mounted to a support or bracket 612 of spinning tube 613 via masts or rods 626.

Other means for engaging and moving excess concrete to a side or ahead of the screeding device may otherwise be implemented on the screeding device on or along the forward edge of the vibrating beam or on or along the forward edge of the plow or the like, without affecting the scope of the present invention.

Figure 26:
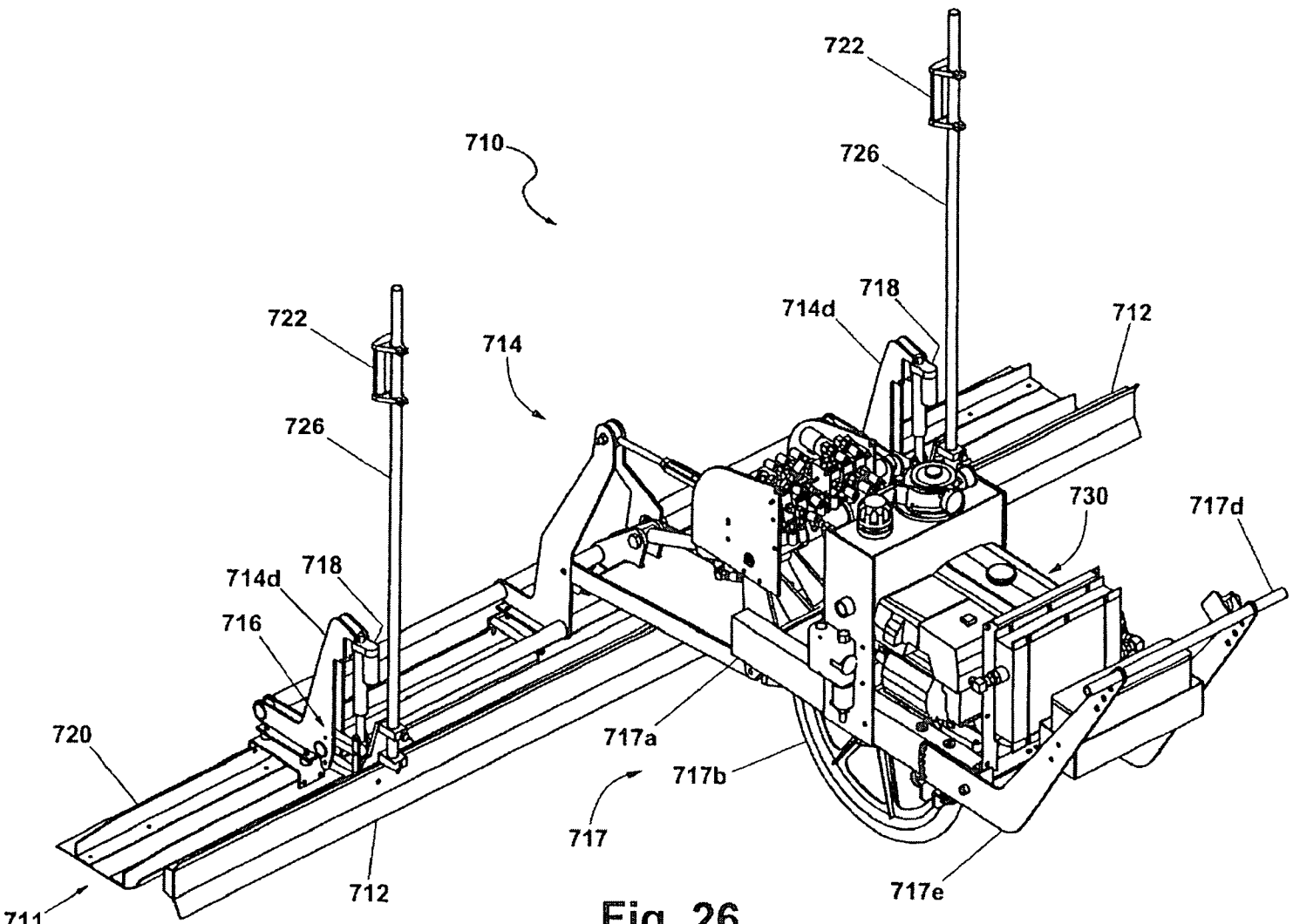
FIG. 26 is an upper, front perspective view of another screeding device in accordance with the present invention, with a single wheeled support.

With reference to FIG. 26, a screeding device 710 includes a wheeled support 717, which includes a single wheel 717*b* for guiding and moving the screeding device over and through the uncured concrete surface. Screeding device 710 further includes a screed head 711 mounted at a rearward end 717*a* of wheeled support 717, such as in a similar fashion as described above with respect to the screed heads 311, 411, 511, 611 of the various screeding devices shown and described herein. Wheeled support 717 also includes a power source 730, which may include an engine, an hydraulic pump, and a reservoir for hydraulic fluid or oil, which is operable to provide pressurized hydraulic fluid or otherwise drive a single drive motor (not shown) to drive the wheel 717*b*. A handle 717*d* is provided at a forward end 717*e* of wheeled support 717 for an operator to guide and/or pull or push the screeding device 710 as it travels over and through the uncured concrete.

Similar to the embodiments discussed above, vibrating beam 720 of screeding device 710 is mounted to a framework 714 and extends laterally outwardly from a pair of frame members 714*d* of framework 714. Grade setting device 712 is adjustably mounted to the framework via linkages 716 and is preferably adjusted via actuation of actuators 718, which, in turn, are preferably actuated in response to laser receivers 722 (mounted on grade setting device 712 via masts or rods 726) receiving a laser reference plane (not shown), as described above.

Screeding device 710 is preferably approximately balanced in a similar fashion to the previously described two-wheel screeding device 310 having a pivot axis 317*j* as shown in FIGS. 17A-20. Stability of the apparatus is made through contact and engagement of the screed head 711 with the uncured concrete surface, with a desired and adjustable proportion of the weight of the device supported by surface contact of the vibrating member 720 with the surface of the uncured concrete. Screeding device 710, screed head 711, vibrating beam 720 and grade setting device 712, which may optionally comprise one or more various devices of the types discussed above, such as a spinning roller (as shown in FIG. 25), a flexible belt and paddles (as shown in FIG. 24), an auger (as shown in FIGS. 23 and 23A), and/or a plow or the like, are otherwise substantially similar to the elements found in the screeding devices 610, 510, 410, 310, discussed above, such that a detailed discussion will not be repeated herein.

Figure 27:
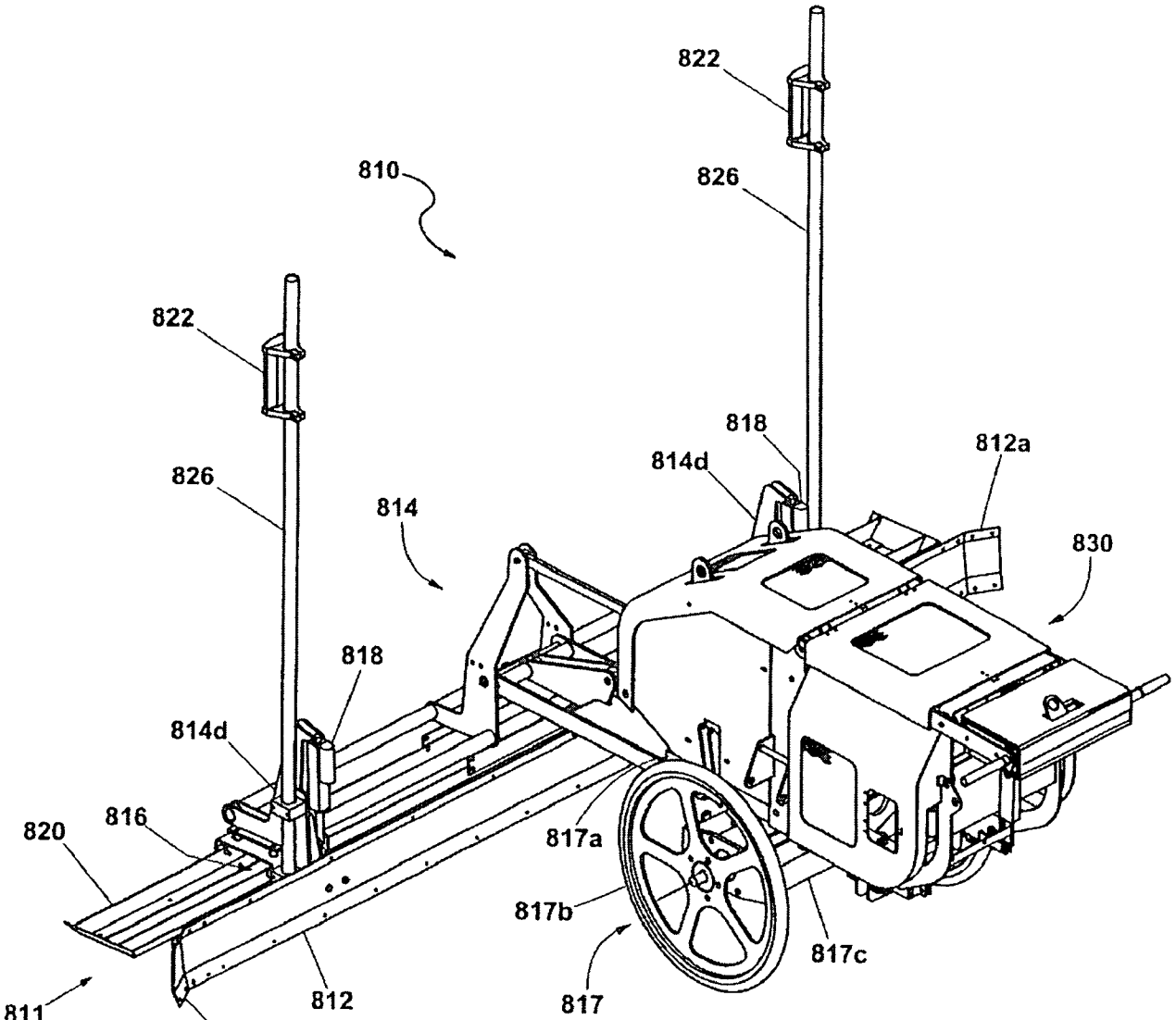
FIG. 27 is an upper, front perspective view of yet another screeding device in accordance with the present invention, with a housing around the components carried on the wheeled support.

Referring now to FIG. 27, another screeding device 810 in accordance with the present invention is shown. Screeding device 810 is configured to be able to exhibit the various functions and elements of the present invention (either separately or in combination) as described herein with respect to the other embodiments, such that a detailed discussion of screeding device 810 will not be repeated herein. Suffice it to say that screeding device 810 includes a screeding head 811 mounted at a rearward end 817*a* of a wheeled support 817. Wheeled support 817 includes a pair of wheels 817*b* rotatably mounted at opposite ends of a laterally extending frame portion 817*c*. Wheeled support 817 at least partially supports the power source (not shown in FIG. 27) and generally contains the power source and other components of the wheeled support within a housing 830 of wheeled support 817.

Screeding head 811 includes a grade setting or indicating device, such as a strike-off plow 812, and a vibratory beam or member 820. Vibratory beam 820 is mounted to framework 814 and extends laterally outwardly in opposite directions from a pair of frame members 814*d* of framework 814. Vibratory beam 820 may be any type of vibratable member and preferably has a generally planar, flat and smooth lower surface for engaging and working the uncured concrete surface.

Plow 812 is attached to framework 814 by two small sets of linkages 816 and is vertically adjustable relative to the framework 814 by a pair of elevation actuators 818. Plow 812 includes angled end portions or wings 812*a* at each end thereof. The angled end portions 812*a* are angled forwardly at the ends of the plow and function to keep the excess concrete at the forward edge of the plow and, thus, to reduce the amount of concrete that may slide off of the ends of the plow during operation and movement of screeding device 810 over and through the uncured concrete. As described above with respect to other screeding devices of the present invention, the elevation of plow 812 relative to framework 814 may be adjustable by actuators 818 in response to input signals from each of a pair of laser receivers 822, which each sense the elevation of a fixed laser plane reference (not shown in FIG. 27) that has been established over the job site by a separate rotating, laser plane generator or projector (also not shown). Each laser receiver 822 is mounted to a support rod or mast 826 which is in turn mounted to the grade setting device or strike-off plow 812.

Similar to the embodiments discussed above, screeding device 810 is at least partially supported on an uncured concrete surface and moved along and over the concrete surface to screed and smooth the surface via vibration of the vibrator beam 820 as the vibrator beam 820 floats on or is at least partially supported on the uncured surface. The plow 812 is adjustable with respect to the vibrator beam 820 to adjust a level or grade of the uncured concrete to a desired grade as screeding device 810 is moved along and over the uncured concrete. The other details of screeding device 810 may be substantially similar to various aspects of screeding device 10, 110, 210, 310, 410, 510, 610 and/or 710, discussed above, such that a detailed discussion of those aspects will not be repeated herein.

With reference to FIG. 28, a hydraulic diagram or schematic 997 is shown which is generally representative of an hydraulic system for the screeding devices shown and described herein and particularly for the embodiment shown in FIG. 27. With the screeding device in operation, hydraulic oil or fluid is drawn up from a reservoir 996 through a strainer 970*a* by pumps 970*b* and 975*a* as they are mechanically driven by a power unit or source 930. Pressurized hydraulic fluid is thus made available for the functioning of a wheel drive or propulsion hydraulic circuit 970. Fluid passes through a variable flow control 970*c* and a pressure-compensated flow control valve 970*e* while any excess pressure, and thus fluid, may be diverted back to reservoir 996 by a relief valve 970*d*. Hydraulic fluid passing through a selector valve 970*f* may be controlled through actuation of the selector valve 970*f* to select forward or reverse travel direction of the screeding apparatus 810 (FIG. 27) by changing the respective directions of rotation of wheel drive motors 917*f*. A pair of counter balance valves 970*g* and 970*h* serve to control the flow of hydraulic fluid under variable load conditions such as encountered by inclines, working loads, or the like. A variable flow control valve 970*i*, a flow divider-combiner valve 970*j*, and a selector control valve 970*k* serve to control the flow into and out of the wheel drive motors 917*f*, such that differential or non-differential drive action of the wheels 817*b* (FIG. 27) may be selected via actuation of the selector valve 970*k* as desired by the operator to enhance either turning of the apparatus 810 or driving effort made by the wheels 817*b* under operating load. Thus, in this example, control of selector valve 970*k* provides a "differential lock" control of propulsion hydraulic circuit 970.

With the screeding device in operation, hydraulic oil or fluid is drawn up from reservoir 996 through strainer 970*a* by pumps 970*b* and 975*a* as they are mechanically driven by power unit 930. Pressurized hydraulic fluid is thus made available for the functioning of an auger or belt hydraulic circuit 975. Hydraulic circuit 975 is optionally included in this example to drive an hydraulic motor 913*c* which in turn drives an auger (such as auger 413 shown in FIG. 23A) or, as a further option, a belt (such as belt 513 shown in FIG. 24) or the like. Pressurized hydraulic fluid flows from pump 975*a* through a pressure-compensated flow control valve 975*b* and through a selector valve 975*c* to a motor 913*c*. Selector valve 975*c* may be actuated by the operator to drive the motor of the auger or belt in a forward or reverse direction, and also provides a stopped function. Any excess hydraulic pressure and fluid may also be diverted back to reservoir 996.

A portion of the excess hydraulic pressure and flow is automatically diverted to a vibrator motor hydraulic circuit 980. Also, any excess hydraulic pressure and fluid may be diverted by a relief valve 980*a* back to reservoir 996. Pressurized hydraulic fluid flows from pressure-compensated flow control valve 975*b* and/or selector valve 975*c* through a pressure-compensated flow control valve 980*b* and through a selector valve 980*c* to a vibrator motor 931*a*, and then returns to reservoir 996. Selector valve 980*c* may be actuated by the operator to turn the vibrator motor 931*a* on or off. A check valve 980*d* serves to preclude possible damage to vibrator motor 931*a* where fluid supply from selector valve 980*c* is suddenly interrupted and inertial forces within the vibrator motor 931*a* and rotating mechanical elements must be dissipated. Check valve 980*d* allows hydraulic fluid to flow freely to vibrator motor 931*a* momentarily until vibrator motor 931*a* comes to a stop. Thus, in this example, hydraulic circuit 980 and the related components as described above provide vibration to a screed head, such as screed head 811 of apparatus 810 (FIG. 27).

Figure 19:
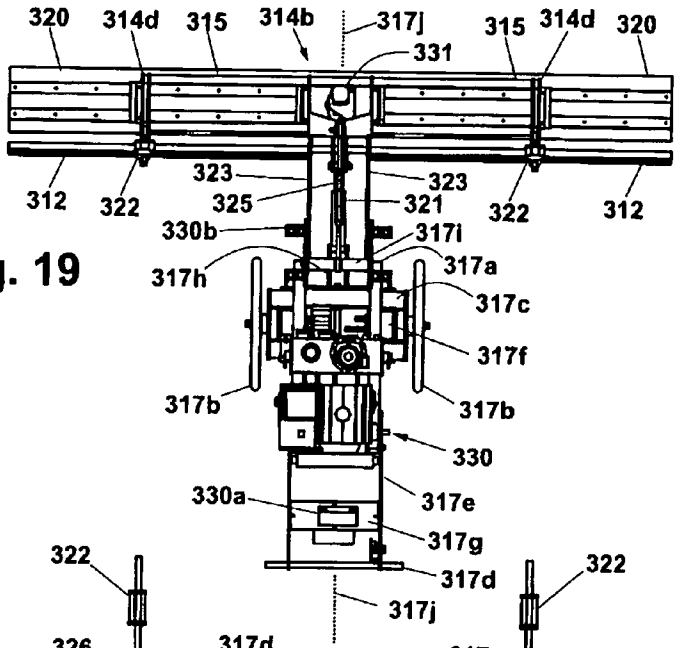
FIG. 19 is a top plan view of the screeding device of FIGS. 16-18.
Figure 20:
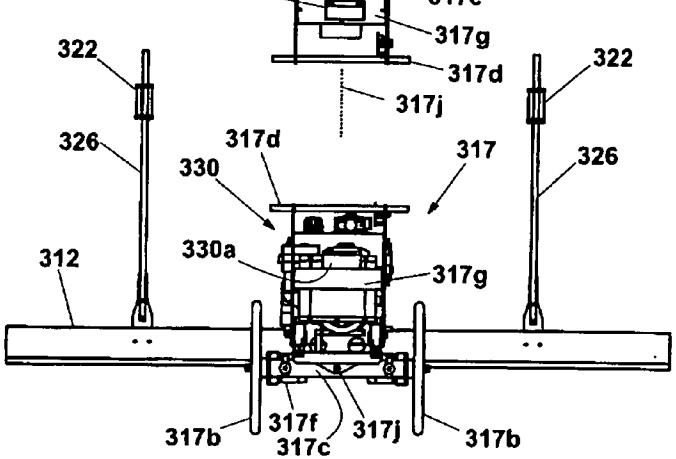
FIG. 20 is a front end elevation of the screeding device of FIGS. 16-19.

For actuation of the lift cylinder 921, pressurized hydraulic fluid flows from pressure-compensated flow control valve 980*b* and/or selector valve 980*c* to supply a hydraulic cylinder circuit 985. Pressurized hydraulic fluid passes through a pressure-compensated flow control valve 985*b*, a selector valve 985*c*, and a relief valve 985*d* to operate lift cylinder 921. Selector valve 985*c* may be actuated by the operator to extend and retract hydraulic lift cylinder 921 (such as lift cylinder 321 as shown in FIGS. 18-20) to either raise or lower the screeding head (such as screeding head 311) as desired. Relief valve 985*d* limits the maximum pressure and therefore the maximum force available to the rod-end of lift cylinder 921. Excess pressure and hydraulic fluid from hydraulic circuit 985 may be diverted back to reservoir 996 by pressure-compensated flow control valve 985*b* as well as selector valve 985*c*. Thus, in this example, hydraulic circuit 985 and the related components as described provide a raise and lower or screed head lift function for the screeding apparatus of the present invention.

Residual hydraulic fluid pressure and flow from hydraulic circuits 975, 980, 985 serves to enable the function of the oscillation lock hydraulic circuit 990. Hydraulic fluid passes through a selector valve 990*a*, check valves with orifices 990*b* and 990*c*, and into a pair of oscillation lock cylinders 935. Whereas oscillation lock cylinders 935 (and cylinders 435 in FIG. 23) serve to control the pivoting or side to side roll action of a wheeled support, such as described previously with respect to wheeled support 317, about a pivot axis (such as pivot axis 317*j*), the operator may actuate selector valve 990*a* to respectively stop fluid flow between oscillation cylinders 935 or may allow a controlled fluid flow between oscillation cylinders 935 through check valves with orifices 990*b* and 990*c*. Thus, in this example, hydraulic circuit 990 and the related components as described provide a useful oscillation lock function for the screeding apparatus of the present invention.

The majority of hydraulic fluid returning to reservoir 996 from the above described hydraulic circuits may pass through a cooler 995 and a filter-diffuser 995*b*, as shown in hydraulic circuit 997 of FIG. 28. A cooler by-pass valve 995*a* may optionally be included in this example to provide an alternate path for hydraulic fluid to pass around the cooler 995, as may be necessary in the event of cold ambient working temperatures.

It may be understood that actuation of the above described selector valves may be accomplished and implemented through various means or options, such as, but not limited to, manual input or control by the operator, mechanical control through a machine linkage or like elements, electrical control by an electro-mechanical actuator, hydraulic control, or otherwise electronically controlled, without affecting the scope of this invention.

Although the screeding devices of the present invention are shown as having a vibrating beam or member for working or smoothing, compacting and/or consolidating the uncured concrete surface, other forms of concrete surface working devices or members or elements may be implemented, without affecting the scope of the present invention. For example, and with reference to FIGS. 29A-C, a concrete working or leveling or raking device 1010 may comprise a concrete surface working member or flotation roller 1020 and a grade setting member or plow or rake 1012 adjustably mounted at a forward side of roller 1020. Roller 1020 is supported on the uncured concrete and rolls over the uncured concrete surface in a first direction of travel indicated by arrow A in FIG. 29B, while rake 1012 may be adjusted relative to roller 1020 via an actuator 1018, as discussed below, to adjust the depth of cut of the rake or grade setting device 1012 to keep the flotation roller 1020 at the proper grade. Actuator 1018 may preferably be an electric linear actuator or the like, without affecting the scope of the present invention.

Concrete raking device 1010 includes a framework 1014, which further includes a handle portion 1014*a* extending from a generally central portion of rake 1012 for a user or raker to grasp and pull or guide raking device 1010 over and along the uncured concrete surface. Framework 1014 includes a pivot bar or connecting member 1014*b* which extends generally perpendicular to the direction of travel along and above rake 1012 and is pivotally connected to the opposite ends of rake 1012 creating a horizontal pivot axis 1014*h*. A pair of side frame members 1014*c* are rigidly or fixedly mounted at one end to the opposite ends of pivot bar 1014*b* and pivotally mounted at the other end to a central axle 1020*a* of roller 1020. Pivotal movement of pivot bar 1014*b* thus causes arcuate movement of roller 1020 relative to pivot bar 1014*b*, while roller 1020 may rotate or roll about its axis 1020*a*. Such arcuate movement of roller 1020 via pivotal movement of pivot bar 1014*b* results in a vertical adjustment of roller 1020 relative to rake 1012, as discussed below.

Figure 29A:
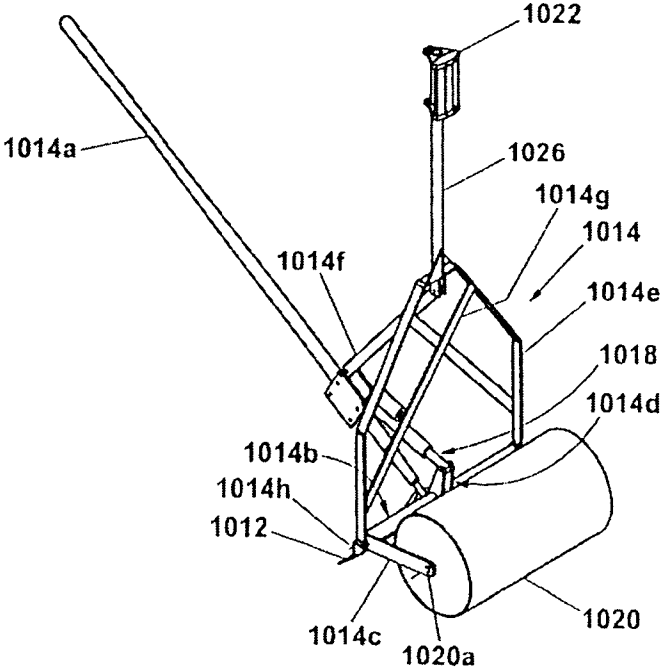
FIG. 29A is a perspective view of another concrete working device in accordance with the present invention.

Pivot bar 1014*b* includes an actuator mounting bracket or lever 1014*d* extending upwardly from the central portion of pivot bar 1014*b* for pivotally mounting one end of actuator 1018 thereto. The other end of actuator 1018 is mounted to handle portion 1014, as best shown in FIGS. 29A and 29B. Actuation or extension/retraction of actuator 1018 causes pivotal movement or rotation of pivot bar 1014*b* via lever arm 1014*d*. Because pivot bar 1014*b* is pivotally mounted to rake 1012 and fixedly mounted to side frame members 1014*c*, pivotal movement of bar 1014*b* causes raising or lowering of flotation roller 1020 relative to rake 1012, which further causes rake 1012 to establish a lower grade or higher grade, respectively, relative to a fixed reference, such as a laser plane or the like. This allows an operator of raking device 1010 to allow the rake 1012 to rest partially upon the uncured concrete, since the roller 1020 will support the rake at the desired grade while the roller is supported on the concrete surface. The uncured concrete thus serves as an elevation or grade height reference for the screeding or raking device 1010.

Preferably, raking device 1010 includes a laser receiver 1022 mounted on a mast or rod 1026 extending upward from a pair of frame members 1014*e* extending from the ends of rake 1012 and a third frame member 1014*f* extending upward from handle portion 1014*a*. A fourth frame member 1014*g* may be added as shown in FIG. 29A to enhance the rigidity and stability of frame members 1014*e* and thus of mast 1026. Actuator 1018 is operable to automatically raise and lower roller 1020 relative to rake 1012 in response to a signal from laser receiver 1022 via an electronic controller (not shown).

Therefore, raking device 1010 provides an automatic control system using a laser receiver and a flotation roller that partially supports the raking device 1010 on an uncured concrete surface which also serves as an elevation reference. During operation, as the raking device is manually drawn towards the user or raker via pulling on handle portion 1014*a* in the direction indicated by arrow A in FIG. 29B, laser receiver 1022 monitors the elevation of the cutting edge of rake 1012 and adjusts actuator 1018 and thus the level of flotation roller 1020 to keep the cutting edge at the desired grade. If the grade of the placed concrete is too high (such as one or two inches (25 mm to 50 mm) above the desired grade), the laser receiver will cause the roller 1020 to raise to a corresponding height above the raking edge 1012, thus automatically lowering the grade setting member 1012 a desired amount. Additionally, a maximum height correction of the roller may be adjusted to control the maximum depth of cut per stroke that the rake 1012 may engage the concrete as it travels in direction A so as to maintain the raking device within the physical effort capabilities of the raker. In areas where excess material is present, each successive stroke may additionally remove more excess concrete from a given location until the desired grade height has been reached. When the draw stroke is completed in direction A, the raker need only push the raking device back outward over the uncured concrete in the opposite direction without lifting the raking device for another stroke, since as soon as the raking device is pushed by the raker, a rotation sensor or direction switch (not shown) attached to the flotation roller may serve to automatically lower the flotation roller 1020 and raise the grade setting device 1012, so that the raking device will roll easily over the concrete surface opposite the direction indicated by arrow A.

Figure 29C:
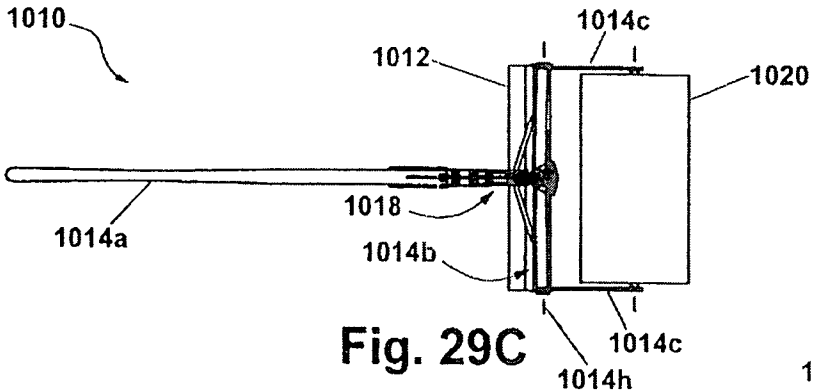
FIG. 29C is a top plan view of the concrete working device of FIGS. 29A and 29B.
Figure 29B:
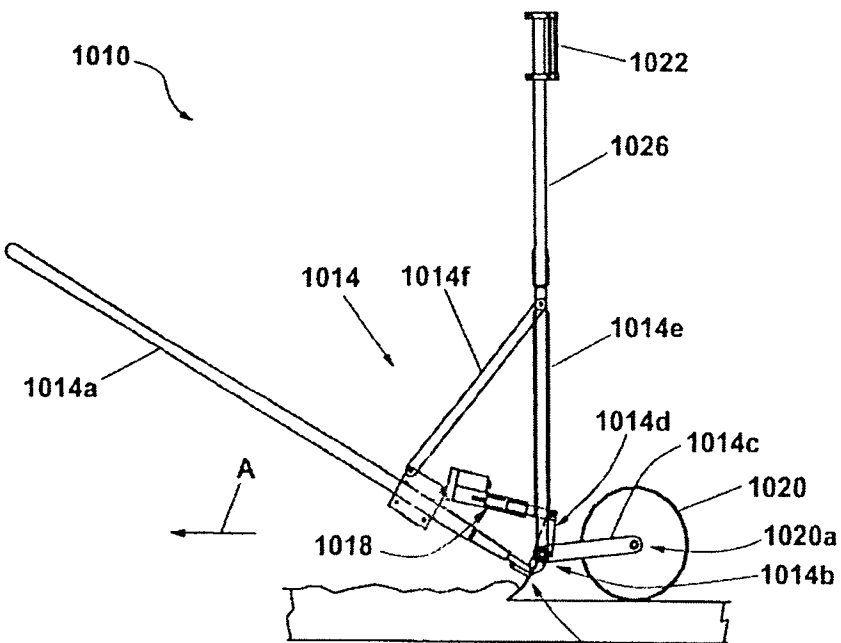
FIG. 29B is a side elevation of the concrete working device of FIG. 29A.
Figure 30C:
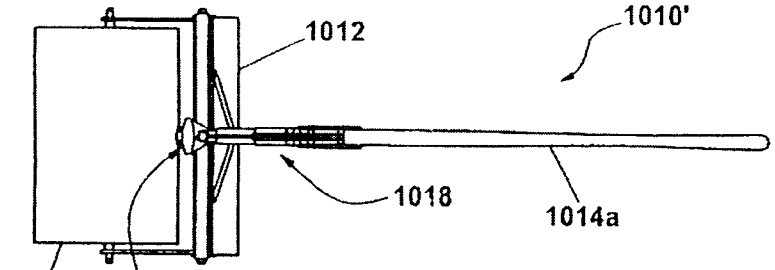
FIGS. 30A-C are views and elevations similar to FIGS. 29A-C of another concrete working device in accordance with the present invention.
Figure 30B:
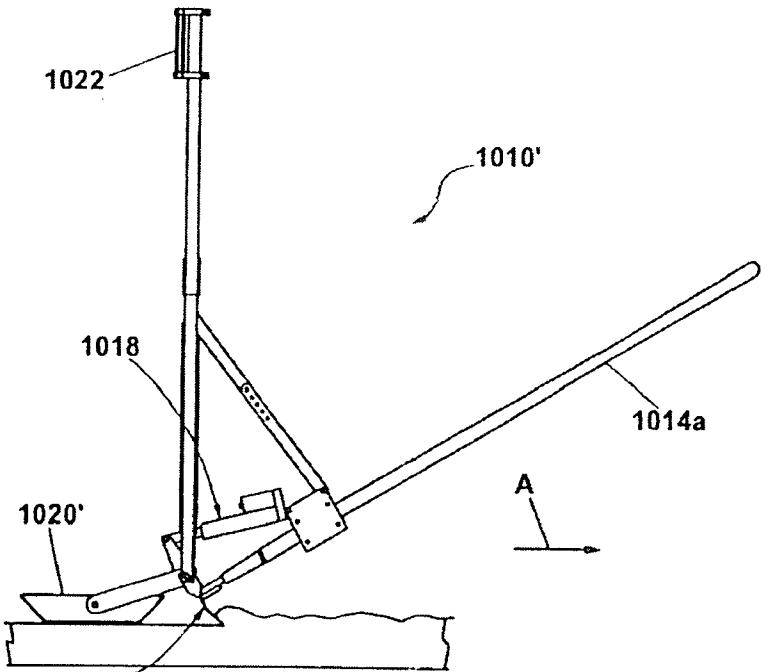
Figure 30A:
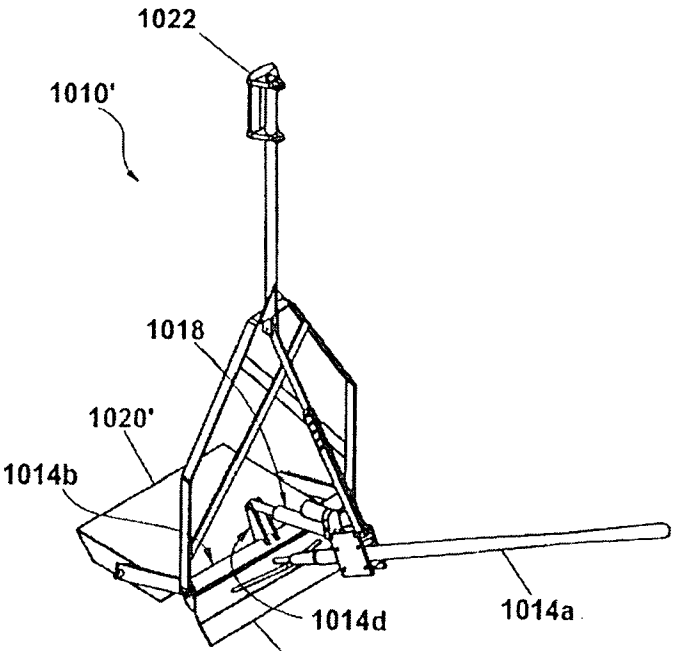
Figure 31A:
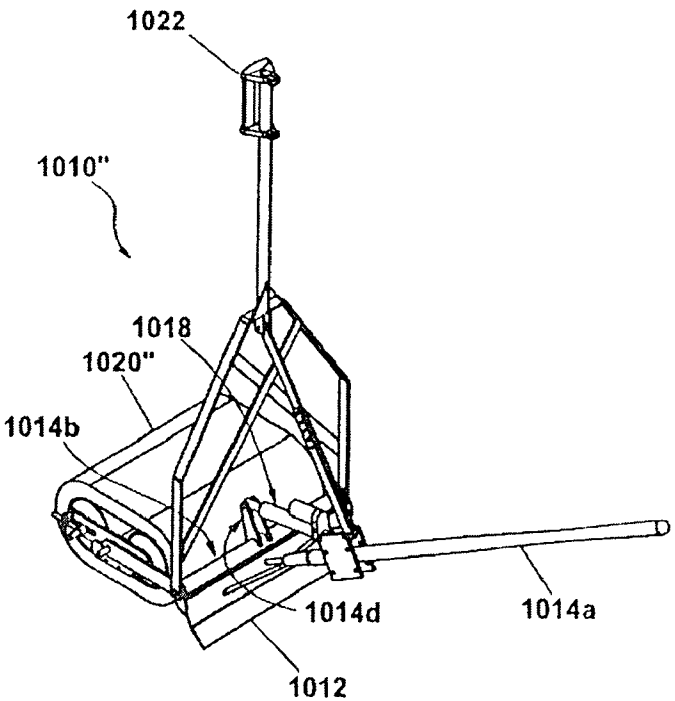
FIGS. 31A-C are views and elevations similar to FIGS. 29A-C of another concrete working device in accordance with the present invention.
Figure 31C:
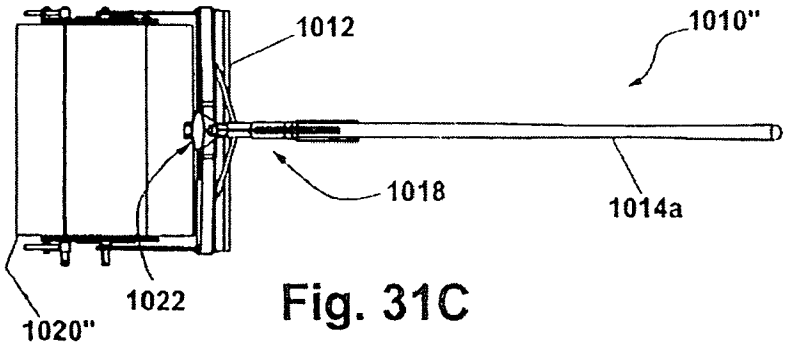
Figure 31B:
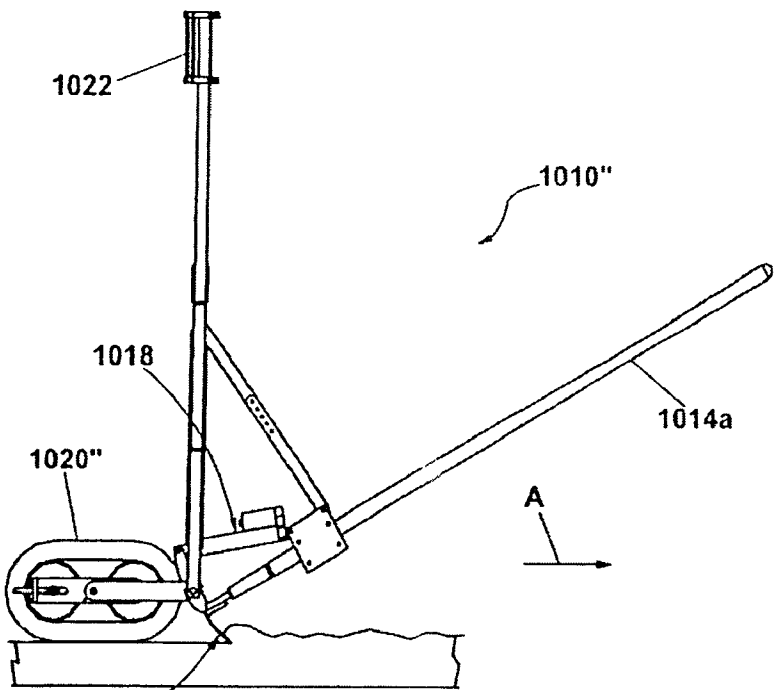

Optionally, the raking device 1010 may include other concrete surface working devices or elements which are substantially equivalent to the function of the flotation roller 1020 in FIGS. 29A-C, without affecting the scope of the present invention. For example, a raking device 1010' may include a floating pan 1020' (FIGS. 30A-C), or a raking device 1010" may include a floating track 1020" (FIGS. 31A-C). The floating pan 1020' of raking device 1010' may be dragged along and over the uncured concrete surface via a worker pulling at the handle 1014*a* in the direction A (FIG. 30B), while the rake or grade setting member 1012 is adjusted relative to pan 1020' to set or establish the desired grade. Similarly, with respect to raking device 1010", a worker may pull (in the direction A shown in FIG. 31B) the raking device over the concrete surface (with both rollers of the floating roller track 1020" being generally freely rotating as the roller track is pulled or moved over the concrete surface), while the rake or grade setting member 1012 is adjusted relative to floating track 1020" to set or establish the desired grade. Alternately, one of the rollers of the floating track 1020" may be driven via a drive motor (not shown) to assist the operator in moving the raking device 1010" over the uncured concrete surface, without affecting the scope of the present invention. The raking devices 1010' and 1010" are otherwise substantially similar to the raking device 1010 discussed above, and are shown in FIGS. 30A-C and 31A-C with the same reference numbers for the other components, such that a detailed discussion of the raking devices and components will not be repeated herein.

Optionally, the raking device 1010 may include other concrete surface working devices, such as a vibrating beam or member or a powered roller or the like (optionally, a powered roller may be rotated in a direction opposite of travel to finish the concrete surface), without affecting the scope of the present invention. It is further envisioned that an auger may be provided in front of the rake, to further cut and establish the desired grade of the concrete surface, without affecting the scope of the present invention.

The raking device of the present invention thus provides for reduced operator effort to rake placed concrete to a desired grade. The grade may then be set in response to a laser receiver and laser plane technology, so that the need to estimate the grade by visual inspection or looking at adjacent forms may be obviated. The raking device of the present invention provides for an initial grade setting process, whereby initially raking the placed concrete closer to the desired grade may reduce the efforts and improve the accuracy of subsequent concrete working processes.

Figure 32:
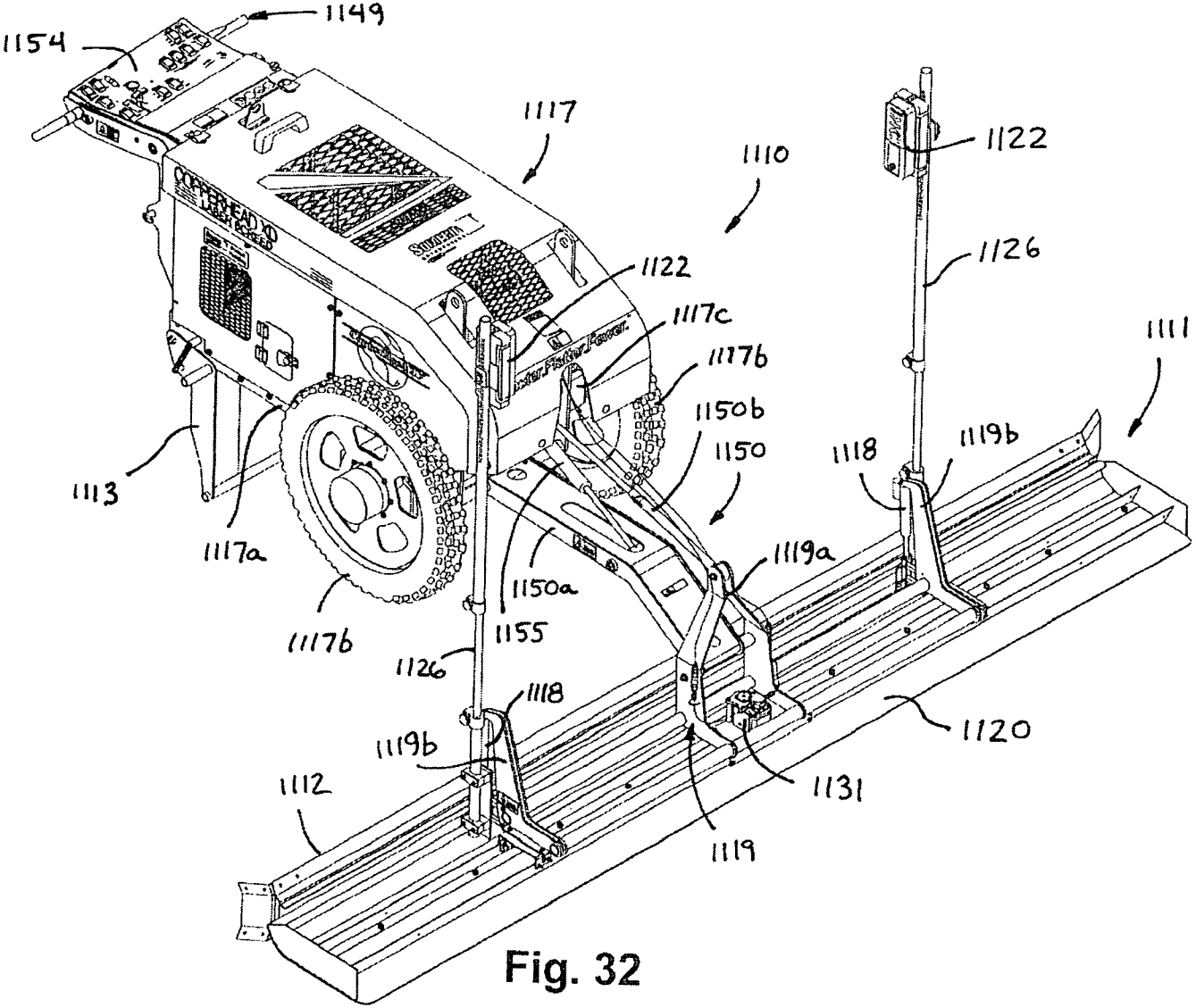
FIG. 32 is a perspective view of another concrete working device in accordance with the present invention.

Referring now to FIG. 32, a screeding device or concrete working apparatus 1110 includes a screeding head 111, which includes a grade setting member or strike-off plow 1112 and a vibrating beam 1120, attached to a framework 1119. Framework 1119 is adjustably mounted to a wheeled support 1117 and is adjustable or movable, such as via a head lift assembly or mechanism 1150, to adjust a position or orientation of screeding head 1111 relative to wheeled support 1117. The wheeled support 1117 includes a pair of powered drive wheels 1117*b* and is movable or drivable over and/or through the uncured concrete by an operator grasping handlebars 1149 at the rear of the wheeled support 1117 opposite from the screed head 1111. Screeding device 1110 may be substantially similar to the screeding device or devices discussed above, such that a detailed discussion of the similar components and/or features will not be repeated herein.

The screeding device may be powered by any power source, such as an internal combustion engine or the like, such as a 13 HP Robin gasoline engine source (although other power means may be implemented without affecting the scope of the present invention). The power source may rotationally drive the wheels and tires 117*b* of the screeding device. The tires may comprise 28-inch diameter×3½ inch knobby-tread tires. Such tires are commonly used as a front tire on off-road motorcycles having a 21-inch wheel rim diameter. Optionally, the screeding device may have 25 inch or 28 inch diameter ATV knobby-tread tires. Such ATV tires are 8½ inch wide and offer additional support to the machine via lower ground contact pressures and improved traction when working on sandy or otherwise soft subgrades. By using low air inflation pressures, these tires provide improved absorption of obstacles such as rebar and Nelson studs commonly used in elevated deck concrete construction.

Figure 35:
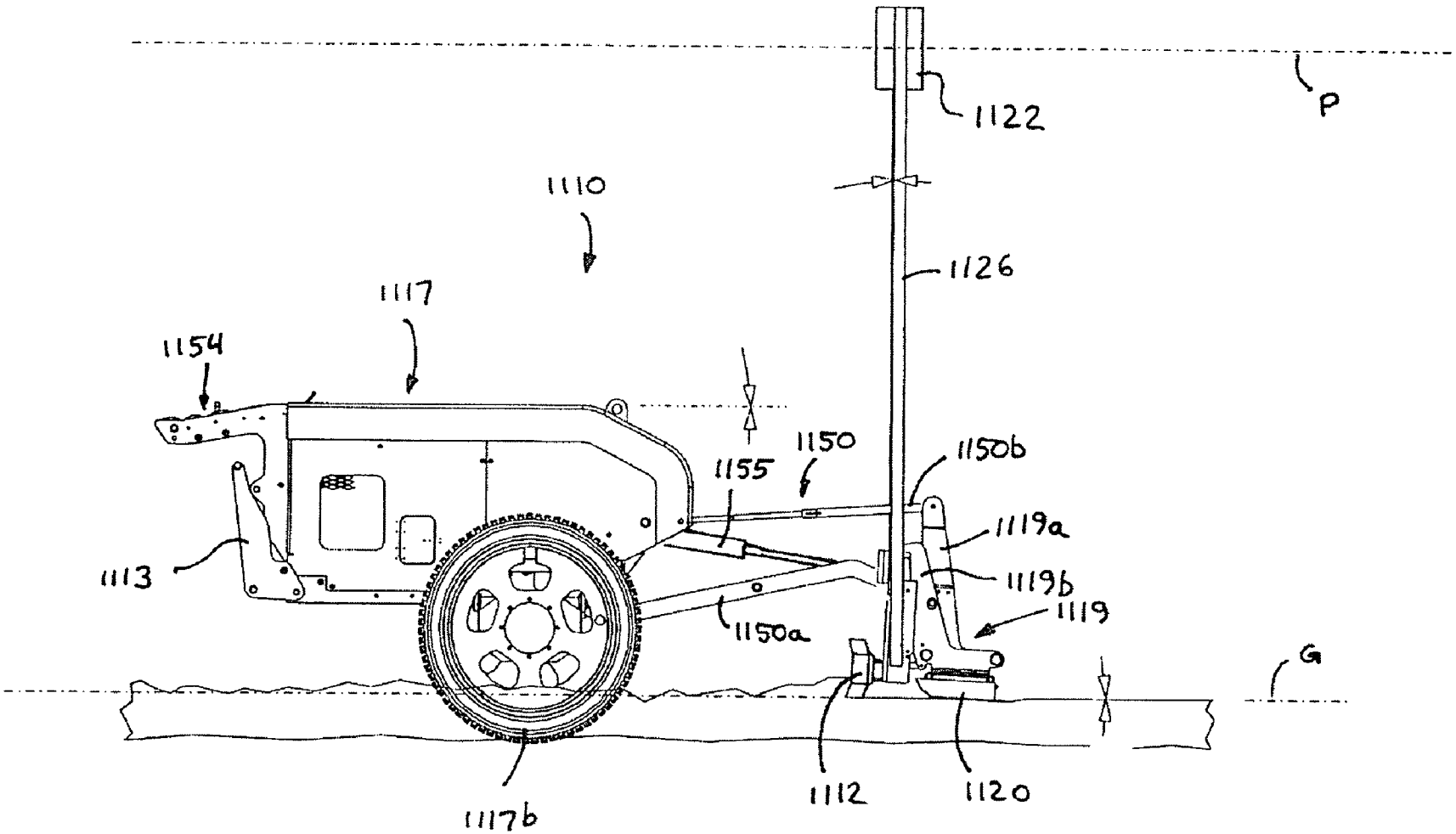
FIG. 35 is a side elevation of the concrete working device of FIG. 32, shown during normal operation of the device.

Screeding device 1110 may also include a kickstand or adjustable support 1113 at the rearward end of the wheeled support 1117 to provide support of the rearward end of the wheeled support when the screeding device is not in use. As can be seen with reference to FIGS. 32 and 35, the kickstand 1113 may be movable or adjustable between a lowered position (as shown in FIG. 32) and a raised position (as shown in FIG. 35), whereby the screeding device may be moved and operated as discussed below. The kickstand is helpful to limit or substantially preclude tipping of the machine backward when it is parked or not in use. Such tipping may otherwise occur if the rear portion or handlebar 1149 of the screeding device is pushed downward, due to the balance of the machine about the wheels.

The screed head 1111 may be an eight foot or ten foot wide screed head or any other width as may be desired depending on the particular application of the screeding device. Optionally, the screed head may comprise an interchangeable quick-attach 8-foot or 10-foot wide screed head. The desired screed head may then be readily connected or attached to the wheeled support for a particular application, and may be changed to a different width screed head for a different application. Similar to the screed heads discussed above, the plow 1112 of screed head 1111 may be adjustable relative to the vibrating member or beam 1120 via a pair of actuators 1118 that are operable to raise and lower plow 1112 relative to vibrating beam 1120 to establish the desired grade of the uncured concrete surface as the screeding device 1110 moves over and through the uncured concrete. The actuators 1118 may be operable in response to a pair of laser receivers 1122, as discussed above.

When screeding, the screeding device is generally supported upon a surface by only three points or support areas or regions. Two of these support areas are created by contact of the drive wheels (tires) with the uncured concrete and/or subgrade, and the other support area is created by contact of the screed head with the surface of the concrete. The screeding device 1110 includes a head lift assembly or system 1150 that is selectively adjustable to raise or lift the screed head relative to the wheeled support to adjust the level or height of the screed head relative to the wheeled support and optionally to raise the screed head above the uncured concrete, such that the screeding device may be supported only by the two wheels or tires of the wheeled support. The head lift assembly 1150 may be selectively adjusted by an operator by setting or adjusting a head lift function of the screeding device 1110.

When not screeding concrete, the head lift function may be used by the operator to either raise or lower the screed head relative to the wheels. For example, an electric rocker switch 1152 at a control panel 1154 (FIG. 33) may actuate a hydraulic cylinder 1155 at the head lift or lift arm assembly 1150 to either raise or lower the entire screed head 1111 relative to the wheeled support 1117 and the wheels 1117*b*. This allows the operator to raise the screed head to clear the ground and other obstacles when simply moving the machine around. During this process, the machine is balanced and driven by the operator on only its two wheels.

The screed head 1111 is adjustably mounted at the end of the wheeled support via a lift arm assembly 1150. In the illustrated embodiment, the lift arm assembly 1150 includes a lift arm 1150*a* and an upper arm or tie rod 1150*b* that is kinematically generally parallel with respect to the lift arm 1150*a*. Lift arm 1150*a* and tie rod 1150*b* are pivotally mounted at frame of wheeled support 1117 and at a mounting link or upper support portion 1119*a*, which extends upward from the support frame or framework 1119 of the screed head 1111 and thus upward from vibrating beam 1120, so that vibrating beam 1120 is adjustably mounted to wheeled support 1117. The frame of the wheeled support 1117 and the upper support portion 1119*a* of the screed head 11111 represent the third and fourth links respectively. Thus, a four-bar mechanical linkage is created between the screed head and the wheeled support.

When the screed head is either raised or lowered relative to the wheeled support, such as via retraction or extension of an actuator 1155, the vertical axis of the frame of the machine and the vertical axis of the screed head thus may remain generally parallel. Likewise, the horizontal axes of the frame and screed head will also remain generally parallel. Therefore, the pitch angle of the machine's frame, will at any given moment, be approximately equivalent to the pitch or "attack angle" of the machine's screed head. Optionally, a three degree angle of attack with respect to horizontal may be provided to the vibrating member by design. However, other angles of attack may be provided or the angle of attack may be adjustable by the operator to set the desired angle of attack for the particular application of the machine, without affecting the scope of the present invention. For example, the angle of attack may be adjusted by adjusting the length of the tie rod 1150*b*.

When screeding concrete flatwork, the pitch or the attack angle of the machine is important for at least two reasons. If the pitch angle of the machine is not correct, then the "angle of attack" of the screed head will be wrong, or less than ideal, as it engages the uncured concrete. The relative height position of the strike-off plow to the vibrating member, as well as the angle of the vibrating member relative to the desired concrete surface should be substantially maintained for proper screeding. If the angle of attack is too high, the vibrating member angle may be too steep, tending to take or carry too much cream away from the surface of the concrete. Likewise, if the angle of attack is low, the vibrating member angle may be too shallow, tending to not seal the surface of the concrete under the action of the vibrating member.

Also, it is important to keep the laser receivers 1122 and their supporting masts 1126 in the near vertical position relative to the concrete surface being screeded. If the machine comes out of level while screeding, the masts will tend to tilt forward or back at a slight angle. This effectively shortens the masts with respect to true vertical and lowers the laser receivers with respect to the desired grade. With the laser receivers slightly lower than normal, the laser beam will strike the laser receivers towards the top of the sensor windows of the laser receivers. At this point, the laser control system determines that the screed head is slightly low with respect to the desired grade. The system responds by signaling the linear actuators on the screed head plow to retract, and thus, raises the screed head plow, and raises the grade elevation, just enough to get the laser beam to again strike the center of the laser receiver's sensor window. The result of this induced correction is that the concrete will actually be screeded slightly higher than intended. This kind of screeding error can be avoided when the laser receivers and masts are maintained as close to vertical as possible at all times while screeding.

Optionally, and desirably, the screeding machine includes a bubble level or indicator 1156 mounted on or at or near the operator's console or control panel 1154. The bubble indicator is calibrated and fixed to the console of the machine to indicate the fore-aft pitch angle, or levelness, of the machine along the direction of machine travel. The axis of rotation is generally parallel to the axis of rotation of the wheels. Accordingly, the bubble indicator can also indicate if the screed head of the machine is at the wrong pitch angle for screeding.

Regardless of the desired slab thickness or variations in the subgrade, as long as the screed head lift function is adjustably activated by the operator to raise or lower the screed head relative to the wheeled support, in order to maintain the bubble level indicator substantially at level or within a desired range of level (or at a desired angle or slope), the proper pitch angle for the machine and the screed head may be substantially maintained. The vertical orientation or positions of the laser receivers and masts are thus also correctly maintained for best accuracy.

Periodically, during the screeding of concrete, the bubble indicator may be checked by the operator to make certain that the bubble indicator is within the level indication marks. If the bubble indicator indicates that the machine is not within the desired or appropriate level range, adjustments may be made accordingly by the operator via the head lift electrical rocker switch 1152 on control console. Likewise, at the beginning of a screeding pass, whenever the screed head is lowered to the desired grade, the bubble level may be checked by the operator to make certain that the bubble is within the level indication marks. If not, adjustments may be made accordingly via the head lift electrical rocker switch 1152 on control console. In either case, such an operating procedure ensures that the machine and the screed head remains substantially at or near the correct angle of attack as the conditions or profile of the subgrade may vary.

Figure 34:
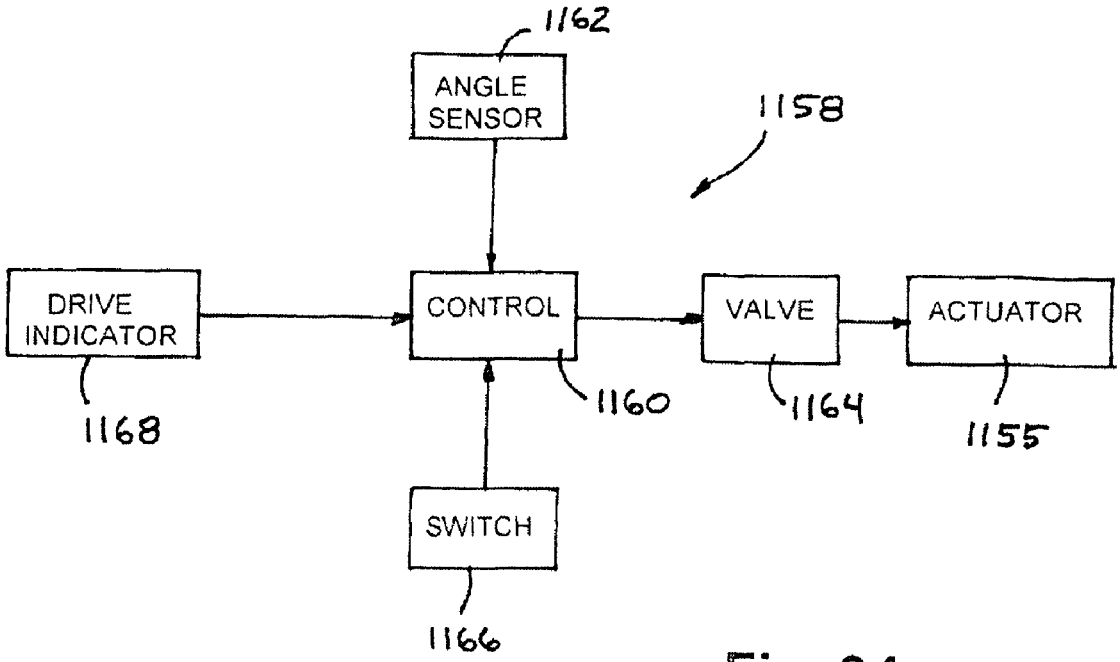
FIG. 34 is a schematic of an automatic leveling system of the present invention that is useful with the concrete working device.

Optionally, and desirably, the screeding machine or device 1110 may include an automatic leveling system 1158 (FIG. 34) to automatically adjust the lift head function to raise or lower the screed head relative to the wheeled support as the screeding device is moved over and along the uncured concrete surface. For example, the automatic level feature or system, when activated, may automatically keep the bubble indicator within the level indication marks. This replaces the need for the operator to monitor and repeatedly adjust the head lift electrical rocker switch while screeding.

Figure 33:
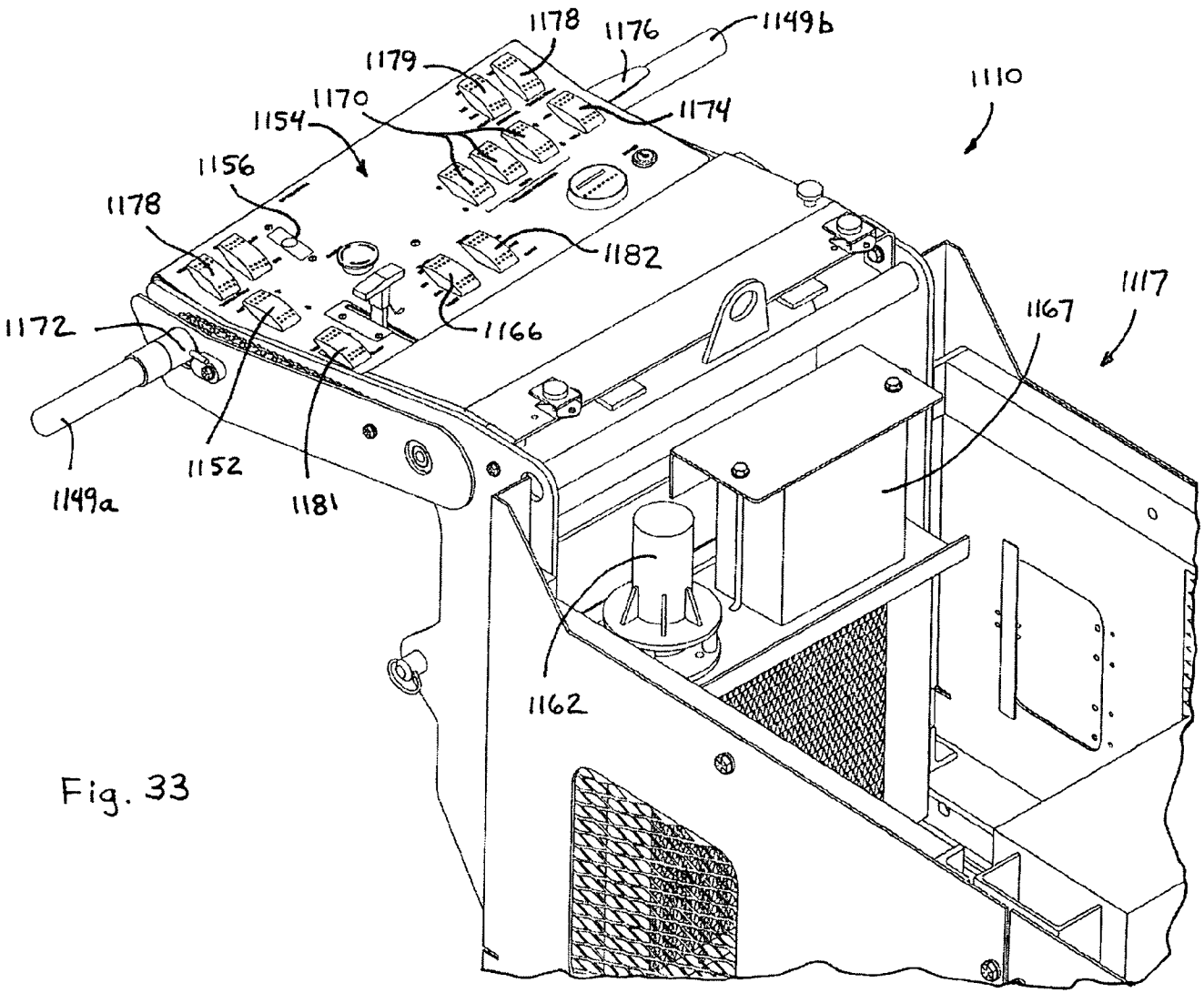
FIG. 33 is a perspective view of a control panel useful with the device of FIG. 32.

In the illustrated embodiment, the automatic level system 1158 consists of a control 1160, a power source, such as a 12-volt electrical power source and a hydraulic power source (included as part of the machine), an electronic angle sensor 1162 (FIGS. 33 and 34), an electro-hydraulic control valve 1164, the lift arm actuator 1155, such as a hydraulic cylinder or the like, one or more operator-controlled switches 1166 at control panel 1154, and a drive indicator 1168 that indicates or generates an output indicative of the direction of movement of the screeding device, as discussed below. As shown in FIG. 33, the electronic angle sensor 1162 may be mounted to the frame of the machine, such as, for example, next to the battery 1167 and just inside the engine compartment. The angle sensor may have an accuracy of plus or minus approximately one degree, and an adjustable time delay of approximately zero to three seconds (although other accuracy and time delay settings may be implemented without affecting the scope of the present invention). The sensing element inside the angle sensor may comprise a gimbal-mounted pendulum that may be inductively coupled to the position-sensing electronics. The pendulum may be damped using a viscous silicone fluid or the like to prevent erratic oscillation of the pendulum from vibration or other instantaneous disturbance forces.

In the illustrated embodiment, the automatic level feature has three modes of operation: "on", "auto", and "off". These may be selectable via an electric rocker switch at the control panel. When the automatic level switch 1166 is at the "on" setting, the machine will continuously adjust the head lift cylinder to keep the machine and the screed head at the proper angle with respect to level. The on mode may enable the machine level system to operate in both forward and reverse (screeding) driving directions. Another benefit of the automatic level system is that, when activated, and when the operator pushes down on the handlebars, such as to move the screeding device to the next pass, the head will automatically lift up, thereby making it easier for the operator to move the screeding device to the next pass without dipping the head into the concrete.

Alternately, when the machine level switch is at the "auto" setting, the machine will continuously adjust the head lift cylinder to keep the machine and the screed head level, but only when the screeding device or machine is operating or moving in the reverse (screeding) driving direction. The driving direction and/or speed of the screeding device may be determined via a signal to the control from the drive indicator 1168, which may comprise a wheel speed sensor or a switch setting for the propulsion and/or steering switches, or any other means for indicating the direction of travel of the screeding device or for otherwise providing such indication to the auto-leveling control 1160. When driving the machine in the forward direction, the machine level function will be automatically deactivated. When the machine level switch is at the "off" setting, the machine will not adjust the head lift cylinder in either the forward or reverse driving directions. Any adjustment of the head lift cylinder when the automatic level system is deactivated may be done by the operator manually actuating the head lift controls.

As described above, two electric linear actuators 1118 adjust the elevation of the grade setting device or plow 1112 of the screed head 1111 of the screeding device of the present invention relative to the vibrating beam 1120. Each of the linear actuators is attached to the ends of the plow 1112 and a respective support or link 1119*b* of the support frame 1119 of the screed head 1111. The actuators may be controlled manually, such as by a set of rocker switches 1170 on the operator's console, or automatically, such as by an electronic control that receives input signals from the laser receivers.

Optionally, the control may include an actuator dynamic brake device, which functions to more accurately control the electric actuators and plow elevation by grounding the linear actuator motor terminals at the end of each adjustment signal. This effectively stops the actuator more quickly and accurately. The residual electrical current and resultant counter electro magnetic field (EMF) in the motor windings is thus more rapidly dissipated, which reduces or substantially precludes any overshoot or slight overrun of the actuator motor when the controller switches off the electrical power by simply opening a set of contacts in the circuit. This feature thus does not require any extra input from the operator of the machine.

Optionally, the screeding device may include a laser receiver edge-seeking system, which may function to improve the accuracy of the laser system. As described above, signals from the laser receivers are directed to the control system to continually adjust the height of the plow of the screed head. The laser receiver edge-seeking system may reduce the effective dead band of the laser receivers by sensing only one edge of the site-generated laser plane beam, such as in a similar manner as described in U.S. Pat. No. 4,978,246, entitled APPARATUS AND METHOD FOR CONTROLLING LASER GUIDED MACHINES, issued to Somero on Dec. 18, 1990, which is hereby incorporated herein by reference. The laser receiver edge-seeking system of the screeding device of the present invention may use an electronic controller to directly adjust the pair of electric actuators to adjust the height of the plow in response to the output signals of the laser receivers.

Ideally, fresh concrete is placed in an area to be screeded generally averaging between about zero to about ½ inch higher than the desired finished elevation. If the accuracy of the concrete placement is poor, both high and low areas are usually apparent in the placed concrete and the average amount of material will be too high or too low. Workers with concrete rakes and shovels are typically needed to fill in the voids and cut down the high spots just ahead of the plow of the machine as it advances. With an excessively high placement of fresh concrete, manual raking in advance of the machine must move the extra material away. When the concrete is too high the excess material will very rapidly build up against the plow, quickly exceeding the screeding capabilities of the machine.

Figure 36:
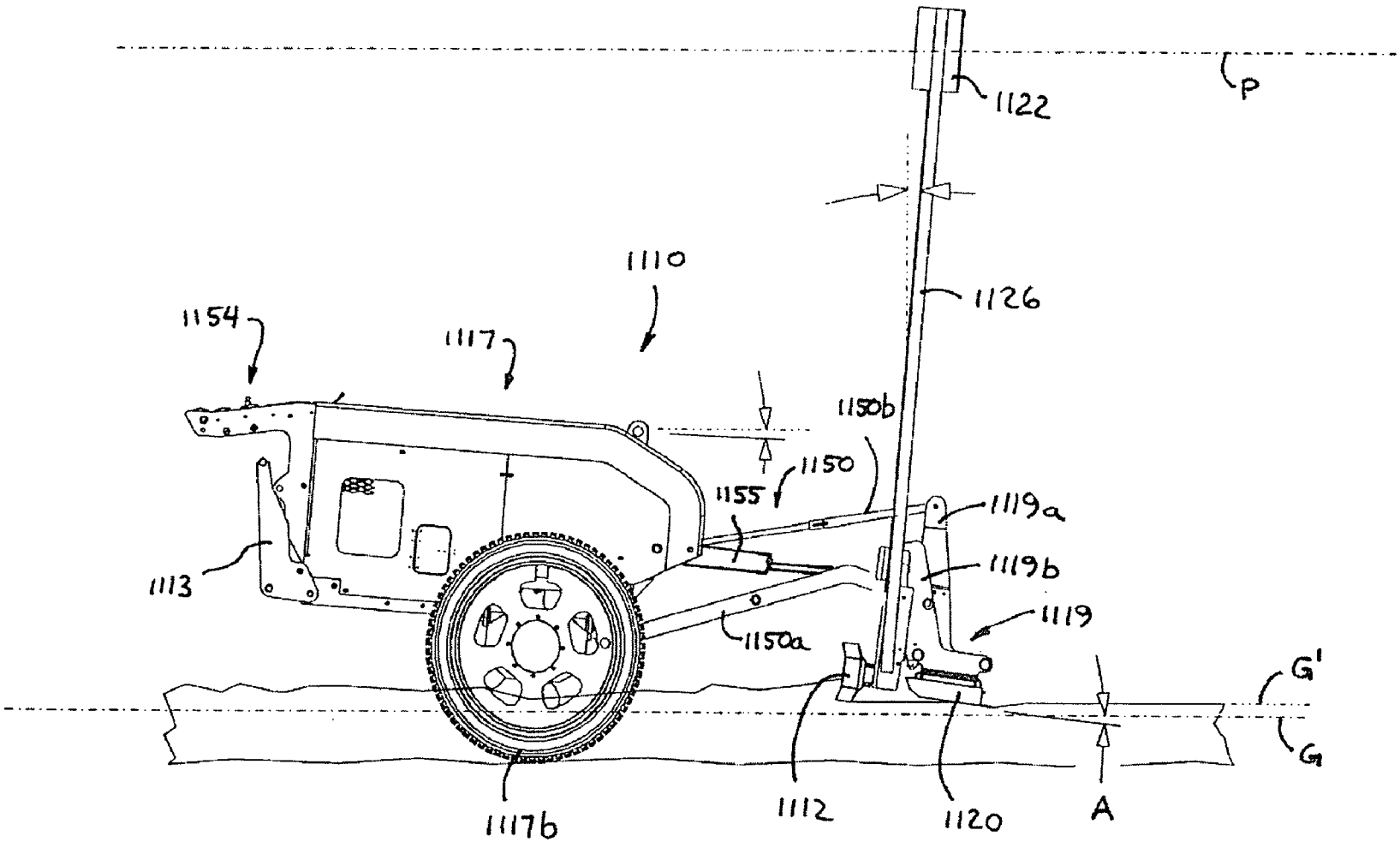
FIG. 36 is a side elevation of the concrete working device of FIG. 32, shown during a quick-pass or pre-screeding pass of the device.

Accordingly, and with reference to FIGS. 35 and 36, the screeding device may be operable in either a normal mode (as shown in FIG. 35) or a quick-pass or pre-screeding mode or method or process (as shown in FIG. 36) that temporarily adjusts and uses the screeding device to quickly remove excess concrete from an area to be screeded. As shown in FIG. 35, the mast 1126 of the laser receiver 1122 is generally vertical when the screeding device 1110 is set for normal screeding operation, with the vibrating member 1120 at the desired attack angle. The laser receiver 1122 is thus positioned at and senses the laser reference plane P, and the actuators 1118 are adjusted to adjust the plow 1112 relative to the vibrating member 1120, such that the vibrating member is at the established and desired grade G.

As shown in FIG. 36, the screed head 1111 may be raised relative to the wheeled support 1117 to raise the vibrating member 1120 above the desired grade G, whereby the screeding device may perform a quick-pass over the uncured concrete. For example, just prior to performing a quick-pass, the operator may use the head lift control function to raise the screed head 1111 substantially, such as raise it as high as it will go, relative to the wheeled support 1117. This is done while the screed head remains resting on the roughly placed concrete. In this configuration, the machine will be out of level. The automatic level function is deactivated and the machine is pitched steeply forward (as shown in FIG. 36) as compared to the normal generally level screeding position (as shown in FIG. 35). The steep forward pitch of the machine results in a significant and advantageous change to the geometry of the machine.

In such an orientation, the laser receivers 1122 and support masts 1126 are inclined away from vertical and in the direction away from the operator. This shortens the effective vertical elevation between the laser receivers and the plow 1112. Generally, for about four inches (about 10 cm) that the receiver masts are pitched forward, the resulting concrete elevation is raised about ⅛ of an inch (about 3 mm) with respect to the laser plane. Thus, with the receiver masts effectively shortened, the plow will be higher than normal with respect to the final desired grade. With the receivers pitched forward about eight to ten inches (about 20-25 cm), the plow will be approximately ⅜ to ½ of an inch (about 10-13 mm) above the desired grade. This is beneficial for making a quick-pass or pre-screed pass with the screeding device. With the screeding device adjusted in this manner, the operator is then able to move the screeding device over and through the placed concrete to plow the excess concrete back and out of the area to be screeded. As can be seen in FIG. 36, the quick-pass functions to establish a level of concrete G' that is above the desired grade G. The next screeding pass over the same area would be screeded normally with the machine adjusted normally and the automatic level function in operation. The quick-pass technique thus may substantially reduce the amount of manual raking by on-site workers.

In the quick-pass mode, the vibrating member is at a steeper angle of attack A (FIG. 36) than normal, with only about the last two inches (about 5 cm) or so of the trailing edge of the vibrator being engaged with the concrete. The vibrator may be activated or deactivated depending upon the conditions of the concrete and operator preference. With a normal screeding pass immediately following the quick-pass, the finish quality of the concrete during the quick-pass is not important.

Optionally, the screeding device may have a drive speed control or input or switch 1172 and propel switch 1174 at the control panel 1154 for controlling the speed and travel direction of the screeding device. The drive speed control 1172 may consist of a twist grip on the handlebar 1149*a* that controls the speed of the screeding devices two propulsion drive wheels. For example, twisting the grip toward the rear of the machine may increase the speed of the drive wheels, while twisting the grip toward the front of the machine will decrease the speed of the drive wheels. The drive speed control may not change the operating speed of the engine, but instead may only regulate the total amount of hydraulic fluid that is delivered to the wheel drive motors, such as via a pressure-compensated flow control. In addition, the drive speed control may not automatically return to the off, closed, or otherwise neutral position, but instead may remain where it is set by the operator until the grip is moved again. This may substantially reduce hand effort and fatigue for the operator during long screeding passes. The propel switch 1174 may comprise a rocker type electrical switch that controls the direction of travel of the machine. Thus, it may have only two positions: either forward or reverse, where reverse is the normal screeding direction.

Optionally, the screeding device may include an operator presence switch 1176, which may be located at the handlebar grip, such as at the opposite grip 1149*b* from the drive speed control 1172. For the purposes of safety, it may be held down (closed) under the grasp of the operator's hand in order for the machine to be driven and for the screed head's vibrator to operate. When the operator presence switch is released, the drive wheels and vibrator may be deactivated and the screeding device may come to a complete stop. Preferably, when the switch is released, the engine may remain running while the head lift function and the electrical system also remain functional.

The screeding device may also include a free wheel function or system that selectively allows the driven wheels to freely rotate, and may also include a power steer function or system that selectively drives the wheels independently of one another to steer and turn the screeding device as it is moved or driven over and through the uncured concrete. The free wheel and power steer functions are essentially maneuvering aids for reducing operator effort as well as for increasing the capabilities of the machine. In the illustrated embodiment, there are two free wheel/power steer momentary rocker switches 1178 (such as one switch for each wheel motor) located on the operator's console 1154 adjacent the operator's handle grips at each side. When the operator is driving the machine, the switch or switches can be easily activated via use of the thumb. For example, when one of the rocker switches is depressed forward, the free wheel function may be enabled for the drive wheel at that corresponding side of the machine. When the rocker switch is depressed backward, the power steer function is enabled for the drive wheel at that side of the machine. Preferably, both the left and right rocker switches are momentary type switches, such that they must be depressed either forward or backward and held for as long as the particular function requires activation.

The free wheel function is used to help reduce the operator's effort while maneuvering and steering the machine, typically when not screeding concrete. When the free wheel function is activated on either side of the machine, the respective electro-hydraulic solenoid valve is activated within the hydraulic system. Both respective electro-hydraulic valves may be plumbed in parallel with the left or right wheel drive motors. This enables blocking normal hydraulic pressure to a motor while at the same time allowing fluid within the motor be circulated freely through the electro-hydraulic valve and back to the motor with little or substantially no resistance to the fluid flow. A freely turning drive motor allows the drive wheel on the activated side to spin substantially freely in either direction, while the opposite wheel may remain driven under hydraulic power when the free wheel function on the opposite side is not activated. With one wheel driving and one wheel able to free wheel, it is considerably easier for the operator to sharply turn and steer the machine.

The free wheel function may also be used as a means for the operator to move the machine if hydraulic pressure or engine power should become temporarily lost. For example, the operator can depress both the free wheel switches at the same time, thus energizing both electro-hydraulic by-pass valves. When in this mode of operation, the machine can be pushed, pulled, and generally maneuvered without the engine running. Because the by-pass valves may have to be energized, it is envisioned that the ignition key to the screeding device may have to be in the "on" position to activate the free wheel system.

The power steer function is similar to the free wheel function described above. The power steer function is used while gradually screeding around obstacles or when screeding with a heavy load of concrete at only one end of the plow. The power steer function also allows the machine to perform a powered turn in a long arc in either the left or the right directions. For example, if the left power steer switch is activated, the left side wheel speed may be reduced while the right side wheel speed may be increased. This will cause the machine to gradually steer to the left in an arc without heavy steering input by the operator. Additionally, if only the right end of the plow is engaged with a heavy load of concrete, depressing the left power steer switch will also help the operator counter the unbalanced load on the machine by reducing power to the left side wheel and increasing drive speed to the right side wheel. This may greatly assist the operator in keeping the machine traveling in a desired straight line. Depressing the right power steer switch offers the same function as the left power steer switch, except that it steers or pulls the machine in the opposite direction.

Optionally, the intensity level of the power steer function may be adjustable at either side. For example, if the operator finds that the power steer function is either too forceful or too weak at either side, or is otherwise not balanced from side to side, adjustments can be made using two potentiometers or the like, which may be located under the engine cover at the right front frame rail of the machine. Turning the knobs of the potentiometers in one direction will make the power steer react more strongly, while turning them in the other direction will reduce the power steer reaction. The adjustable potentiometers provide an electrical means to readily adjust each of the electro-hydraulic proportional flow control valves and, thus, offer the ability to fine-tune the hydraulic fluid flow to each of the wheel drive motors.

Optionally, the screeding device may include a traction assist feature, which may be activated and deactivated via a control or input or switch 1179 at control panel 1154. When deactivated, the wheels are driven independently, with the hydraulic fluid flowing to the wheel motor that encounters the least resistance. When activated, the hydraulic system functions to balance the power or fluid flow between the two wheel motors, which enhances traction of the wheels when slippage is encountered.

Figure 37:
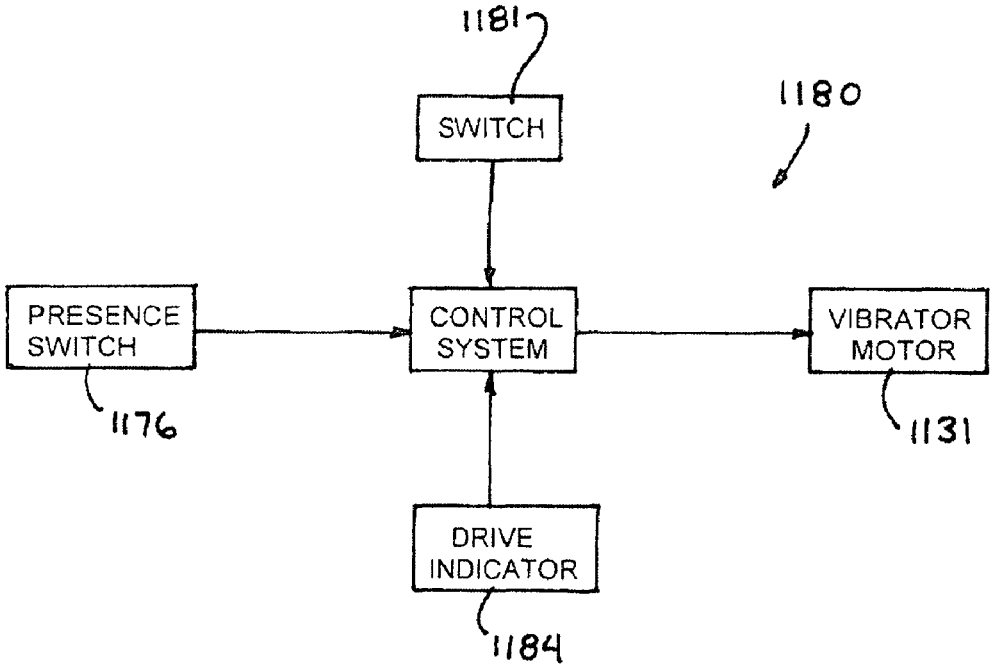
FIG. 37 is a schematic of a soft-start system of the present invention that is useful with the concrete working device.

Optionally, the screeding device may include a vibrator start delay or "soft-start" function or system 1180 (FIG. 37). The vibrator start delay system may include a vibrator switch 1181, such as a rocker type electrical switch, that controls the on-off operation of the hydraulic motor 1131 of the screed head vibrator 1120. The vibrator switch may be set to either an "off" setting or an "auto" setting. In the "off" position, the hydraulically driven vibrator motor 1131 is disabled and will not operate. In the "auto" position, the vibrator motor will only operate while the screeding device or machine is being driven in the reverse direction, for example, while screeding concrete. The movement of the screeding device in the screeding or reverse direction may be determined by a drive indicator 1184, which (similar to drive indicator 1168 described above) may comprise a wheel speed sensor or a switch setting of the switch or switches for the drive propulsion and/or steering systems, or any other means for indicating movement of the screeding device in the screeding direction or for otherwise providing such indication to the control system. Preferably, the operator presence switch 1176 must also be activated in order to activate the vibrator. If the machine is momentarily stopped while driving or screeding in the normal reverse direction, the vibrator will automatically stop. If the machine is moved in the forward driving direction, the vibrator will remain stopped. When again starting to drive or screed concrete in the reverse direction, the vibrator will start automatically. The soft-start function of the present invention thus actuates the vibrating member in a predetermined delayed fashion when movement of the screeding device occurs and thus limits or substantially precludes indentations from being formed in the concrete surface by the action of a stationary vibrator on the freshly leveled concrete surface.

By design, the screed head of the screeding device is partially supported by the vibrating member as it makes contact with and rests upon the surface of the uncured concrete. If the vibrating member remains stationary while vibrating and while supported upon the uncured concrete, the vibrating member will have a tendency to sink into the concrete. In other words, if the vibrator were to run continuously while the machine is stopped or not moving, an undesired depression will likely be created in the uncured concrete. Turning off the vibrator whenever the rearward travel of the machine is interrupted will limit or substantially preclude the vibrating member and screed head from sinking into the uncured concrete.

Optionally, the vibrator start delay function or control system or assembly 1180 may provide a hydraulic flow ramp-up feature, and may consist of a small hydraulic accumulator connected to the input port of the hydraulically driven vibrator motor. The hydraulic accumulator may be charged with nitrogen gas, such as up to about 200 p.s.i. (about 13.8 bar) of pressure. A floating piston may separate the nitrogen gas from the hydraulic fluid. When at rest, the floating piston is forced toward the single inlet port of the accumulator, whereby all the hydraulic fluid or oil is forced out of the accumulator housing. When the vibrator function is first engaged, a portion of the pressurized hydraulic fluid that would normally start the vibrator motor turning is momentarily diverted into the accumulator. This is because the starting pressure for the motor is higher than the nitrogen pressure behind the piston of accumulator, and pressurized hydraulic fluid always seeks the path of least resistance. The pressurized fluid thus initially flows into the accumulator, and as the pressure builds, the hydraulic fluid also enters the vibrator motor and begins gradually turning it. This automatically delays the vibrator motor from reaching full speed too quickly and effectively prolongs spin-up of the motor to full speed.

Although described as a hydraulic ramp-up function, it is envisioned that the vibrator start delay system may comprise other means for delaying the start of the vibrator motor until the screeding device is moved in a screeding direction. For example, a timer (such as an electronic delay timer or timing device or the like) may be implemented which functions to actuate the vibrator motor a predetermined period of time following the initial movement of the screeding device in the screeding direction. The timer may be used in conjunction with a hydraulic ramp-up function if desired. Such timing means or other delay and/or ramping means may be implemented to automatically actuate the vibrator motor when the screeding device is moved in the screeding direction, without affecting the scope of the present invention. The vibrator start delay system or soft-start system thus may allow the screeding device to move a short distance in the reverse (screeding) direction before the vibrating member actuates and/or comes up to full speed. Such a feature serves to lessen the impact of the vibrator starting too suddenly and forcefully while remaining stationary upon the uncured concrete. The vibrator soft-start system of the screeding device of the present invention thus automatically serves to reduce the creation of start-up depressions in the screeded concrete surface. This makes the task of the operator, and especially the inexperienced operator, much easier.

Figure 38:
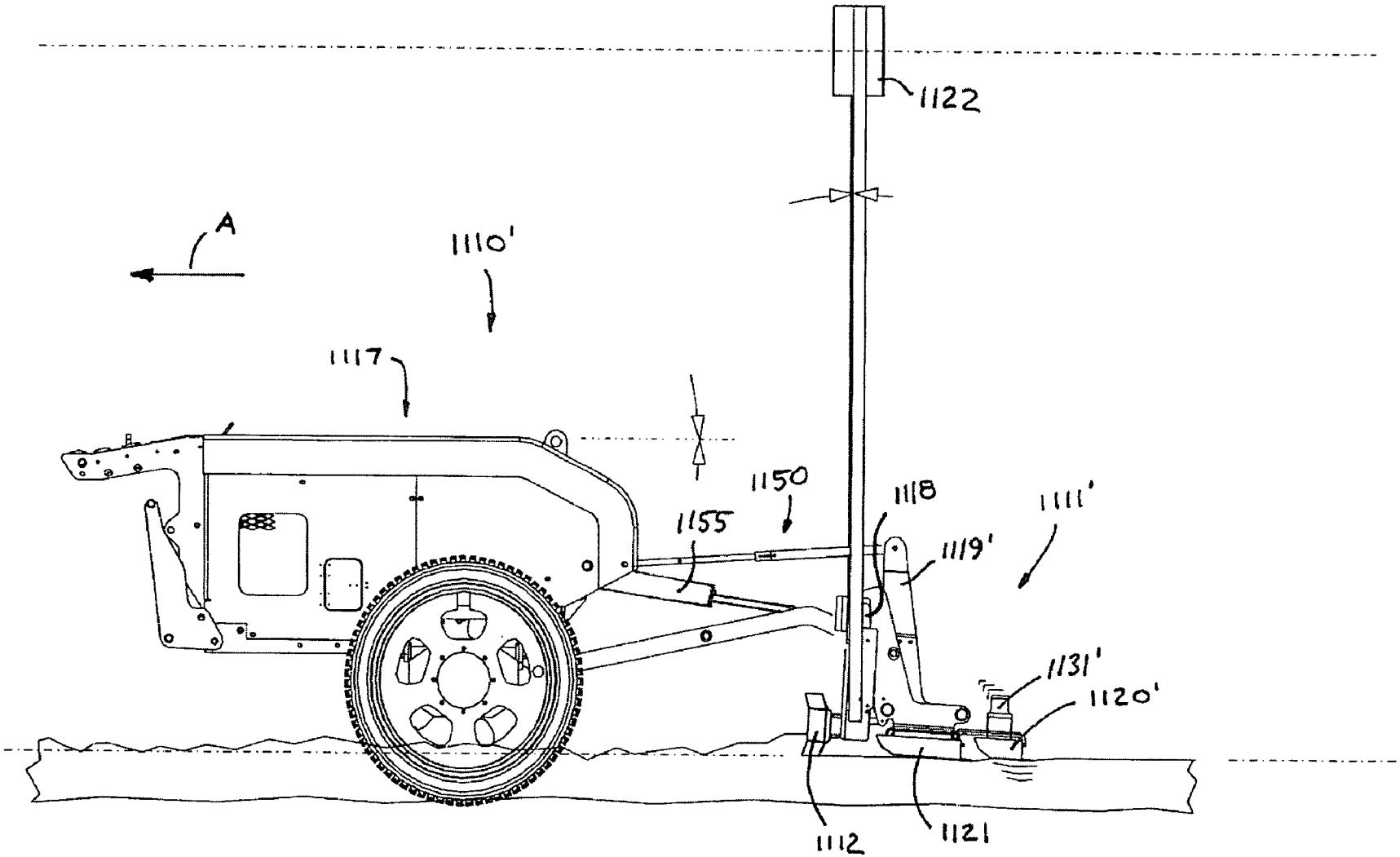
FIG. 38 is a side elevation of another concrete working device in accordance with the present invention.

Optionally, and as shown in FIG. 38, the head assembly 1111' of a screeding device 1110' may include a vibrating member 1120' and a second float or generally elongated planar member 1121 positioned forward of the vibrating member when the screeding device is moved in the screeding direction (the direction of the arrow A in FIG. 38). The second float member 1121 may be adjustably mounted to the wheeled support 1117 via a lift assembly 1150. As described above, the elongated vibrating member 1120' vibrates the concrete and floats upon the concrete surface, thus providing a support and an elevation reference for the screed head end of the machine. The second float member 1121 is located adjacent to the vibrating member and, in a preferred arrangement and as shown in FIG. 38, between the vibrating member and the wheeled support, with the vibrating member following with respect to the direction of screed head travel during the screeding operation.

The grade setting device or plow 1112 may then be adjustably mounted at a rearward portion (which is the leading portion of the screed head when the screeding device is moved in the screeding direction or rearwardly) of the rear or second float member 1121 to establish the desired grade of the uncured concrete as the screeding device is moved over and through the uncured concrete, such as described above. Similar to the other screeding devices described herein, the plow 1112 may be adjustable relative to the second float member 1121 via actuators 1118, which may extend and retract in response to the laser receivers 1122 to cause the plow to engage the uncured concrete and to establish the desired grade or reference surface on which the float member 1121 and the vibrating member 1120' will rest as the screeding device is moved over and along the uncured concrete.

As can be seen in FIG. 38, the float member is mounted to the lift assembly 1150 via a bracket or link **1119*a*', whereby adjustment of the lift assembly 1150, such as via extension and retraction of an actuator (not shown in FIG. 38), causes movement of the float member 1121 and vibrating member 1120' relative to the wheeled support 1117. The vibrating member 1120' may include a generally planar member that is vibratable via a vibrating motor 1131' in a similar manner as described above. The vibrating member 1120' may be substantially rigidly attached (and/or may be adjustably mounted) to the trailing edge or portion of the float member 1121 such that adjustment of the attack angle and height or level of the float member 1121 causes a corresponding adjustment of the attack angle and height or level of the vibrating member 1120'. The screeding device 1110'** may be otherwise similar to the screeding devices discussed above, such that a detailed discussion of the screeding devices will not be repeated herein.

The second float member or split design allows the proportions of the vibrating member contact area with the concrete to be different with respect to the contact area of the floating member. In other words, the proportions of the contact areas may be different to offer the advantage of optimizing the effect of each member independently. For example, if the vibrating member 1120' was narrower in width that the floating member 1121, a more intense amount of vibration energy could be transferred into the concrete by a smaller member and through a smaller area. This could reduce the power requirements, cost, and complexity of the vibrator actuator to achieve the same results. Similarly, the width of the floating member could be increased to effectively increase the surface contact area with the concrete. Structurally, such an arrangement may be beneficial for the design of the floating member. Without having to address concerns related to both vibration and maintaining component strength at the same time, the floating member could be more simply designed and ultimately manufactured at a lower cost. This could reduce the overall cost of the product and provide greater value in the marketplace.

An additional benefit to the split design is related to the vibrator soft-start system, discussed above. With a vibrating and floating member split design, some of the concerns of having the vibrator sink into the concrete whenever forward travel of the machine is stopped are reduced. With the machine stopped, the vibrating member could continue vibrating the surface of the concrete, while the floating member continues the support the screed head end of the machine at the correct (or nearly correct) elevation. This brings the opportunity of supplementing the vibrator soft-start function or perhaps eliminating the need for it all together.

The wheeled support 1117 of the screeding device 110, 1110' includes a lower frame portion 1117*a* that supports the wheels 1117*b* and the axle, and an upper frame portion 1117*c* that supports the lift assembly 1150 and thus the screed head 1111. The upper frame portion is pivotally mounted to the lower frame portion and may pivot about a generally longitudinal axis of the wheeled support. This allows the upper frame portion and the screed head to pivot side to side to maintain the screed head substantially horizontal even when the wheels encounter uneven terrain as the screeding device is moved over and along the uncured concrete. The screed head is thus substantially isolated from the effect of such bumps and obstacles on the sub-floor because it is attached to the upper frame portion.

Optionally, the screeding device may include a side lock switch or input or control 1182 at control panel 1154. When the side lock switch is set to the "on" position, the upper and lower frame portions may be substantially locked together (such as via a side lock device or member selectively connectable between the upper and lower frame portions) and thus do not move independently. Such an arrangement may be useful when transporting the screeding device because the upper frame may otherwise tip side to side during such transportation. When the side lock switch is set to the "off" position, the upper frame portion may move side to side independently of the lower frame portion, regardless of the other settings of the screeding device.

Preferably, the side lock switch may be set to an "auto" position, where the upper and lower frame portions are locked together, except when the screeding device is performing a screeding pass. In other words, upper and lower frame portions may pivot or move relative to one another when the propel switch is set to reverse and the operator presence switch is depressed (or in response to other means for indicating movement of the screeding device in the screeding direction). When the screed pass is completed, the side lock function will automatically lock the upper and lower frame portions together, so that the screeding device is easier to maneuver to the beginning of the next screed pass.

Optionally, and as described above with reference to screeding device 310, the screeding device 1110, 1110' may include counterweights that may be either added or subtracted at either end of the frame to adjust the balance of the screeding device. This offers the operator the ability to adjust the down pressure of the screed head based on the condition of the uncured concrete and site conditions. When screeding concrete, the concrete load against the plow can vary considerably. Accordingly, the drive torque at the wheels may also vary and the corresponding reactionary torque taken by the vibrating member against the concrete may in turn vary.

Optionally, the screeding device may include a weight adjustment function or system that may shift the weights, and thus the balance of the screeding device, automatically. For example, the weights may be moved or shifted automatically along a longitudinal track in the fore-aft direction. The weights (or a single weight) may be manually adjustable, such as by depressing a rocker switch at the operator's console. Optionally, a pressure switch in the wheel drive hydraulic circuit may be used to sense the propulsion system pressure, and a controller may then receive a signal from the pressure switch. The output of the controller then may actuate a linear position actuator to move the adjustable counterweight fore or aft as needed to maintain constant vibrating member pressure against the concrete. Optionally, the weight may be moved in response to an output signal from a force sensor at the screed head that measures the down pressure exerted by the vibrating member against the concrete surface, such as described above with respect to screeding device 310.

Although many of the screeding devices of the present invention are each shown as having a vibrating beam or member which is vibrated in response to rotation of eccentric weights having their axes of rotation oriented generally vertically or generally normal to the plane of the surface of the vibrating beam which contacts the uncured concrete, other vibrational devices may be implemented without affecting the scope of the present invention. For example, it is envisioned that the axes of rotation may be vertical, horizontal, angled, or skewed, to provide vibration at least partially in the vertical direction or entirely in the horizontal direction as well. It is also envisioned that both the vibrating beam and the vibrating device may be angled from horizontal along the direction of travel of the screeding device. This would allow for some fore/aft vibration of the vibrating beam against the uncured concrete as the screeding device is moved along and supported on the uncured concrete surface. It is further envisioned that the vibrating member may be vibrated via any other vibrational device, such as at least one eccentric weight rotating about a generally horizontal axis along the vibrating member, or a pneumatic vibration device, or any other means for vibrating the member or beam, without affecting the scope of the present invention.

It is further envisioned that various devices may be implemented at the screed head of the screeding device of the present invention. For example, the screed head may include a vibrating beam, a plow or an auger or may include any combination of a vibrating beam, a plow and/or an auger for grading, leveling, smoothing and/or screeding the uncured concrete surface. Optionally, the screed head may include a leveling roller or a spinning tube, which may be rotatable to roll over the concrete surface to level and/or smooth the surface. Optionally, the leveling roller may be of the type disclosed in commonly assigned, U.S. Pat. No. 6,695,532, which is hereby incorporated herein by reference.

Therefore, the present invention provides a lightweight, easily maneuverable screeding device which is operable to consolidate, smooth, level and/or screed uncured concrete, and is ideally suited for use on elevated deck surfaces. The screeding device of the present invention avoids the need for using metal stands or for manually creating wet screed pads in the uncured concrete in advance of the screeding operation, because the screed head essentially creates its own continuous wet screed pads as the screeding device is moved or pulled over the uncured concrete by an operator. The screeding device is easily movable, steered and/or pulled by an operator over the uncured concrete surface, while the vibrating beam or member vibrates to smooth and compact the concrete at the surface as it is supported thereon. A strike-off plow or other grade setting device is positioned along a forward edge of the vibrating beam to establish or cut the grade of the uncured concrete to a desired grade or level. The weight of the screeding device at least partially rests upon the uncured concrete surface and may include no wheels with only an operator providing partial support, a single wheel, or preferably a pair of wheels, for at least partially supporting components of the screeding device and for enhancing mobility and maneuverability of the screeding device. Optionally, the wheels may be powered or driven to further enhance the mobility, maneuverability, work output, and usefulness of the screeding device.

Optionally, the level or elevation of the plow or grade setting device may be automatically adjusted in response to a laser plane using laser receivers or optionally a laser-guided 3-D reference system for vertically adjusting the grade setting device to the desired grade height. The screeding device may also or otherwise provide a visual indicator to the operator as to the current status of the grade. Optionally, the screeding device may include a concrete moving device, such as an auger or other means for engaging and moving excess uncured concrete to either or both sides or just ahead of the screeding device as the screeding device is moved through the uncured concrete. The concrete moving device may be implemented along a forward edge of a strike-off plow, which cuts or establishes the desired grade height, or may be implemented on a forward edge of the vibrating beam without a strike-off plow, whereby the concrete moving device is operable to cut or establish the desired grade height of the uncured concrete as the screeding device moves along and through the uncured concrete.

Changes and modifications in the specifically described embodiments may be carried out without departing from the principles of the present invention, which is intended to be limited only by the scope of the appended claims, as interpreted according to the principles of patent law.

The invention claimed is:

1. A wheeled screeding device movable over a surface of uncured concrete and being operable to level and smooth the uncured concrete surface, said wheeled screeding device comprising:

a wheeled support having a frame portion supported by at least one wheel, said at least one wheel having an axis of rotation, wherein said axis of rotation is disposed between a forward end of said frame portion and a rearward end of said frame portion;

a screed head disposed at said rearward end of said frame portion and an operator control element disposed at or near said forward end of said frame portion, wherein said wheeled support is balanced such that said screed head is at least partially supportable on an uncured concrete surface, and wherein said screed head is adapted to impart a force onto the uncured concrete surface; and an adjustment device operable to adjust a balance of said wheeled support about said axis of rotation to adjust said force imparted by said screed head.

2. The wheeled screeding device of claim 1, wherein said adjustment device comprises at least one weight at least one end of said wheeled support.

3. The wheeled screeding device of claim 1, wherein said adjustment device is operable to adjust a position of said frame portion relative to said axis of rotation.

4. The wheeled screeding device of claim 1, wherein said screed head comprises a vibratable member for engaging and smoothing the uncured concrete surface.

5. The wheeled screeding device of claim 4, wherein said screed head includes a grade setting device which is adjustably mounted to the vibratable member, said grade setting device being adjustable relative to said vibratable member to at least one of establish and indicate a desired grade of the concrete surface.

6. The wheeled screeding device of claim 4, wherein said screed head includes a means for moving excess concrete from in front of said vibratable member.

7. The wheeled screeding device of claim 1, wherein said screed head comprises a grade setting device for establishing a desired grade of the uncured concrete surface.

8. The wheeled screeding device of claim 2, wherein said at least one weight at least one end of said wheeled support comprises at least one weight that is movably disposed at said wheeled support to adjust the balance of said wheeled support about said axis of rotation to adjust said force imparted by said screed head.

9. The wheeled screeding device of claim 1, wherein said operator control element is operable by an operator of said wheeled screeding device to at least partially control said wheeled screeding device while said wheeled screeding device is moved over a surface of uncured concrete and while said wheeled screeding device is operated to level and smooth the uncured concrete surface.

10. The wheeled screeding device of claim 9, wherein said operator control element comprises at least one handle for an operator to grasp while moving said wheeled screeding device in a screeding direction.

11. The wheeled screeding device of claim 10, wherein said wheeled screeding device and said at least one handle are configured for use by an operator walking in front of said wheeled screeding device as it moves in the screeding direction.

12. The wheeled screeding device of claim 1, wherein said operator control element comprises at least one user actuatable input that is actuatable by the operator of said wheeled screeding device to electrically control said wheeled screeding device while said wheeled screeding device is moved over a surface of uncured concrete and while said wheeled screeding device is operated to level and smooth the uncured concrete surface.

13. The wheeled screeding device of claim 12, wherein said at least one user actuatable input comprises a plurality of user actuatable inputs disposed at a control panel disposed at or near said forward end of said frame portion.

* * * * *

UNITED STATES PATENT AND TRADEMARK OFFICE

CERTIFICATE OF CORRECTION

PATENT NO. : 7,909,533 B2
APPLICATION NO. : 12/356635
DATED : March 22, 2011
INVENTOR(S) : Philip J. Quenzi et al.

It is certified that error appears in the above-identified patent and that said Letters Patent is hereby corrected as shown below:

Column 1
Line 18, “application” should be --applications--

Column 14
Line 30, “rates” should be --rakes--

Column 24
Line 24, “fighting” should be --flighting--
Line 29, “fighting” should be --flighting--
Line 34, “fighting” should be --flighting--

Column 32
Line 57, “111” should be --1111--

Column 33
Line 11, “117b” should be --1117b--
Line 12, “diameter×3½” should be --diameter × 3½--

Column 34
Line 26, “11111” should be --1111--

Column 43
Line 5, “110” should be --1110--

Column 45
Line 47, Claim 2, Insert --at-- after “weight”

Column 46
Line 17, Claim 8, Insert --at-- after “weight”

Signed and Sealed this
Fifteenth Day of November, 2011

David J. Kappos

David J. Kappos
*Director of the United States Patent and Trademark Office*